US006402314B1

(12) United States Patent
Sato et al.

(10) Patent No.: US 6,402,314 B1
(45) Date of Patent: Jun. 11, 2002

(54) INKJET RECORDING APPARATUS

(75) Inventors: Tatsuru Sato; Katsuhiko Sato; Masayoshi Shiraishi; Hiroshige Ikeno, all of Tokyo (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 08/183,693

(22) Filed: Jan. 19, 1994

(51) Int. Cl.[7] ..... B41J 2/17
(52) U.S. Cl. ..... 347/98
(58) Field of Search ..... 347/101, 105, 347/102, 103, 98

(56) References Cited

U.S. PATENT DOCUMENTS

| | | | | |
|---|---|---|---|---|
| 4,538,160 A | * | 8/1985 | Uchiyama | 347/101 |
| 4,877,688 A | * | 10/1989 | Senoo et al. | 347/105 |
| 5,005,025 A | * | 4/1991 | Miyakawa et al. | 101/424.1 |
| 5,165,973 A | * | 11/1992 | Kojima et al. | 347/105 |
| 5,171,626 A | * | 12/1992 | Nagamine et al. | 347/105 |

FOREIGN PATENT DOCUMENTS

| | | |
|---|---|---|
| JP | 60150044 | 10/1985 |
| JP | 61249755 | 11/1986 |
| JP | 63299970 | 12/1988 |
| JP | 2251453 | 10/1990 |
| JP | 3079349 | 4/1991 |
| JP | 3092351 | 4/1991 |
| JP | 3292144 | 12/1991 |

* cited by examiner

*Primary Examiner*—John Barlow
*Assistant Examiner*—Julian D. Huffman
(74) *Attorney, Agent, or Firm*—Adams & Wilks

(57) ABSTRACT

An inkjet recording apparatus comprises an inkjet recording device for discharging recording ink according to a recording signal and for recording on a recording medium, and a coating device for coating a coating material on the recording medium prior to recording by the inkjet recording device. The inkjet recording device comprises at least one first orifice for discharging the recording ink on the recording medium, a first passage in communication with the first orifice for receiving a supply of the recording ink, and a first heating device for heating the recording ink supplied to the first passage. The coating device has at least one second orifice for discharging the coating material on the recording medium, a second passage in communication with the second orifice for receiving a supply of the coating material, and a second heating device for heating the coating material supplied to the second passage.

27 Claims, 41 Drawing Sheets

FIG. 20
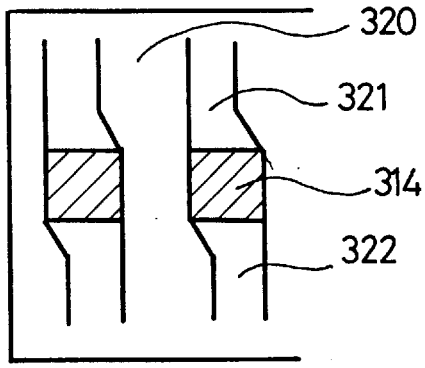
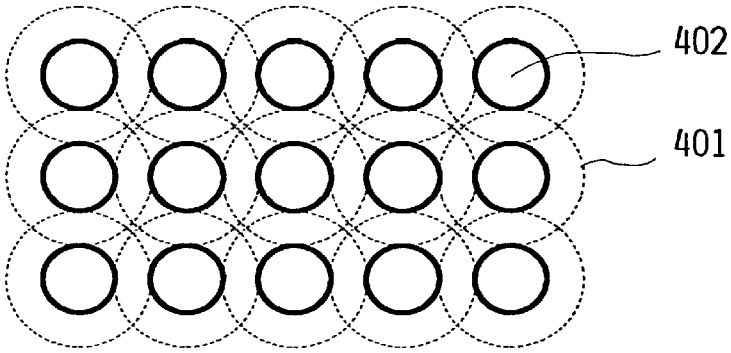
FIG. 21(a)
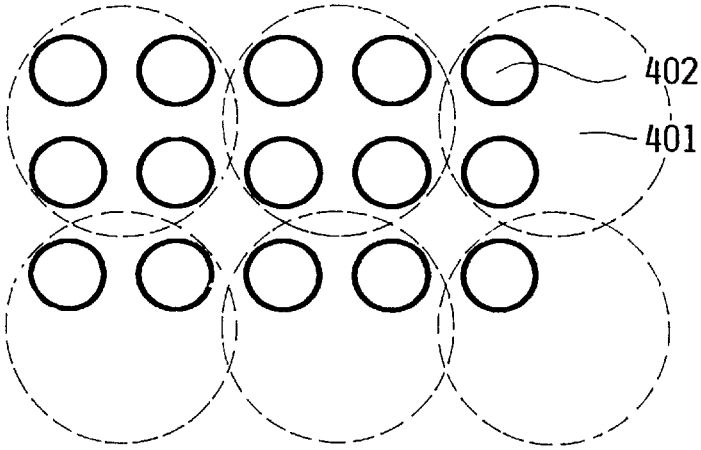
FIG. 21(b)

FIG. 22

| No. | Composition of coating liquid (weight %) | Viscosity (cp@20℃) | Head current Ith (mA) | Duration time tp(μs) |
|---|---|---|---|---|
| A | Polyvinyl alcohol saponificated completely C-05<br>average degree of polymerization : 550<br>degree of saponification : 98.5 % more } 3<br>Ethanol 10<br>Water 87 | 3.0 | 220 | 7.5 |
| B | Polyvinyl alcohol saponificated completely C-10<br>average degree of polymerization : 1000<br>degree of saponification : 98.0 ~ 99.0 % } 2<br>Ethanol 5<br>Water 93 | 3.0 | 220 | 7.5 |
| C | Polyvinyl alcohol saponificated completely C-17<br>average degree of polymerization : 1700<br>degree of saponification : 98.0 ~ 99.0 % } 1<br>Ethanol 3<br>Water 96 | 3.4 | 240 | 7.5 |
| D | Polyvinyl alcohol saponificated intermediately MA-17<br>average degree of polymerization : 1700<br>degree of saponification : 96.0 ~ 97.0 % } 1<br>Ethanol 10<br>Water 89 | 4.2 | 230 | 10.0 |
| E | Polyvinyl alcohol saponificated partially PA-10<br>average degree of polymerization : 1000<br>degree of saponification : 86.0 ~ 90.0 % } 1<br>Ethanol 10<br>Water 89 | 3.7 | 200 | 10.5 |
| F | Polyvinyl alcohol saponificated partially PA-15<br>average degree of polymerization : 1500<br>degree of saponification : 86.0 ~ 90.0 % } 1<br>Ethanol 14<br>Water 85 | 2.8 | 200 | 9.0 |

FIG. 23

| No. | Composition of coating liquid (weight %) | | Viscosity (cP@20°C) | Discharge orifice size of coating head | | |
|---|---|---|---|---|---|---|
| | | | | 35 μm □ | 45 μm □ | 55 μm □ |
| A | Polyvinyl alcohol saponificated partially B-03<br>average degree of polymerization : 350<br>degree of saponification : 86.0 ~92.0 %<br>Ethanol<br>Water | 4<br><br><br>6<br>90 | 3.2 | ○ | ○ | ◎ |
| B | Polyvinyl alcohol saponificated partially B-05<br>average degree of polymerization : 550<br>degree of saponification : 87.0 ~ 89.0 %<br>Ethanol<br>Water | 4<br><br><br>6<br>90 | 4.8 | ○ | ◎ | ◎ |
| C | Polyvinyl alcohol saponificated partially B-17<br>average degree of polymerization : 1700<br>degree of saponification : 87.0 ~ 89.0 %<br>Ethanol<br>Water | 2<br><br><br>8<br>90 | 3.8 | ◎ | ◎ | ◎ |
| D | Polyvinyl alcohol saponificated intermediately H-17<br>average degree of polymerization : 1700<br>degree of saponification : 95.0 ~ 96.0 %<br>Ethanol<br>Water | 2<br><br><br>8<br>90 | 5.0 | ○ | ◎ | ◎ |

INKJET RECORDING APPARATUS

BACKGROUND OF THE INVENTION

This invention relates to a coating material for coating on the surface of a recording medium used in the inkjet recording method, and more particularly to an inkjet recording apparatus for recording ink on a recording medium coated with such coating material.

The inkjet recording method is a method of recording information where small drops of ink are generated and applied onto a recording medium, such as paper, and all or a portion of the ink is adhered on the recording medium by means of the ink discharge method, such as a sucking system by electrostatic power, a system in which mechanical vibration or displacement is given to the ink with piezoelectric elements, and a system utilizing pressure where the pressure is generated by heating the ink to form bubbles. The inkjet recording method is associated with high speed and high quality multi-color recording.

In the inkjet recording method, in order to avoid an inferior recording quality due to bleeding and/or flowing of adhered ink on the recording medium, a specialized recording medium is used. For example, the recording medium is a specially coated paper on which a layer of inorganic pigment is coated which provides a larger amount of water absorption and color constituent absorption contained in the ink. Alternatively, the recording medium has a special film on which the surface is specially processed for ink-flow resistivity.

In the foregoing prior art recording medium, there exists a problem that without such specialized and limited type of recording medium, a higher quality of recording is not maintained in the inkjet recording method. That is, when users who handle the prior art inkjet recorders misuse the recording medium, they encounter problems in that they fail to achieve high quality recording because of bleeding of the ink and in that fatal contamination occurs within the printing mechanism and the recorder because of flowing of the ink.

Moreover, the high cost of the recording medium because of special processing and/or special materials required poses another problem.

In the inkjet recording method, where the ink is particularized into droplets and discharged from nozzles of a recording head onto the recording medium such as a recording paper, etc., and characters, drawings, etc., are printed on the recording medium, it is required that the particularized ink droplets to be discharged from nozzles of the recording head should be about 30 $\mu$m in diameter with homogeneity in size and shape, and that such ink droplets be discharged onto the recording medium constantly and regularly to form an image with a dot array of ink drops. But in order to satisfy the foregoing fundamental functional requisites during practical usage, the inkjet recording apparatus should be free from such problems peculiar to the inkjet recorder as, for example, clogging at orifices of nozzles due to caking of the ink, change in viscosity of the ink due to change in atmospheric temperature and humidity, deterioration of the quality of the ink with age in longer term stock, and evaporation of ink solvent at the ink supply system. Therefore, the selection and design of the ink for the inkjet recorder should be optimized, taking with integrity into account, for example, the recording head, the ink supply system, the recording media, and the head driving condition.

Under the foregoing conditions, two kinds of inks, water base and oil base ink, according to solvent classification, are in use for the inkjet recorders for output devices and for computers and office automation equipment. The main characteristics of water base and oil base ink are as follows: the water base ink has higher stability in discharge due to stronger surface tension and has, therefore, higher selectivity and chemical stability in/with materials for an ink tank and other components for the ink supply systems which have direct contact with the ink. The oil base ink has higher selectivity in and better fixability on the recording media such as a paper and better water resistant property after the recording. However, a vital feature considered in selecting the type of ink is the safety to the human body as a result of its flammable and odor characteristics. For this reason, a water base ink has been widely used.

Since water base ink is discharged through a very fine orifice (approximately 20–50 $\mu$m in diameter) which is formed as a hole on the recording head nozzle, its principle components are water soluble dye, such as direct dye and acid dye, different from the printing ink in general use, and water which is the principle solvent. Additional components, such as miscellaneous additive(s), if necessary, may be added. The percentage of water in the water base ink, in practical use, is approximately 80% and the ink discharged through the nozzle of the recording head is fixed to the recording medium through a drying process, usually air drying.

Since the water base ink applied during prior art inkjet recording usually has a high percentage of water, most of the duration time from its discharge through the recording head nozzle until anchoring to the recording medium is for evaporation of the water as the principal component. Atmospheric temperature and humidity affects, of course, the duration of the evaporation and it depends sometimes on the types (and materials) of the recording medium. The length of the duration of evaporation, in turn, reflects directly on the duration time of the image production and quality of image on the recording medium. A plain paper is commonly used as the recording medium. When plain paper is used as the recording medium according to the common usage, a longer duration of time is needed for absorption and drying of the ink.

Since humidity on parts of the plain paper spreads over the surface thereof due to delay in absorption and drying, bleeding, waving, wrinkling, etc., on the paper remarkably increase on the plain paper and blotting is apt to occur due to friction between a feeding roller and the undried ink which is undergoing the drying process. Therefore, an inferior quality image results on the plain paper in prior art inkjet recording.

SUMMARY OF THE INVENTION

An object of the present invention is to obtain high quality images during inkjet recording without regard to the type of recording medium used, and to provide an inkjet recorder free from contamination, e.g., inside of the recorder due to flow of the recording ink.

Another object of the present invention relates to an economical coating material for the recording medium for the purpose of inkjet recording with higher quality without regard to the type of recording medium used.

Yet another object of the present invention relates to obtaining high speed and high quality fixing of the ink with stability on the recording medium by shortening the drying time of the ink during inkjet recording by evaporating or drying water which is brought to the recording medium through the discharged ink, as well water which is excessively contained in and/or adhered to the recording medium at the time of inkjet recording.

In order to solve the problems in the conventional art, the inkjet recorder of the present invention provides coating means which coats the coating material upon the recording medium before the recording ink is recorded on the recording medium, the inkjet recorder recording an image on the recording medium by discharging the recording ink according to a recording signal.

Moreover, the coating material according to the present invention, which is coated on the recording medium before the ink is recorded on the recording medium, comprises polyvinyl alcohol which is saponified partially and has a degree of saponification of 60% to 97.5%, or polyvinyl alcohol which is saponified completely having a degree of saponification of 97.5% or more.

The composition formula of polyvinyl alcohol is:

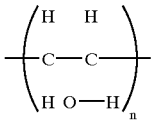

This product is made chemically through hydrolysis of polyvinyl acetate of which composition formula is:

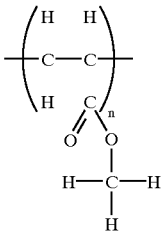

A portion or all of the COOR group in the polyvinyl acetate that is replaced with the OH group is known in general as polyvinyl alcohol. Polyvinyl alcohol which is saponified completely refers to a replacement of the COOR group with the OH group by 97.5% or more, and polyvinyl alcohol which is saponified partially refers to a replacement of the COOR group by the OH group by less than 97.5%. The solubility of the polyvinyl alcohol varies in relation to the degree of the replacement of the COOR group with the OH group as described above.

With respect to solubility in water, polyvinyl alcohol which is saponified completely hardly dissolves in cold water at approximately 20° C., although it swells itself. However, in water at 80° C. or above, polyvinyl alcohol which is saponified completely dissolves. With respect to the ratio of substitution of the OH group for the COOR group, the lower the ratio is the more it dissolves in cold water. That is, the lower the ratio is the higher the solubility ratio of the polyvinyl alcohol is in cold water.

Polyvinyl alcohol hardly dissolves into solvents other than water, but it dissolves into a mixed solvent with methanol or ethanol. Polyvinyl alcohol which is saponified completely dissolves into a mixed solvent of up to 40% with methanol or ethanol. The lower the ratio of substitution of the OH group for the COOR group is, the higher its solubility ratio is in a mixed solvent with methanol or ethanol.

Furthermore, since water is the principal component of the ink for the inkjet recorder which generates tiny ink bubbles and spreads (or sprays) the ink by mechanical vibration using piezo-electric elements or by heating the ink and utilizing pressure to spread (spray) the ink, etc., it is possible to select as the recording medium a coating film that has a certain solubility in water, such as polyvinyl alcohol having the foregoing characteristics.

According to the present invention, the surface of the recording medium is coated with a coating film of a material comprising polyvinyl alcohol which is saponified partially and of which the degree of saponification is 60% to 97.5%, or polyvinyl alcohol which is saponified completely and of which the degree of saponification is 97.5% or above. When the ink is sprayed on the coating film, the ink infiltrates into the coating film and dries quickly without flowing or bleeding on the recording medium.

The characteristics of the coating film changes due to the degree of polymerization of polyvinyl alcohol saponified partially and having a degree of saponification of 60% to 97.5% or of polyvinyl alcohol saponified completely and having a degree of saponification of 97.5% or above. In the present invention, inkjet recording can be performed without flowing or bleeding and without regard to the types of materials used for the recording medium on which the coating film is formed. Preferably, the coating material has the following specifications:

(a) 0.2 to 30% content by weight of polyvinyl alcohol saponified partially or polyvinyl alcohol saponified completely (hereinafter referred to as p.p or p.c, respectively) when the average degree of polymerization of p.p or p.c is 150 to 750;

(b) 0.1 to 20% content by weight of p.p or p.c when the average degree of polymerization of p.p or p.c is 750 to 2000; or (c) 0.05 to 15% content by weight of p.p or p.c when the average degree of polymerization of p.p or p.c is 2000 to 5000.

Polyvinyl alcohol is very stable and less expensive to use as the coating material. This is due to the fact that polyvinyl alcohol is widely used in synthetic paste or as an added agent when the recording paper is made of pulp. Thus the coating materials according to the present invention are economical and allow for the realization of higher quality inkjet recording without regard to the types of recording media used.

Moreover, the coating means facilitates coating of the coating film on the recording medium before the recording ink is recorded. When the recording ink is recorded on the coating film having the foregoing characteristics, high quality inkjet recording is achieved without regard to the type of recording medium used.

In another aspect, the present invention is directed to an inkjet recording apparatus comprising an inkjet recording head for discharging recording ink according to a recording signal and for recording on a recording medium. The inkjet recording head has at least one first orifice for discharging the recording ink, a first passage in communication with the first orifice for receiving a supply of the recording ink, and a heating element for heating the recording ink supplied to the first passage. A coating head coats a coating material on the recording medium prior to recording by the inkjet recording head. The coating head comprises at least one second orifice for discharging the coating material, a second passage in communication with the second orifice for receiving a supply of the coating material, and a heating element for heating the coating material supplied to the passage.

In the inkjet recording apparatus having the foregoing construction, neither special arrangements for coating the coating film nor a complicated configuration of the apparatus is needed. Furthermore, with the inkjet recording head and the coating head having the same structure and the coating material having the foregoing characteristics, high quality recording can be achieved without regard to the type of recording medium used.

Moreover, when the coating material comprises a coating film having the above-mentioned characteristics, the coefficient of viscosity of the coating film may be higher than that of the recording ink, causing the discharge characteristics of the coating head to vary. In such a case, a stable and high quality recording can be achieved, according to the present invention, by providing a control unit for controlling the heating units so that the heating unit for heating the coating film generates a greater amount of heat energy than that generated by the heating unit for heating the recording ink, or by providing the orifice of the coating head with a greater discharge area than the discharge area of the orifice of the inkjet recording head. By providing the coating head with an orifice having a greater discharge area, a higher volume of the coating film can be discharged onto the recording medium, thereby improving the coating efficiency and the overall quality of inkjet recording.

In another aspect, the present invention pertains to an inkjet recording apparatus comprising a coating head for coating a coating material on a recording medium according to a recording signal, a delay circuit for delaying the recording signal for a predetermined amount of time and outputting a delay signal, and an inkjet recording head for discharging recording ink according to the delayed recording signal and for recording on the recording medium. The coating head comprises at least one orifice for discharging the coating material on the recording medium and a passage in communication with the orifice for receiving a supply of the coating material. The inkjet recording head comprises at least one orifice for discharging the recording ink on the recording medium and a passage in communication with the orifice for receiving a supply of the recording ink.

In the present aspect of the invention, the coating material has good compatibility with recording ink and can be coated on a specified area of the recording medium before recording of the recording ink. Furthermore, the coating material according to the present invention can be applied to provide high quality inkjet recording and without regard to the type of recording medium used.

In another aspect, the present invention further comprises a wind pressure generating device and a wind pressure supply device proximate the recording medium and the coating head. By this construction, positive or negative wind pressure can be supplied on the surface of an inkjet recording area of the recording medium during inkjet recording. Thus the excess water which prevents the recording ink from adhering to the surface of the recording medium can be evaporated in a matter of minutes, and the recording ink can adhere to the recording medium with improved stability and high speed to provide high quality images.

BRIEF DESCRIPTION OF THE DRAWINGS

FIG. 20 shows a partial outline top view of an inkjet recording head and a coating head of an inkjet recording apparatus shown in FIG. 16;

FIG. 21 is an explanatory drawing showing the relation between a coating head and an inkjet recording head of an inkjet recording apparatus according to this invention;

FIG. 22 is an explanatory table showing the relation between the composition of a coating liquid, a coefficient of viscosity and the electric current on a coating head or energizing time charged to the coating head of an inkjet recording apparatus according to this invention;

FIG. 23 is an explanatory table of the relation between the composition of a coating liquid, the coefficient of viscosity, the size of a discharge orifice of a coating head, and recording quality of an inkjet recording apparatus according to this invention;

DETAILED DESCRIPTION OF THE PREFERRED EMBODIMENTS

Figure 1:
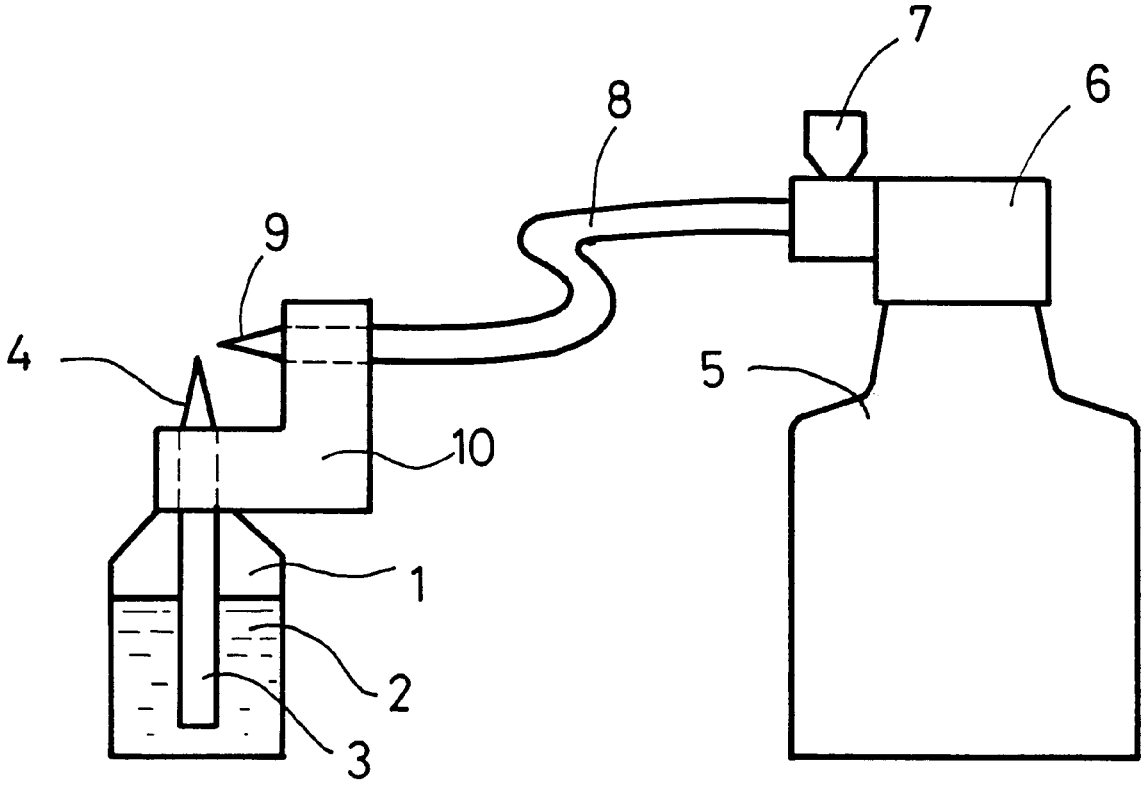
FIG. 1 shows an outline of an air spray coating apparatus for a coating film made of a coating material according to this invention.

A detailed description of the embodiments of the present invention is provided hereinbelow. However, the present embodiments should be considered in all respects illustrative and not restrictive.

(1) Embodiments of Coating Materials.

(The Embodiment 1-1)

After 3 g of polyvinyl alcohol which is saponified completely, of which the average degree of polymerization and degree of saponification were respectively 550 and 98.5%, was placed into a mixed solvent with 95 g of ion-exchanged water and 2 g of ethanol and then mixed well, the solution was heated in a water bath and then dissolved to form a coating material.

The coating material was coated using a coating machine with a bar on the surface of plain paper PPC-K, a product, made by Daishowa Seishi & Co. which is generally referred to as PPC, and used as a plain paper for electrophotography, with a coating gap of 60 $\mu$m and dried to form the recording medium.

On the coated recording medium described above, dot printing of 100 dots was provided using an inkjet recorder filled with ink having the following composition:

(Composition of ink)

| | |
|---|---|
| C. I. Direct Black 168 | 3.0 weight % |
| Ethanol | 8.0 weight % |
| Diethylene glycol | 8.0 weight % |
| ion-exchanged water | 81.0 weight % |

For comparison purpose, on a plain paper PPC-K which was not coated with any coating material, dot printing of 100 dots was provided using the same inkjet recorder in the previous example. The shape and size of the orifice of the nozzle on the inkjet recorder in this embodiment are rectangular and 25 $\mu$m vertically and 40 $\mu$m in width, respectively, and an ink drop of approximately 30–40 $\mu$m in diameter can be discharged at a time.

According to a microscopic survey of measured diameter and circularity, the dots on the coated recording medium described above are 80 $\mu$m–90 $\mu$m in diameter, and 1.02–1.08 in circularity, and are almost completely round and of higher quality. In contrast to the previous example, the dots printed on the recording medium (the plain paper PPC-K) without the coating according to the present invention are 80 $\mu$m–120 $\mu$m in diameter and 1.10–1.85 in circularity and causes bleeding on the recording medium, are far from being completely round, and cannot be expected to achieve good recording quality.

As described above, printing on the recording medium subsequent to coating the recording medium with the coating material according to this invention results in higher and more stable quality printing without regard to the type of recording medium used.

Although the coating material in the embodiment 1-1 comprises 3 weight % of polyvinyl alcohol which is saponified completely and an average degree of polymerization of 550, the positive effect of this invention could also be achieved with less weight percentage of polyvinyl alcohol. For example, even 0.2 weight % of polyvinyl alcohol with an average degree of polymerization in the range of 150 to 750, and either polyvinyl alcohol which is saponified partially or polyvinyl alcohol which is saponified completely can be used. A coating material with either of the above compositions has shown almost the same solubility, and even a coating material with up to 30 weight % of either of the above compositions can be used. It will be understood that the positive effect of this invention can also be achieved in the case where a higher weight percentage of polyvinyl alcohol is used.

(The Embodiment 1-2)

After 1.2 g of polyvinyl alcohol which is saponified partially, of which average degree of polymerization and degree of saponification were respectively 1700 and 82%, was placed into a mixed solvent with 73.8 g of ion-exchanged water and 25 g of ethanol and then mixed well, the resulting solution was heated in a water bath, dissolved and processed into a product, that it is to say, a coating material.

The coating material was coated on a recording medium using a coating machine with a bar on a polyethylene terephtalate film of 125 μm in thickness by 75 μm of coating gap and dried.

On the coated recording medium described above, dot printing of 100 dots was provided by an inkjet recorder filled with ink having the following composition:

| | |
|---|---|
| C. I. Direct Blue 199 | 4.0 weight % |
| Ethanol | 10.0 weight % |
| Triethylene glycol | 15.0 weight % |
| Isopropyl alcohol | 5.0 weight % |
| Ion-exchanged water | 66.0 weight % |

For comparison purpose, on a polyethylene terephtalate film of 125 μm in thickness which has not been coated with any coating material, dot printing of 100 dots was performed by the same recorder. The size of the orifice of the nozzle on the inkjet recorder in this embodiment is rectangular and 25 μm in length and 40 μm in width, and an ink drop of approximately 30–40 μm in diameter can be discharged at a time.

According to a microscopic survey of measuring diameter and circularity, dots on the coated recording medium described above are 80 μm–95 μm in diameter, and 1.05–1.15 in circularity, and are substantially completely round and of higher quality. In contrast to the above, with dots printed on the recording medium without the coating material according to the present invention, (polyethylene terephtalate film without coating), the identification of specific dots was almost impossible and, as a result, quality printing cannot be expected, and the printing itself is rendered difficult.

As described above, higher quality printing with the coating material on the recording medium according to this invention can be accomplished without regard to the type of recording medium used.

Although the coating material in the above embodiment 1-2 includes 1.2 weight % of polyvinyl alcohol which is saponified partially and with an average degree of polymerization of 1700, the positive effect of this invention could be achieved also with less weight percentage of polyvinyl alcohol, even with 0.1 weight %. A coating material with an average degree of polymerization in the range of 750–2000, of either polyvinyl alcohol which is saponified partially or polyvinyl alcohol which is saponified completely, has shown almost the same solubility, and coating materials with up to 20 weight % of polyvinyl alcohol can also be used. It is understood that the positive effect of this invention is also achieved even in the case where a higher weight percentage of polyvinyl alcohol than in the embodiment 1-2 is used.

Again, although in the embodiment 1-2 a coating material with polyvinyl alcohol which is saponified partially at 82% degree of saponification was used, the drying time of dots printed on the coated recording medium in the case of polyvinyl alcohol which is saponified partially at a low percentage was confirmed to be shorter than in the case where a higher percentage was used.

(The Embodiment 1-3)

After 0.5 g of polyvinyl alcohol which is saponified partially, of which average degree of polymerization and degree of saponification were respectively 2300 and 95%, was placed into a mixed solvent with 95 g of ion-exchanged water and 4.5 g of ethanol and then mixed well, the resulting solution was heated in a water bath, dissolved and processed into a product, that is to say, a coating material.

The coating material described above was spray-coated, using an air spray apparatus shown in FIG. 1, on the surface of plain paper PPC-K, a product made by Daishowa Seishi & Co., which is generally referred to as PPC and used as a plain paper for electrophotography. The PPC was dried and used as a recording medium.

As shown in FIG. 1, the air spray apparatus comprises a container 1 which contains a coating material 2, a pipe 3 in midair extending from the container and having a lower portion submerged in the coating material, a needle 4 in midair with a throttled top portion, a bomb 5 filled with high-pressured inactive gas and connected to an air passage pipe 8 by way of a pressure cap 6, a valve 7 connected to the pressure cap 6 for regulating air flowing through the air passage pipe 8, and a top-throttle needle 9 in midair fixed on an end of the air passage pipe 8. The needles 4 and 9 are firmly fixed at right angles to each other with a fixed metal fitting 10.

In FIG. 1 of the air spray apparatus, high pressured inactive gas is speedily sprayed through the opened throttle edge of the needle 9 from the bomb 5 via the pressure cap 6 and the air passage pipe 8, then the coating material 2 is evacuated via the pipe 3 due to the venturi effect and sprayed in a fine mist, completing the process of coating the coating material on the recording medium.

On the coated recording medium as described above, dot printing of 100 dots was provided by an inkjet recorder filled with ink having the following composition:

| | |
|---|---|
| C. I. Direct Black 168 | 3.0 weight % |
| Ethanol | 10.0 weight % |
| Diethylene glycol | 5.0 weight % |
| Ion-exchanged water | 82.0 weight % |

For comparison purpose, on a plain paper PPC-K (which has not been coated with any coating material), dot printing of 100 dots was provided with the same inkjet recorder. The size of the orifice of the nozzle on the inkjet recorder in this embodiment is rectangular with a height of 25 μm and a width of 40 μm, and an ink drop of approximately 30–40 μm in diameter can be discharged at a time.

According to a microscopic survey of the measured diameter and circularity, dots on the coated recording medium described above are 76 μm–82 μm in diameter and 1.00–1.06 in circularity and are substantially round and of higher quality. In contrast to the above, dots on the recording medium without the coating material according to the present invention are 85 μm–120 μm in diameter and 1.06–1.74 in circularity, which causes bleeding on the paper fiber, are far from being completely round, and can not be expected to provide high recording quality.

As described above, it will be appreciated that printing on the recording medium after coating of the coating material according to this invention results in higher and more stable quality printing without regard to the type of recording medium used.

Although the coating material in the above embodiment 1-3 contains 0.5 weight % of polyvinyl alcohol which is saponified partially and has an average degree of polymerization of 2300, the positive effect of this invention can be achieved also with less percentage weight of polyvinyl alcohol, even with 0.05 weight %. Where the average degree of polymerization is in the range of 2000–5000, of either polyvinyl alcohol which is saponified partially or polyvinyl alcohol which is saponified completely, a coating material having the above characteristics has shown almost the same solubility, and coating materials with up to 15 weight % can also be used. It is understood that the positive effect of this invention is also achieved where a weight percentage of polyvinyl alcohol higher than the weight percentage in the embodiment 1-3 is used.

Although both polyvinyl alcohol which is saponified partially and polyvinyl alcohol which is saponified completely with a specific average degree of polymerization and with a specific degree of saponification has been described in the different embodiments above, there exists no correlation between the average degree of polymerization and the degree of saponification, accordingly independent combinations of both parameters may be used.

With respect to the formation of the coating film, the coating machine with a bar is chosen for the embodiments 1-1 and 1-2, and the air spray apparatus is chosen for the embodiment 1-3. However, it is understood that the positive effects of this invention may be achieved with any type of coating film formation means.

Although inkjet recording with ink of only one color has been described in the foregoing embodiments, it is understood that the positive effects of this invention may also be achieved by inkjet recording with multi colored and full-colored inks.

(2) Embodiments of Inkjet Recording Apparatus (The Embodiment 2-1)

Figure 2:
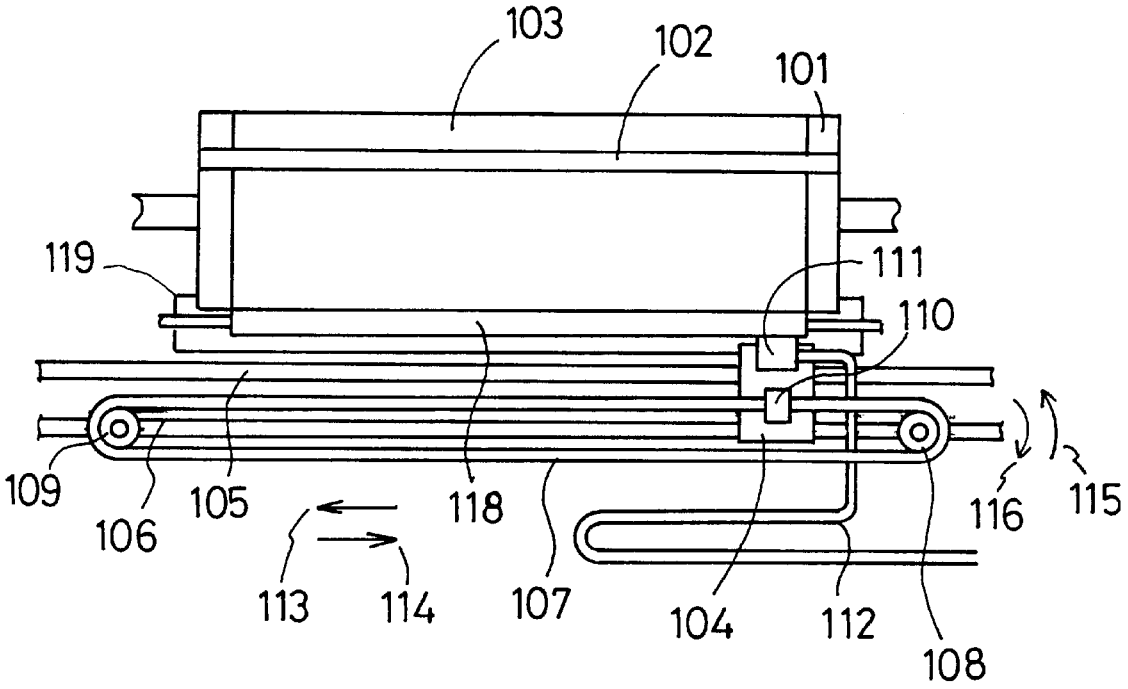
FIG. 2 shows a block diagram of an embodiment of an inkjet recording apparatus according to this invention.
Figure 3:
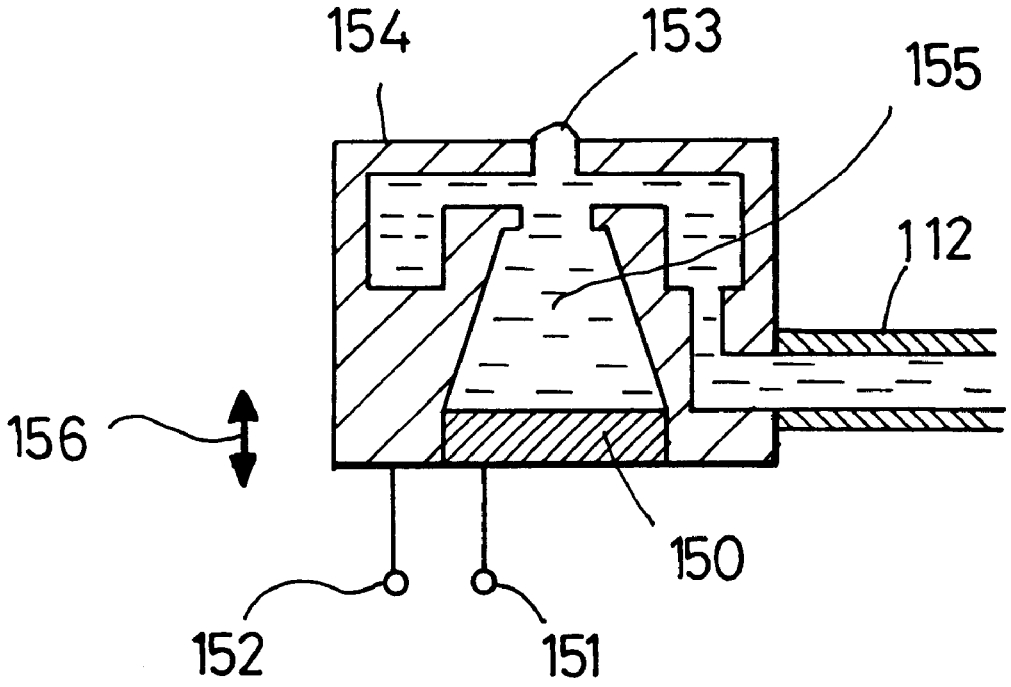
FIG. 3 is a cross-section of an inkjet recording head according to the present invention.

FIG. 2 shows a block diagram of an inkjet printer according to this invention. FIG. 3 shows a cross-section of a recording head unit used for the inkjet printer shown in FIG. 2 and FIG. 4 shows a side view block diagram of the inkjet printer shown in FIG. 2.

In FIG. 2, 101 is a platen roller driven by a motor etc., 102 is a recording medium fastener for holding a recording medium 103 rolled upon the platen roller, 104 is a carrier supported on shafts 105 and 106 in sliding condition, and 107 is a driving belt extended between pulleys 108 and 109 with proportionate tension. The carrier 104 is clamped on the driving belt 107 with a clamp means 110. 111 is an inkjet recording head mounted on carrier 104, 112 is an ink supply pipe fixed on the carrier 104 with a fixture which is not shown in the drawing, and 118 is a coating roller which coats the recording medium 103 with a coating material 123 contained in a coating unit 119 during rolling of the platen roller 101.

Figure 4:
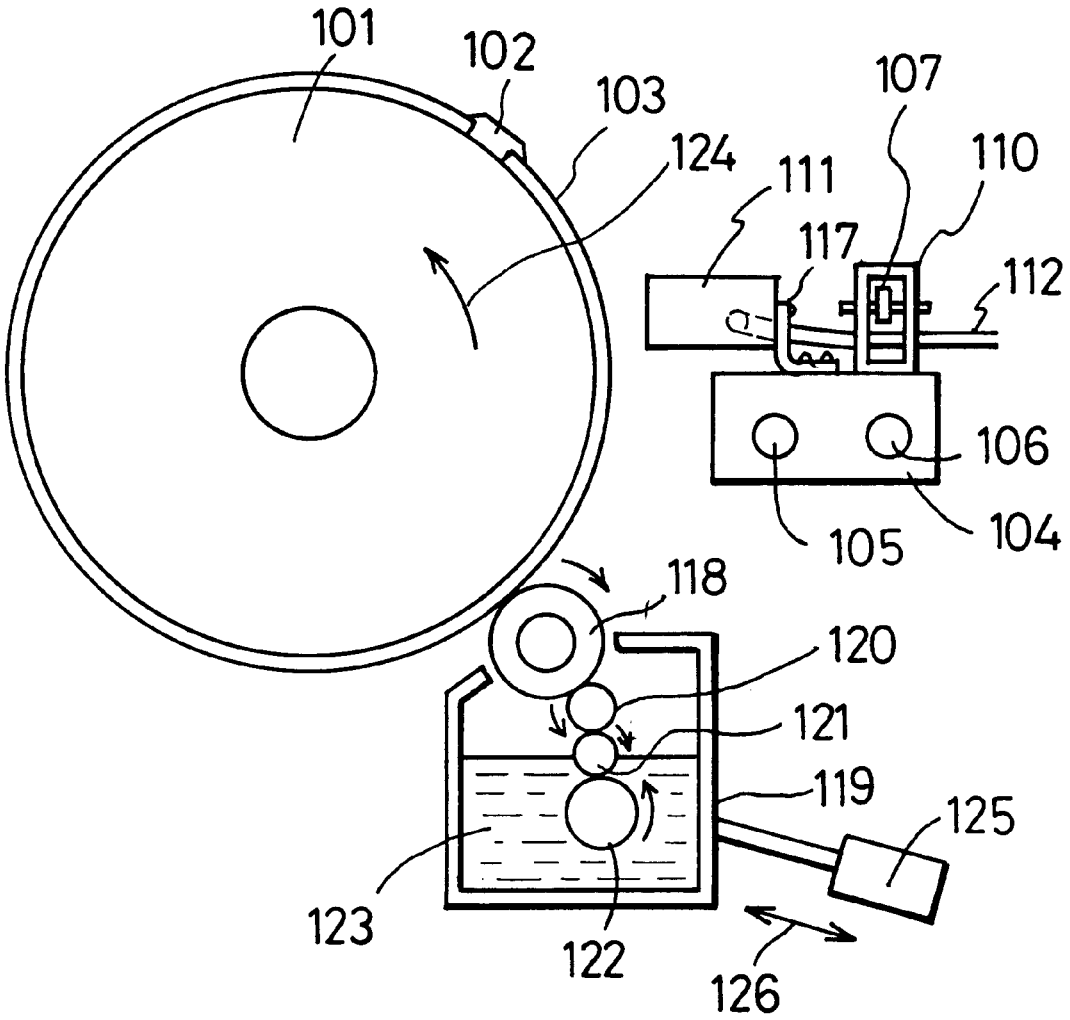
FIG. 4 is a side view block diagram of an embodiment of an inkjet recording apparatus according to this invention.

FIG. 4 shows a side view block diagram of the inkjet printer shown in FIG. 2 with the coating unit 119 shown in cross-section. Reference numerals in FIG. 4 correspond to the reference numerals in FIG. 2. In FIG. 4, the inkjet recording head 111 is supported by supporting means 117. The coating unit 119 contains the coating material 123 of which composition is 1.2 weight % of polyvinyl alcohol which is saponified partially and has an average degree of polymerization of 1700 and a 90% degree of saponification, 83.8 weight % of ion-exchanged water, and 15 weight % of ethanol. 122 is a stir and supply roller for the coating material 123, and 120 and 121 are rollers for transporting and forming the coating material into a thin film. The coating material 123 is supplied to a coating roller 118 by rollers 120–122 at a moderate thickness. The coating unit 119 itself can move in the direction of an arrow 126 by way of pressing means 125, and through this movement the coating roller 118 can control its degree of contact with the recording medium 103.

The operation of a printer according to the present invention having the configuration described above is explained hereinafter. Suppose that the recording medium 103 is wrapped upon the platen roller 101 by the recording medium fastener 102 and that the platen roller turns in the direction of arrow 124 in FIG. 4. When the top edge of the recording medium 103 turns and comes to the position of the coating roller 118, the coating unit 119 is pressed onto the platen roller 101 by the pressing means 125 and then coating of a film by the coating roller 118 on the recording medium 103 is initiated. Since the platen roller 101 turns in the direction of the arrow 124, inkjet recording is initiated at the inkjet recording head 111 position on the field of the recording medium 103 where the coating film has been applied.

The carrier 104 halts at the edge of the platen roller 101 (at right hand side in FIG. 2) before initiation of recording. At the initiation of recording, the pulley 109 begins to turn and the belt 107 proceeds in the direction of arrow 115. Therefore, the carrier 104 is driven along the shafts 105 and 106 in the direction of arrow 113 (main scanning direction). The ink is sprayed from the recording head 111 over the coating film of the recording medium 103, where recording is done by anchoring of the ink, when a recording signal is input into the recording head 111. When the carrier 104 reaches the other edge of the platen roller 101 (at the left hand side in FIG. 2), the pulley 109 halts a moment and the platen roller 101 turns in the direction of the arrow 124 in FIG. 4 (subscanning direction). Next, the pulley 109 turns in reverse, and since the driving belt 107 turns in the direction of arrow 116, the carrier 104 is driven along the shafts 105 and 106 in the direction of arrow 114 (main scanning direction). When the carrier 104 reaches again the right hand edge in FIG. 1, the pulley 109 halts a moment and the platen roller 101 turns in the subscanning direction. By repetitive reciprocal movement of the carrier 104 in the main scanning direction and turning of the platen roller 101 in the subscanning direction, coating of the coating material 123 and inkjet recording are accomplished.

FIG. 3 shows a cross-section of the inkjet recording head 111. The reference numerals in FIG. 3 correspond to the reference numerals in FIG. 2. 150 is an electric oscillator, 151 and 152 are input terminals, 153 is a nozzle from which the ink is discharged, 154 is a chamber and 155 is a recording ink. When a recording signal is input into the input terminal 151 and 152, ink is discharged from the nozzle 153 corresponding to the recording signal.

(The Embodiment 2-2)

Figure 5:
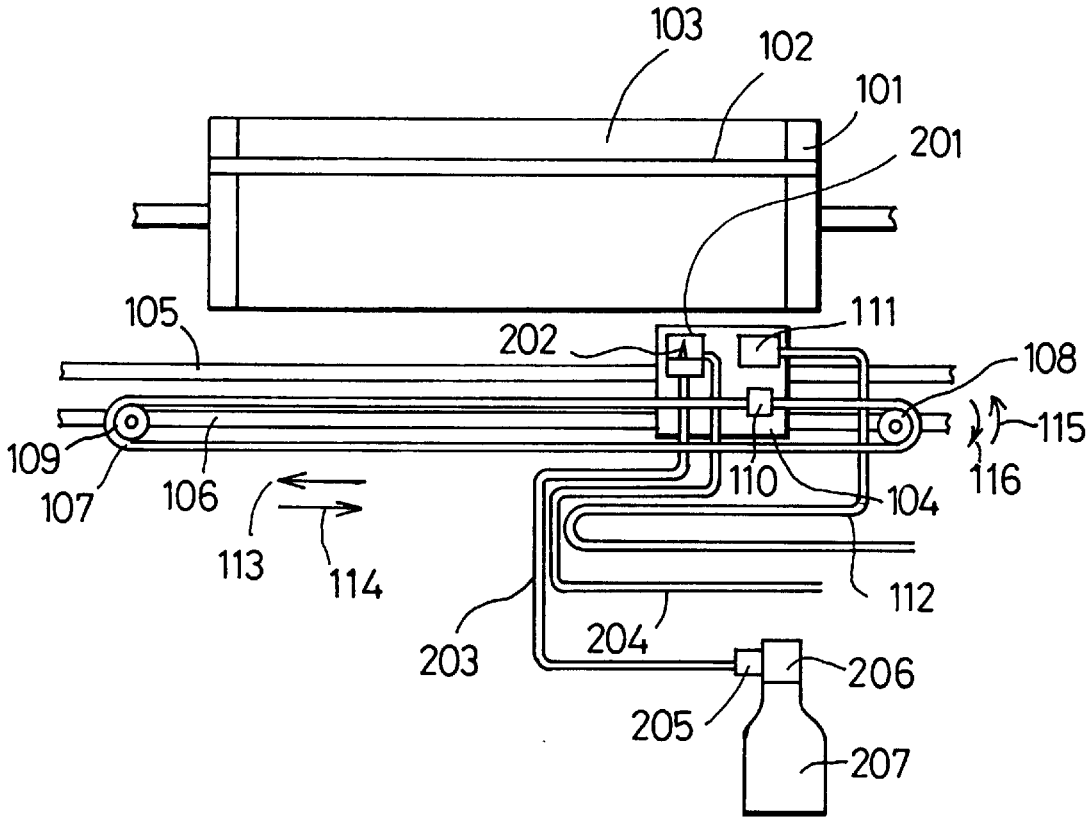
FIG. 5 shows a block diagram of another embodiment of an inkjet recording apparatus according to this invention.
Figure 6:
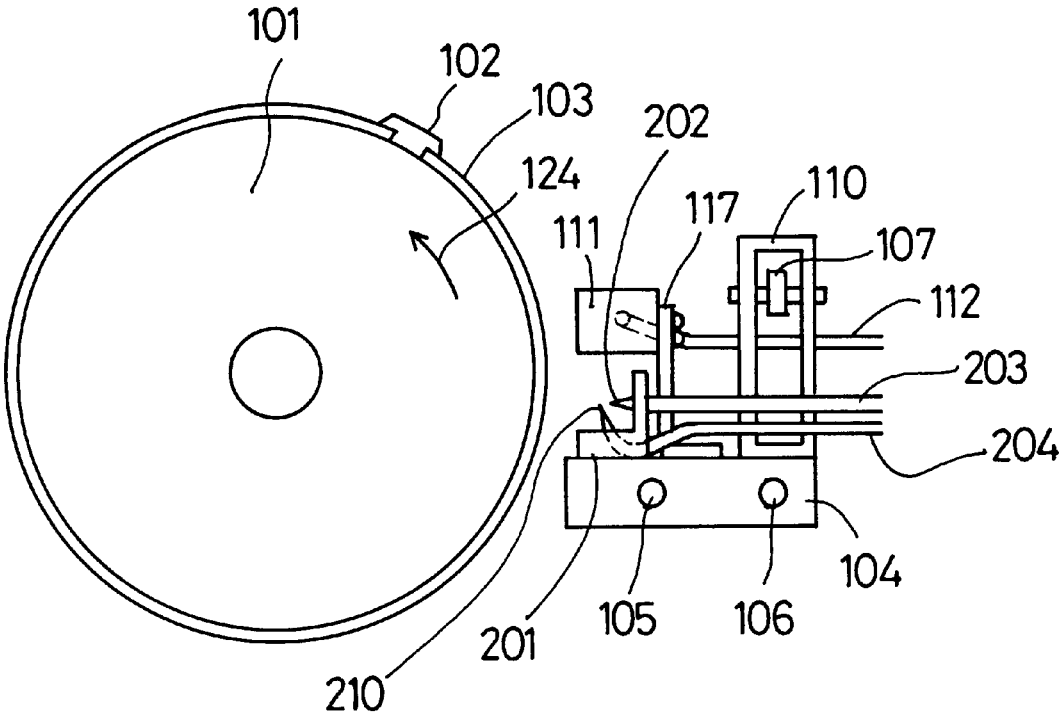
FIG. 6 shows a side view block diagram of another embodiment of an inkjet recording apparatus according to this invention.

FIG. 5 shows a block diagram of another embodiment of an inkjet recording printer according to this invention, and FIG. 6 shows a side view block diagram of the inkjet printer shown in FIG. 5. Reference numerals in FIG. 5 and FIG. 6 correspond to the reference numerals in FIG. 2 and FIG. 4.

In the following explanation of FIG. 5, a description of the corresponding portions in FIG. 2 is omitted. 201 is a fixture by which an air spray means is fixed to the carrier 104, where a high pressure non-activated gas pipe 203 and a coating material supply pipe 204 are supported. The high pressure gas pipe 203 is connected to a high pressure, non-activated gas bomb 207 via a pressure cap 206. A valve 205 is disposed between the high pressure, non-activated gas pipe 203 and the pressure cap 206. An edge of the ink supply pipe 112 is connected to an ink tank which is not shown in the drawings. An edge of the coating material supply pipe 204 is connected to a coating material tank which is not shown in the drawing. The coating material tank contains a coating material having a composition comprising 2.0 weight % of polyvinyl alcohol which is saponified completely, an average degree of polymerization of 550, a 98.5% degree of saponification, 88.0 weight % of ion-exchanged water, 5 weight % of ethanol and 5 weight % of diethylene glycol.

FIG. 6 is a side view block diagram of the inkjet printer in FIG. 5. Reference numerals in FIG. 6 correspond to the reference numerals in FIG. 5. In FIG. 6, the inkjet recording head 111 is supported by the supporting means 117. On an edge of the coating material supply pipe 204 is fixed a top-throttled needle in midair 210. Needles 202 and 210 are firmly fixed at right angle to each other with a fixed metal fitting 201. When the valve 205 is opened, high pressure, non-activated gas is speedily discharged from the throttled top of the needle 203 via the pressure cap 206 and the high pressure, non-activated gas pipe 203. The coating material is then evacuated via the coating material supply pipe 204 due to the venturi effect and sprayed in a fine midst with the gas through the needle 210, thereby coating the coating material on the recording medium 103.

Hereinafter, the operation of the printer in this invention which has the foregoing configuration will be explained. Suppose that the recording medium 103 is wrapped on the platen roller 101 which turns towards the arrow signal 124 in FIG. 6 in the subscanning direction. The carrier 104 halts at the position of an end of the platen roller (at the right hand side in FIG. 5) until just before the recording. When recording is initiated, the pulley 109 is initiated to turn and the driving belt 107 is rotated towards the arrow signal 113. Thereafter, the carrier 104 moves towards the arrow signal 113 in the main scanning direction on the shafts 105 and 106. At this moment an "OPEN" signal is given to the valve 205, and coating on the recording medium 103 is started. Once a recording signal is input into the recording head 111, droplets of ink are discharged from the recording head 111 and recording is achieved as the ink fixes onto the recording medium 103.

As explained in the embodiment 2-1, by the repetition of main scanning due to reciprocal movement of the carrier 104 and subscanning due to turning of the platen roller 101, the coating of the coating material and the inkjet recording are executed on the recording medium 103.

Because the needles 202 and 210 for air spraying, which constitute the coating means, are furnished upon the carrier 104 at different height positions from that of the inkjet recording head 111, the coating of the coating material is executed on the recording medium 103 before the inkjet recording. Therefore droplets of the ink due to inkjet recording is adhered on the coating film which is coated on the recording medium 103.

Although in the present embodiment the needles 202 and 210 for air spraying are furnished upon carrier 104 at different height positions from that of the inkjet recording head 111, it is also understood that both needles can be furnished at the same height position and nevertheless that the coating material should be coated before inkjet recording. For the latter case, the coating means should be structured at the preceding position in the main scanning direction to the inkjet recording head 111.

In the present embodiment, the same recording head 111 as in the embodiment 2-1 is used. As clarified in the embodiments 2-1 and 2-2, by the inkjet recorder according to this invention higher quality inkjet recording can be achieved without regard to the type of recording medium used because the coating material is coated by the coating means before inkjet recording and because inkjet recording is performed on the coating film which has been coated on the recording medium.

(The Embodiment 2-3)

Figure 7:
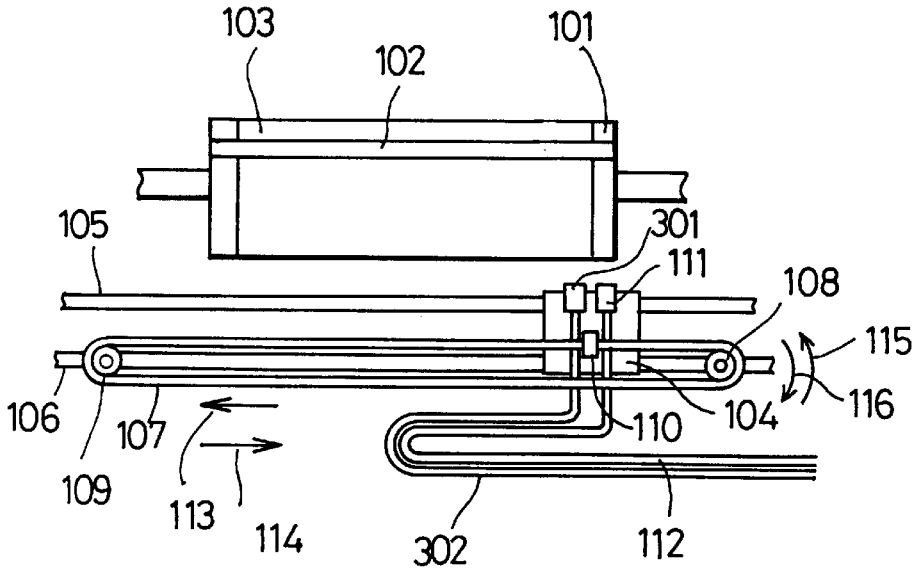
FIG. 7 shows a block diagram of another embodiment of an inkjet recording apparatus according to this invention.

FIG. 7 shows a block diagram of an inkjet printer and FIG. 8 through FIG. 11 show in sequence an outline cross-section, an outline top plan view, an outline side view, and an outline top plan view of a portion of an inkjet recording head to be used for the inkjet printer in the embodiments of the present invention. FIGS. 12(*a*)–(*e*) are explanatory drawings of operations of the inkjet recording head and the coating head.

In FIG. 7, an explanation is omitted for the same elements described with respect to FIG. 2. 301 is a coating head mounted on the carrier 104, 302 is a coating material supply pipe of which a top portion is connected to the coating head 301. The pipe 302 supplies the coating material to the coating head 301. A coating material tank which is not shown in the drawing is connected to another top portion of the coating material supply pipe 302. 111 is the inkjet recording head which is mounted on the carrier 104. 112 is the ink supply pipe of which a top portion is connected to the inkjet recording head 111. The ink supply pipe 112 supplies the recording ink to the inkjet recording head 111. A recording ink tank is connected to another top portion of the ink supply pipe 112. In this embodiment, a coating liquid is applied which has a composition including polyvinyl alcohol.

Hereinafter operations of the printer with the configuration according to this invention will be explained. Suppose that the recording medium 103 is wrapped on the platen roller 101 with the recording medium fastener 102, and the carrier 104 halts at an end position of the platen roller (at the right hand side in FIG. 7) before initiation of recording. Once the recording is initiated, the pulley 108 turns in the direction of the arrow signal 115, then the driving belt 107 is turned in the direction of the arrow signal 115. Therefore, the carrier 104 moves on the shafts 105 and 106 in the direction of the arrow signal 113 along the main scanning direction. At this point, droplets of the coating liquid are discharged from the coating head 302 onto the recording medium and the coating is completed when the discharge signal is input into the coating head 302. Thereafter, droplets of the recording ink are discharged from the recording head 111 and inkjet recording is completed when the recording ink adheres or is anchored on the recording medium 103.

When the carrier 104 reaches the other end of the platen roller 101 (at the left hand side in FIG. 7), the pulley 108 halts for a moment. Then the pulley 108 turns speedily in reverse, and since the driving belt 107 turns speedily in the direction of the arrow signal 116, the carrier 104 speedily moves on the shaft 105 and 106 in the direction of the arrow signal 114 to the initial position, which corresponds to a carriage return. By this carriage return, the discharge signal is prohibited from being input into the coating head 301 and the inkjet recording head 111 such that the inkjet recording is not completed. The platen roller 101 turns in the subscanning direction when the carrier 104 returns to the initial position. When the carrier 104 reaches again the right hand side position, the pulley 108 halts a moment and then begins to turn again towards the arrow signal 115 direction.

Through repetitive reciprocal movement in the main scanning direction and turning of the platen roller 101 in the subscanning direction, coating of the coating liquid and inkjet recording are accomplished on the recording medium 103. In this embodiment, driving of the coating head and the inkjet recording head is specifically executed while the carrier 104 moves towards the arrow signal 113 in the main scanning direction only. Since the coating head 301 is furnished in the preceding position in the main scanning direction to the inkjet recording head 111 the coating of the coating liquid discharged through the coating head 301 is accomplished without fail and precedes inkjet recording by discharging of the recording ink.

Figure 8:
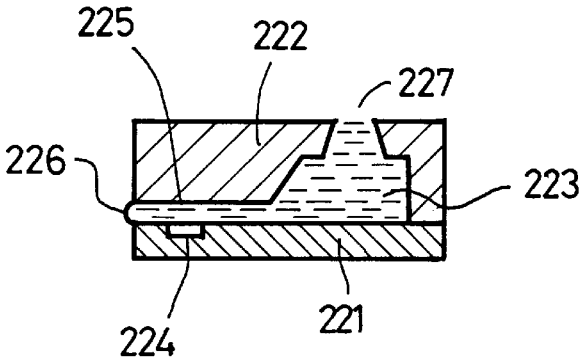
FIG. 8 shows a cross-section outline of the structure of an inkjet recording head and a coating head of an inkjet recording apparatus according to this invention.
Figure 9:
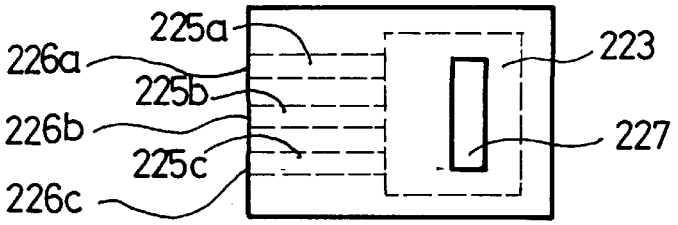
FIG. 9 shows an outline top view of an inkjet recording head and a coating head of an inkjet recording apparatus according to this invention.
Figure 10:
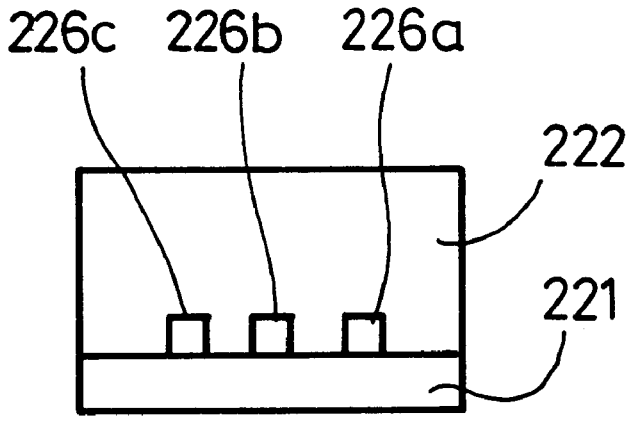
FIG. 10 shows an outline side view of an inkjet recording head and a coating head of an inkjet recording apparatus according to this invention.

FIG. 8, FIG. 9 and FIG. 10 are respectively a cross-section, a top plain view and a side view of an outline of the inkjet recording head and the coating head for the inkjet printer according to this invention. By means of a junction of a channel substrate 222 on a heater substrate 221, the inkjet recording head and the coating head have a high volume pool 223 formed between the substrates 221 and 222. Multiple nozzles 225*a*, 225*b* and 225*c*, which are formed at the top side of both substrates 221 and 222, are independently communicated to the pool 223 and comprise orifices 226*a*, 226*b*, 226*c*, respectively, for discharging liquid. In FIGS. 8 and 9, 227 is an outlet for supplying the recording ink or the coating liquid, opened through the channel substrate 222.

Figure 11:
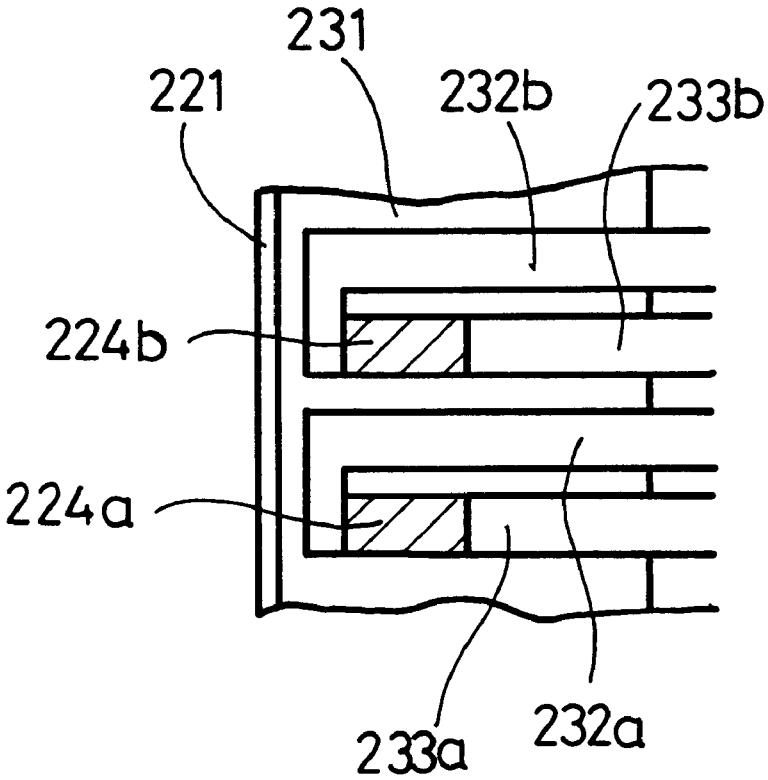
FIG. 11 shows an outline top view of a portion of an inkjet recording head and a coating head of an inkjet recording apparatus according to this invention.
Figure 12A:
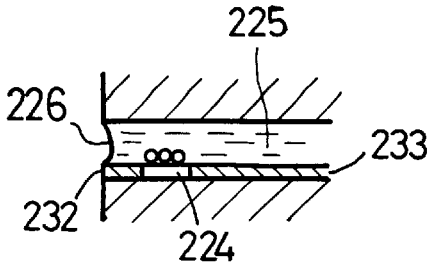
FIG. 12 shows an explanatory drawing of operations of an inkjet recording head and a coating head of an inkjet recording apparatus according to this invention.
Figure 12B:
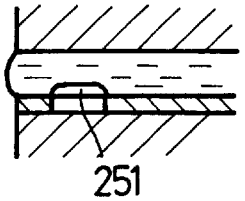
Figure 12C:
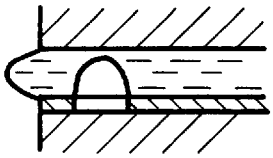
Figure 12D:
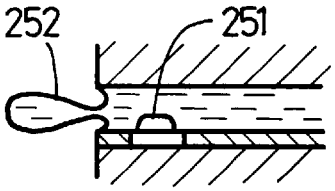
Figure 12E:
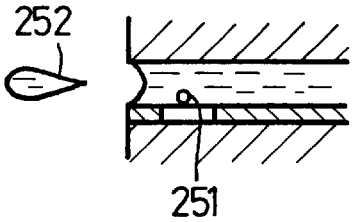

Heat resistance 224, which is housed in a nozzle 225, is formed on the heater substrate 221. FIG. 11 is a detailed top plan view of part of the heat resistance 224 and its surroundings. A glaze layer 231 is formed on the heater substrate 221, and the heat resistances 224*a*, 224*b*, are formed with Poly-Si, TaAl, or BHf, etc. through filming by way of deposition, or sputtering, etc., doping of impurity, if necessary, and patterning in a predetermined shape for a predetermined value of resistance. Electrode layers 232*a*, 232*b*, 233*a* and 233*b* of Al, etc. are formed on the glaze layer 231. The heat resistance 224 can be heated by charging electric current to the electrode layers 232*a*, 232*b*, 233*a*, 233*b* and the heat resistance layer 224.

Hereinunder, operations of the coating head 301 and the inkjet recording heat 111 will be explained using FIGS. 12(*a*) to 12(*e*) which show cross-sections of a part of the nozzles and their surroundings in FIG. 8. 22*b* is the nozzle, 226 is the orifice, 224 is the heat resistance, and 232 and 233 are the electrode layers. There is, inside of the nozzle 225, the coating liquid in the coating head or the inkjet recording ink in the inkjet recording head. FIG. 12(*a*) shows the state in which electric current has been applied to the heat resistance 224, the heat resistance 224 has achieved an exoergic condition, the coating liquid or the inkjet recording ink is undergoing evaporation and a bubble begins to be generated. FIGS. 12(*b*) and 12(*c*) show the state in which the heat resistance continues to be in an exoergic condition, and the bubble turns into a film bubble 251. FIGS. 12(*d*)–(*e*) show the state in which a drop of the coating liquid or a drop of the inkjet recording ink is discharged from the orifice of the nozzle due to the pressure by the bubbles. At this point the electric current has been turned OFF and the film bubble 251 shrinks and then disappears.

Since coating with the coating liquid and inkjet recording with the inkjet recording ink can be done by way of the coating head and the inkjet recording head, respectively, both of which have the same structure as mentioned above, an inkjet recording apparatus with a simple structure is realized without furnishing any specialized coating means. Moreover, since in the inkjet recording apparatus according to this invention image recording with the inkjet recording ink is performed on the coating film which coated on the recording medium before the inkjet recording ink is recorded, a higher quality inkjet recording can be accomplished without regard to the type of recording medium used.

Figure 13:
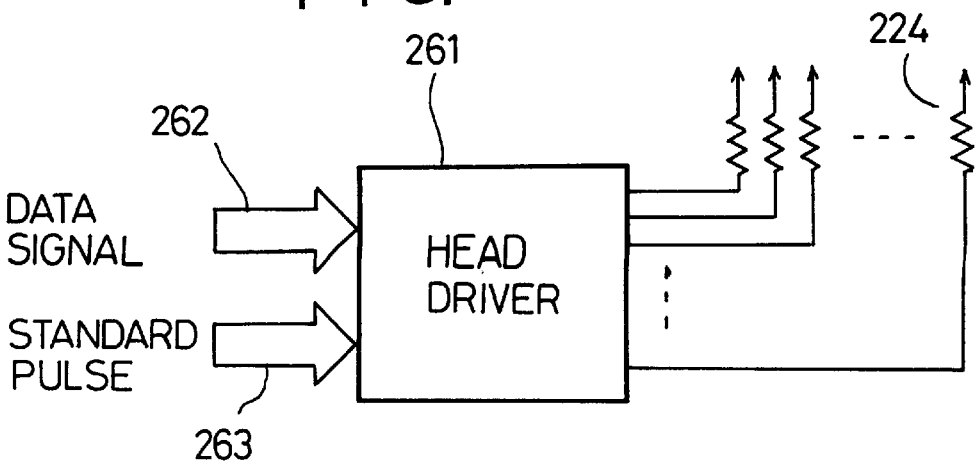
FIG. 13 shows an outline block diagram of a driving circuit for heat resistances in an inkjet recording head and a coating head of an inkjet recording apparatus according to this invention.
Figure 14:
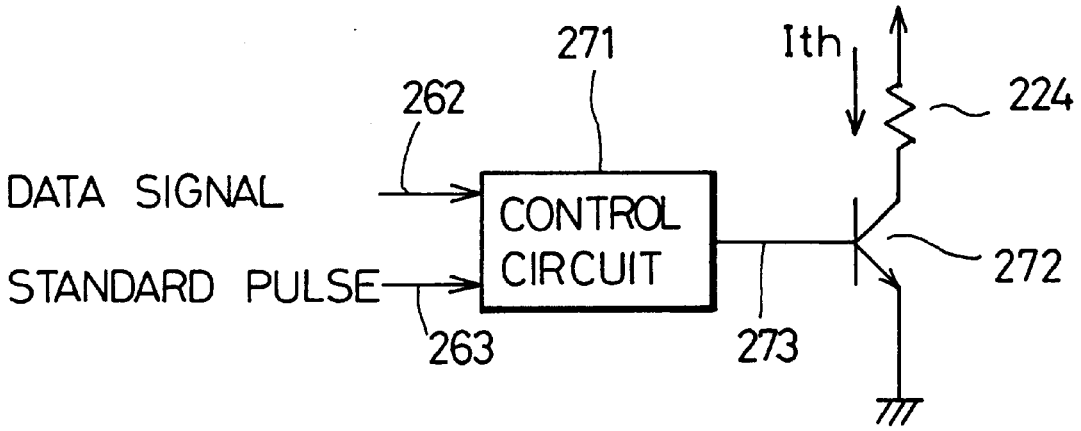
FIG. 14 shows a driving circuit diagram of a part related to a heat resistance in an inkjet recording head and a coating head of an inkjet recording apparatus according to this invention.
Figure 15:
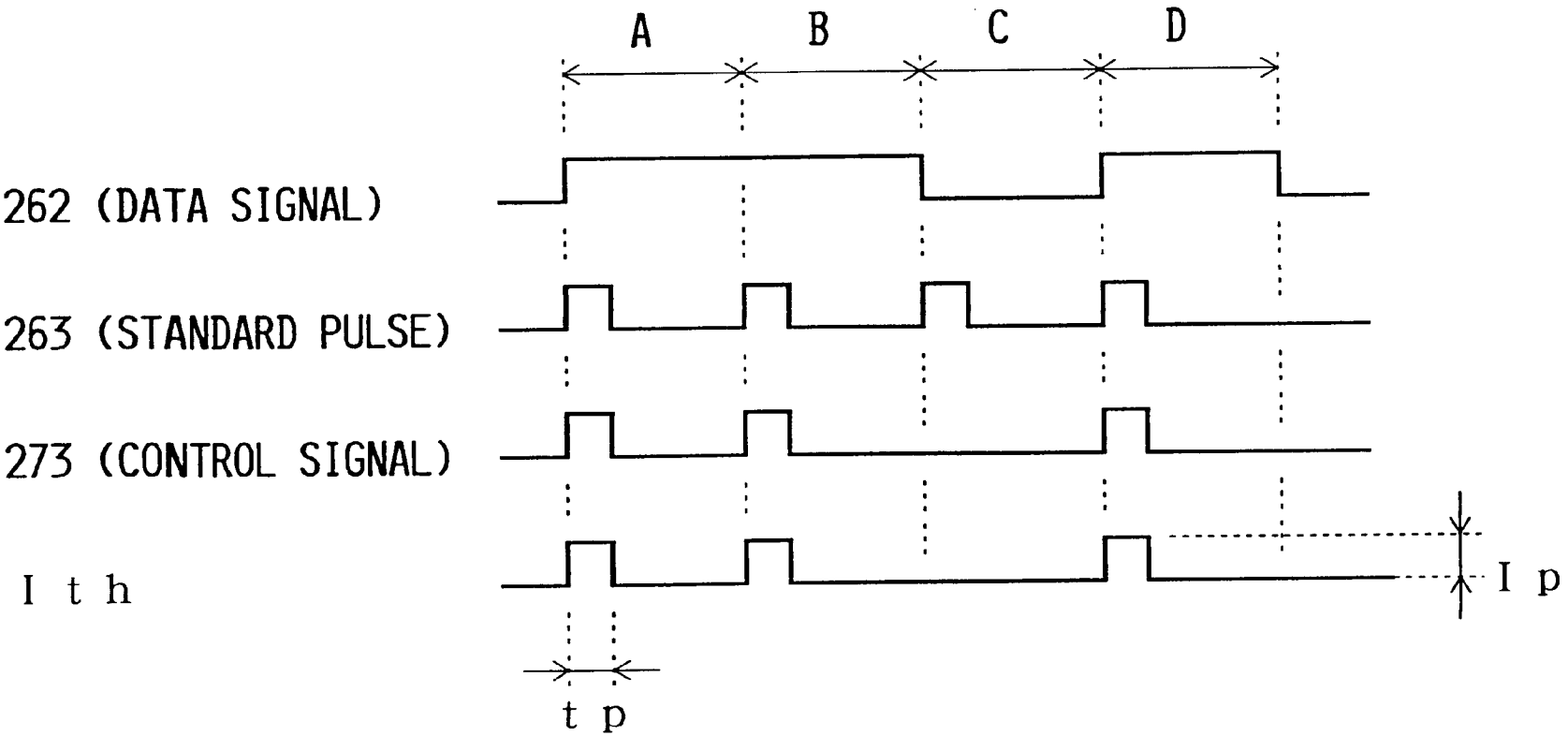
FIG. 15 shows a timing chart which explains the drive time of a heat resistance of an inkjet recording head and a coating head of an inkjet recording apparatus according to this invention.

FIG. 13 shows an outline block diagram of a driving circuit for the heat resistance 224 of the coating head and the inkjet recording head of the inkjet recording apparatus according to this embodiment. FIG. 14 shows a driving circuit diagram of a circuit for controlling electric current for driving the head resistance 224 in FIG. 13. FIG. 15 shows a timing chart exhibiting the status of signals.

Operations of the coating head and the inkjet recording head in this embodiment are shown in FIG. 12(*a*)–(*e*). In order to control the foregoing operations, a standard pulse 263 for head driving and data signal 262 which is synchronized to the standard pulse 263 are input into a head driver 261 in FIG. 13. The electric current which is charged to the heat resistance 224 is controlled by the head driver 261. These operations, based on a more concrete example, are explained in more detail using the circuit diagram of FIG. 14 and a timing chart of FIG. 15.

The standard pulse 263 and the data signal 262 have already been input into a control circuit 271 in the head driver 261. A control signal 273 which is output from the control circuit 271 is input into a base of a switching transistor 272, and then a head current Ith which is charged to the heat resistance 224 coupled with the collector can be controlled. In FIG. 15, each of A, B, C and D shows a timing point at which a dot is discharged, of which discharge timing is synchronized by way of the standard pulse 263. The data signal 262 is a signal which determines if a dot should be discharged or not at each discharge time. The example shown in FIG. 15 shows that A, B and D are to be discharged and that C is not to be discharged. By way of inputs of the standard pulse 263 and the data signal 262, the control signal 273 is created in the control circuit 271, and only when the switching transistor 272 is switched ON by this control signal, the head current Ith is charged to the heat resistance 224. Suppose that in FIG. 15, Ip is a value of the head current Ith and tp is the duration time that the head current Ith is charged for. The value of resistance of the heat resistance 224 of the coating head and the inkjet recording head in this embodiment is 120 Ω each. Optimal values of the head current Ith for discharging the inkjet recording ink on the inkjet recording head and the duration time tp that the head current above is charged is found to be respectively Ith=200 mA, tp=7.5 μs. The composition of the inkjet recording ink in this test is as follows and its coefficient of viscosity is 2.4 cP:

| | |
|---|---|
| Dye (Direct Blue 199) | 3 weight % |
| Diethylene glycol | 22 weight % |
| Ethanol | 1 weight % |
| Water (ion-exchanged water) | 74 weight % |

In FIG. 22, A to F are show the composition of the coating liquid and its viscosity, the head current Ith that each coating liquid can be discharged in a stable condition by the coating head, and the duration time tp that the head current is charged for, according to this embodiment.

Each coating liquid has a higher viscosity than that of the inkjet recording ink, and it is understood that a stable discharge of the coating liquid is realized by means of the head current Ith and duration time tp at the coating head being set higher that for the inkjet recording head. That is, since a larger amount of heat energy is charged for the discharge of the coating liquid as compared for the discharge of the inkjet recording ink, the stable discharge of the coating liquid can be realized.

As clearly shown in this embodiment, stable coating can be realized by means of driving both the coating head and the inkjet recording head such that the heat generated by the heat resistance for heating the coating liquid in the coating head is larger than that for heating the inkjet recording liquid in the inkjet recording head. Accordingly, a higher quality and stable recording image can be realized without regard to the recording medium used since the coating liquid is coated on the recording medium before the inkjet recording ink is recorded on the recording medium.

(The Embodiment 2-4)

Figure 16:
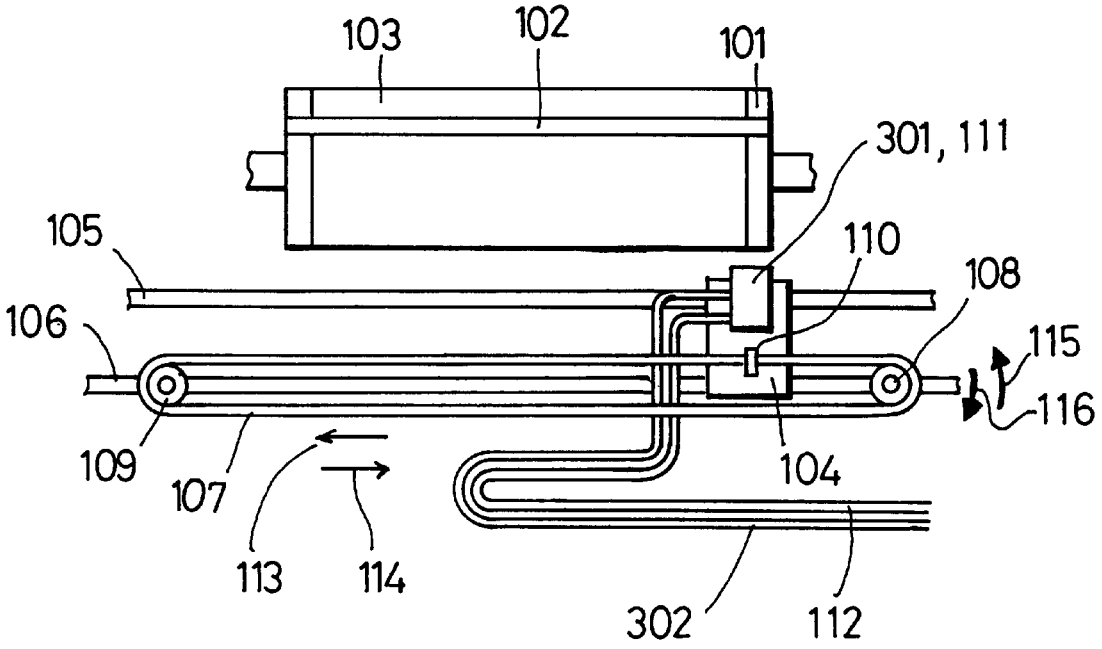
FIG. 16 shows another block diagram of an inkjet recording apparatus according to this invention.
Figure 17:
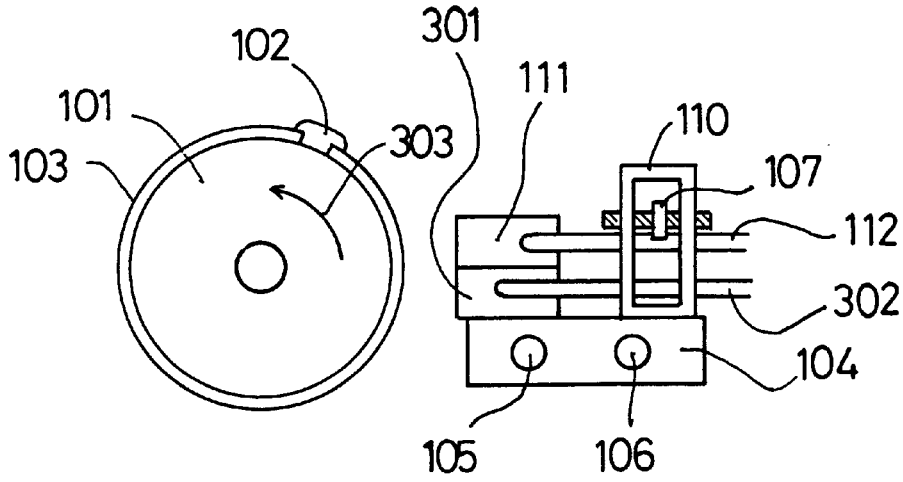
FIG. 17 shows a side view of the inkjet recording apparatus shown in FIG. 16.
Figure 18:
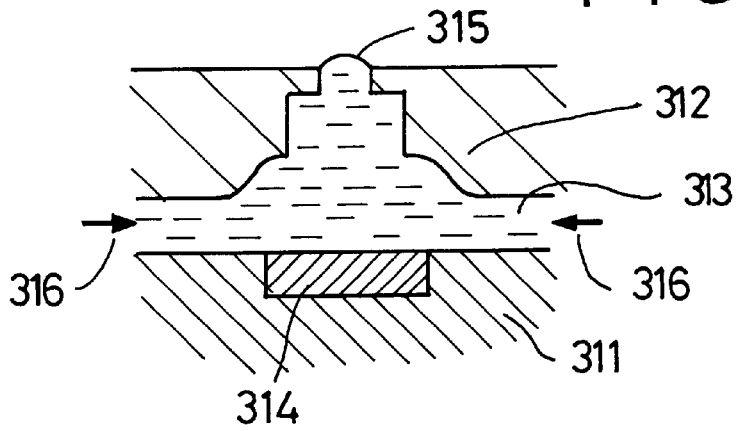
FIG. 18 shows an outline cross-section of an inkjet recording head and a coating head of the inkjet recording apparatus shown in FIG. 16.
Figure 19:
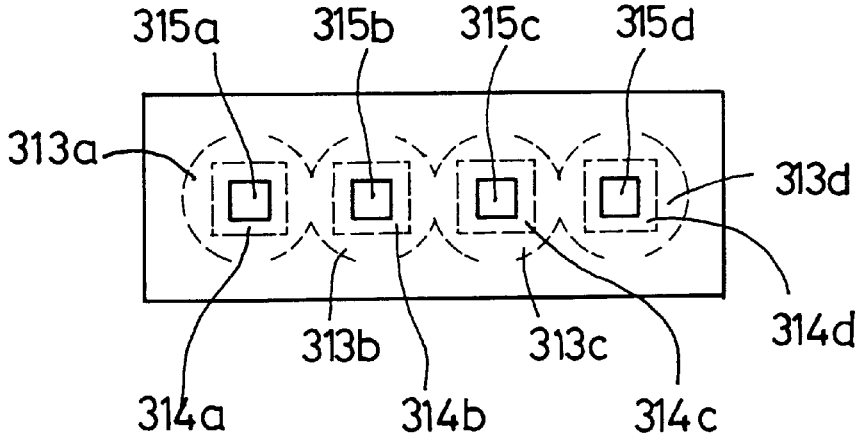
FIG. 19 shows an outline plane view of an inkjet recording head and a coating head of the inkjet recording apparatus shown in FIG. 16.

FIG. 16 shows a block diagram of another embodiment of an inkjet printer according to this invention. FIG. 17 shows a side view of the inkjet printer shown in FIG. 16. In FIG. 16 and FIG. 17, reference numerals for corresponding parts are as shown in FIG. 7. FIG. 18 to FIG. 20 are respectively a cross-section, a top plain view, and a partial top plain view of an outline of the inkjet recording head and the coating head to be used in the inkjet printers according to this invention.

An explanation of the parts or components in FIG. 16 which are the same as in FIG. 2 is omitted. Except for the feature that the coating head 301 and the inkjet recording head 111 are furnished in a stacked condition upon the carrier 104, as shown in FIG. 17, all other parts and components are as shown in both FIG. 16 and FIG. 7.

Operation of the printer with the structure described above will be explained hereunder. Suppose that the recording medium 103 is wrapped on the platen roller 101 by the recording medium fastener 102. The platen roller 101 turns towards the arrow signal 303 in FIG. 17 in the subscanning direction.

The carrier 104 halts at an end of the platen roller (at the right hand side in FIG. 16) before initiation of recording. When recording is initiated, the pulley 108 begins to turn and the driving belt 107 turns towards the arrows signal 115. Therefore, the carrier 104 moves on the shaft 105 and 106 towards the arrow signal 113 in the main scanning direction. At this point, once the discharge signal is input into the coating head 301, the coating material is discharged from the coating head 301, and the coating material is coated on the recording medium 103. Once the recording signal is input into the inkjet recording head 111, a droplet of the inkjet recording ink is discharged from the inkjet recording head 111, and the inkjet recording is accomplished by means that droplets of the inkjet recording ink are adhered on the recording medium 103.

When the carrier 104 reaches another end of the platen roller 101 (left hand side in FIG. 16), the pulley 108 halts for a moment, then the platen roller 101 turns towards the arrow signal 303 in the subscanning direction. Next, the pulley 108 turns in reverse, and since the driving belt 107 turns towards the arrow signal 116, the carrier 104 moves on the shaft 105 and 106 towards the arrow signal 114 in the main scanning direction. At this point, the coating material is coated and the inkjet recording ink is recorded as described above. When the carrier 104 reaches again the right hand side in FIG. 16, the pulley 108 halts again for a moment, and the platen roller 101 turns in the subscanning direction. Through the reciprocal movement of the carrier 104 in the main scanning direction and reciprocal turning of the platen roller 101 in the subscanning direction, the coating of the coating material and the inkjet recording on the recording medium 103 are executed.

Since the coating head 301 and the inkjet recording head 111 are furnished upon the carrier 104 at different heights, that is, since the coating head 301 is furnished at a forward position to the inkjet recording head 111 with respect to the subscanning direction, the coating material is coated before the inkjet recording ink is recorded on the recording medium. Therefore, droplets of the inkjet recording ink by the inkjet recording head are adhered without fail on the coated film coated on the recording medium.

FIG. 18, FIG. 19 and FIG. 20 are, respectively, a cross-section, a top plain view, and a part top plain view of an outline of the inkjet recording head and the coating head of the inkjet printer in this embodiment. Both of the inkjet recording head and the coating head have a structure such that a cast plate 312 on which a discharge orifice 315 is formed is superposed and set upon a heater substrate 311.

Between the heater substrate 311 and the cast plate 312 a pool 313 of liquid is formed and the coating liquid or the inkjet recording ink flows into the pool 313 through the clearance shown by the arrow signal 316 in FIG. 18. The operations and movements of the heat resistance 314, electrode layer 321 and 322, and glaze layer 320 are all the same as in the case of embodiment 2-3.

In the inkjet printer according to this embodiment, the inkjet recording head is equipped with a discharge orifice 315 having a square shape and dimensions of 35 μm by 35 μm, and a pitch between neighboring orifices has 180 dots/inch. Other examples of such coating heads have a square discharge orifice 315 with dimensions of, respectively, 45 μm×45 μm and 55 μm×55 μm. The pitch between neighboring orifices has 180 dots/inch in any of the three kinds of the coating heads described above. A composition of the inkjet recording ink for the inkjet recording head is as follows:

| | |
|---|---|
| Dye (C. I. Direct Black 168) | 3 weight % |
| Diethylene glycol | 20 weight % |
| Ethanol | 20 weight % |
| Water (ion-exchanged water) | 57 weight % |

The viscosity of the ink in this embodiment is 3.8 cP at 20° C.

Concerning the coating liquids, four kinds of coating liquids are used having the composition of A to D shown in FIG. 23.

The resistance value of the heat resistance 314 in he inkjet recording head 111 and the coating head 301 is 40 Ω, and its driving circuit is the same as in the outline of the block diagram and the partial circuit diagram shown in FIG. 13 and FIG. 14. Concerning the driving timing, it is the same as in the timing chart shown in FIG. 15. The head current Ith is 350 mA and the duration tp of the charged current to the head is 8.0 μs.

The result of experiments according to the combinations of each coating liquid and each coating head having discharge orifices of various sizes during use of the inkjet printer shown in FIG. 16 for printing on paper is shown in FIG. 23. In FIG. 23, ◎ (double circle) shows positive significant effects of the coating where higher quality of print (recording) is obtained. ○ (single circle) shows the positive good effects of the coating where the quality of print (recording) is not as good as in the cases shown by double circles.

As it is clear in this embodiment, the discharged volume of the coating liquid driven at a discharge signal is greater, therefore the positive effect of the coating is better in the case where the area of discharge orifice for discharging the coating liquid at the coating head is greater than that for discharging the inkjet recording ink at the inkjet recording head. The positive effect of the coating is more significant in the case of the coating material containing polyvinyl alcohol which is saponified completely or polyvinyl alcohol which is saponified partially with a lower degree of polymerization. Further, there is a greater positive effect when the coating material has a higher viscosity in the case where the area of discharge orifices for-discharging the coating liquid at the coating head is larger than that for discharging the inkjet recording ink at the inkjet recording head. As a result, in the inkjet recorder according to this invention, higher quality of inkjet recording can be achieved without regard to the type of recording medium used since the coating of the coating material on the recording medium is executed before the inkjet recording image is recorded with the inkjet recording ink on the recording medium and, therefore, since the inkjet recording image is printed on the coating film.

(The Embodiment 2-5)

Similar to the inkjet printer in the embodiment 2-4, an inkjet recording head with the discharge orifices 315 having an area of 35 μm by 35 μm square and with the neighboring pitch between discharge orifices of 180 dots/inch, a coating head 301 with the discharge orifices 315 having an area of 50 μm by 50 μm square and with the neighboring pitch between discharge orifices of 90 dots/inch, are used in this embodiment. The composition of the inkjet recording ink for discharging from the inkjet recording head 111 is as follows:

| | |
|---|---|
| Dye (C. I. Direct Blue 199) | 3 weight % |
| Diethylene glycol | 10 weight % |
| Ethanol | 20 weight % |
| Water (ion-exchanged water) | 67 weight % |

The viscosity of the inkjet recording ink in this embodiment is 2.7 cP at 20° C.

The composition of the coating liquid to be discharged from the coating head 301 is as follows:

| | |
|---|---|
| Polyvinyl alcohol saponified completely K-17 made by Denki Kagaku & Co. | 2 weight % |
| Average degree of polymerization: | 1700 |
| Degree of saponification: | 98.5–100.0 % |
| Ethanol | 8 weight % |
| Water (ion-exchanged water) | 90 weight % |

The viscosity of the coating liquid in this embodiment in 4.4 cP at 20° C.

The value of resistance at the heat resistance 314 of each of the coating head 301 and the inkjet recording head 111 is 40 Ω and the driving circuit is the same as in the outline block diagram in FIG. 13 and the partial diagram of the driving circuit in FIG. 14. The driving time is the same as in the timing chart in FIG. 15. The charged current Ith for the inkjet recording at the inkjet recording head 111 is 350 mA and its duration time tp is 8.0 μs. The charged current Ith for coating at the coating head 301 is 350 mA and its duration time tp is 10.0 μs.

FIG. 21(*b*) shows an explanatory drawing of the inkjet recording method according to this embodiment. In FIG. 21(*b*) a dot 401 shown with dotted lines is a coating dot formed on the recording medium by way of discharge of the coating liquid, and a dot 402 shown with slant lines is the inkjet recording dot formed by way of discharge of the inkjet recording ink on the coating dot formed on the recording medium.

In this embodiment, since a dot pitch of discharged coating liquid by the coating head is 90 dots/inch and since a dot pitch of discharged inkjet recording ink by the inkjet recording head is 180 dots/inch, multiple inkjet recording dots are formed on a coating dot.

For comparison purpose, an explanatory drawing recorded by the apparatus in the embodiment 2-4 is shown in FIG. 21(*a*). Since a dot pitch of both the inkjet recording head 111 and on the coating head 301 are 180 dots/inch for all dot pitches, it is understood that an inkjet recording dot with droplets of inkjet recording ink is formed on the coating dot. In FIG. 21(*a*), the maximum size of a discharge orifice of the coating head is 141 μm by 141 μm (1/180 inch) in the case where the shape of the discharge orifice is square, since a dot pitch of discharge orifice at the coating head is 180 dots/inch. But in FIG. 21(*b*) of this embodiment, the maximum size of the discharge orifice can be 282 μm by 282 μm (1/90 inch), therefore more volume of discharge of the coating liquid per movement of the carrier can be discharged on the recording medium and an improved positive effect in printing could be obtained. In this embodiment, the discharge from both orifices is controlled such that the inkjet recording is performed but coating is not performed during return movement of the carrier.

In order to realize the recording method shown in FIG. 21(*a*), the same number of driving elements for driving the heat resistances of the coating head are needed as those number of driving elements for driving the heat resistances of the inkjet recording head. But in order to realize the recording method shown in FIG. 21(*b*), the number of driving elements for driving the heat resistances of the coating head should be half the number of those of the inkjet recording head. Therefore a simpler structure of the inkjet recorder can be realized.

As it is clear in the present embodiment, in the inkjet recorder according to this invention, higher quality inkjet recording can be achieved without regard to the types of recording medium used, since the coating with the coating material is very efficiently done on the recording medium by means of a simple structure just before inkjet recording with the inkjet recording ink is executed.

Although inkjet recording with a single color ink has been described in each of embodiments 2-1 through 2-5, it is understood that this invention can also be applied to multi-color or full-color inkjet recorders.

Moreover, although described with application to a printer, each of the embodiments 2-1 through 2-5 can also be applied to a facsimile, a copier, etc.

(The Embodiment 2-6)

Figure 28:
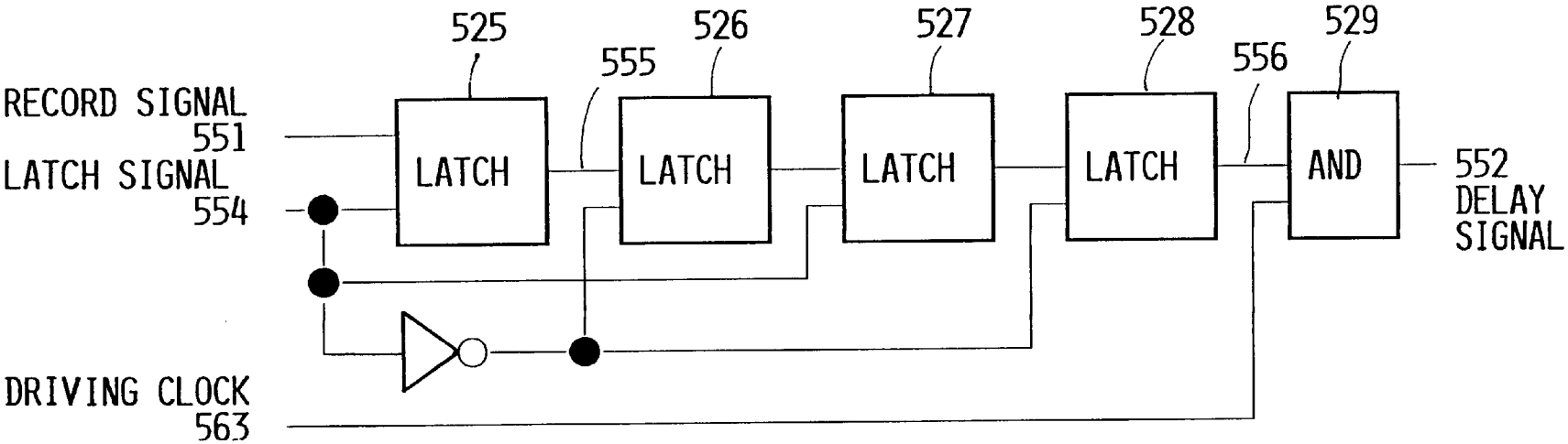
FIG. 28 shows a circuit block diagram of a delaying means of an inkjet recording apparatus according to this invention.

The embodiment 2-6 will be explained with reference to FIGS. 24 and 28.

Figure 24:
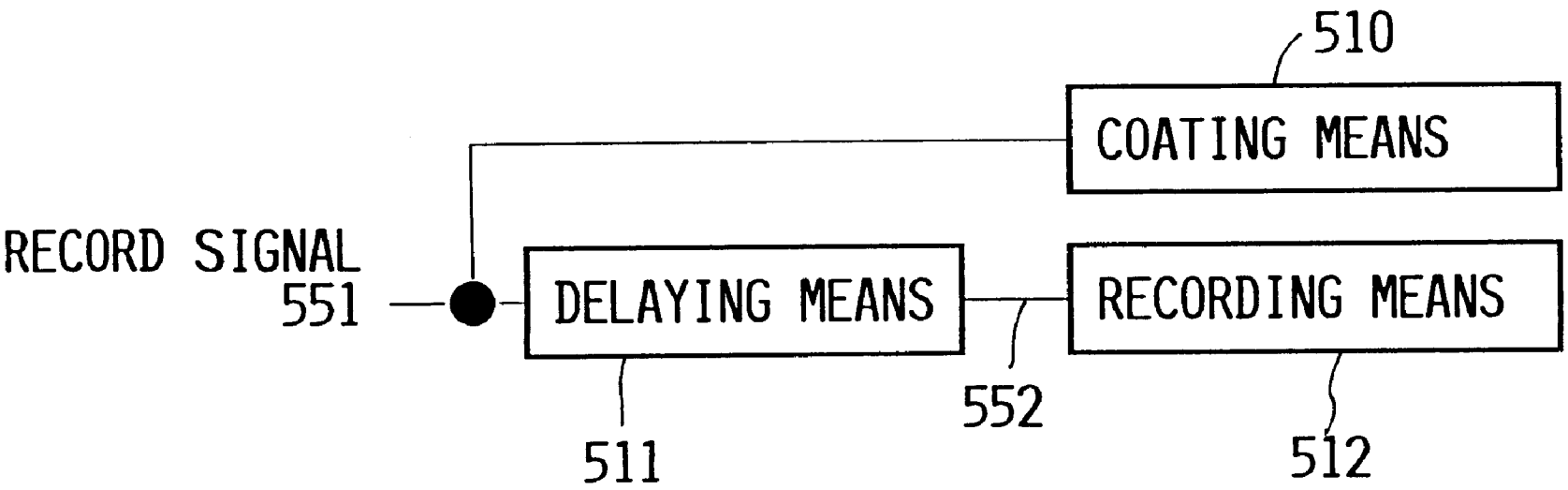
FIG. 24 shows a block diagram of an inkjet recording apparatus according to this invention.
Figure 25:
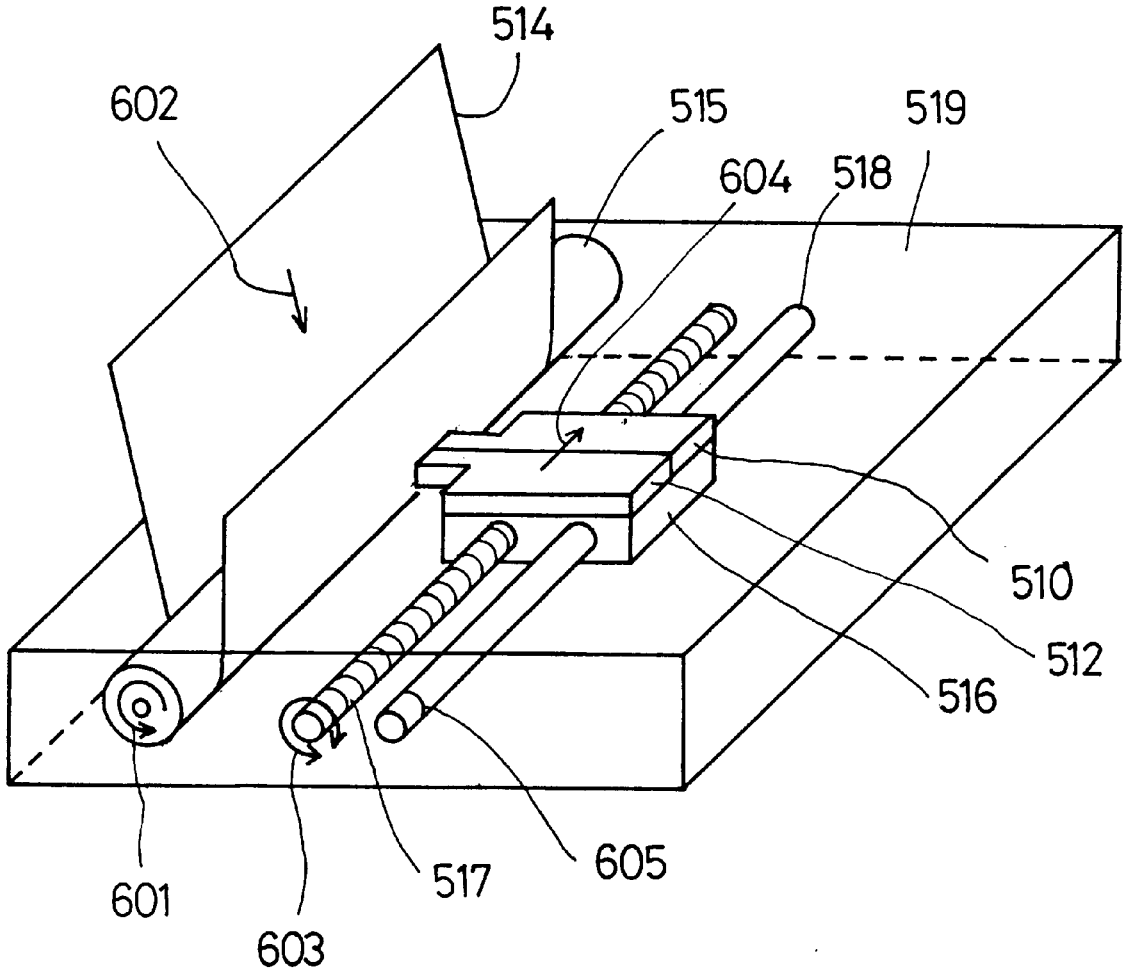
FIG. 25 shows another embodiment of an inkjet recording apparatus according to this invention.
Figure 26:
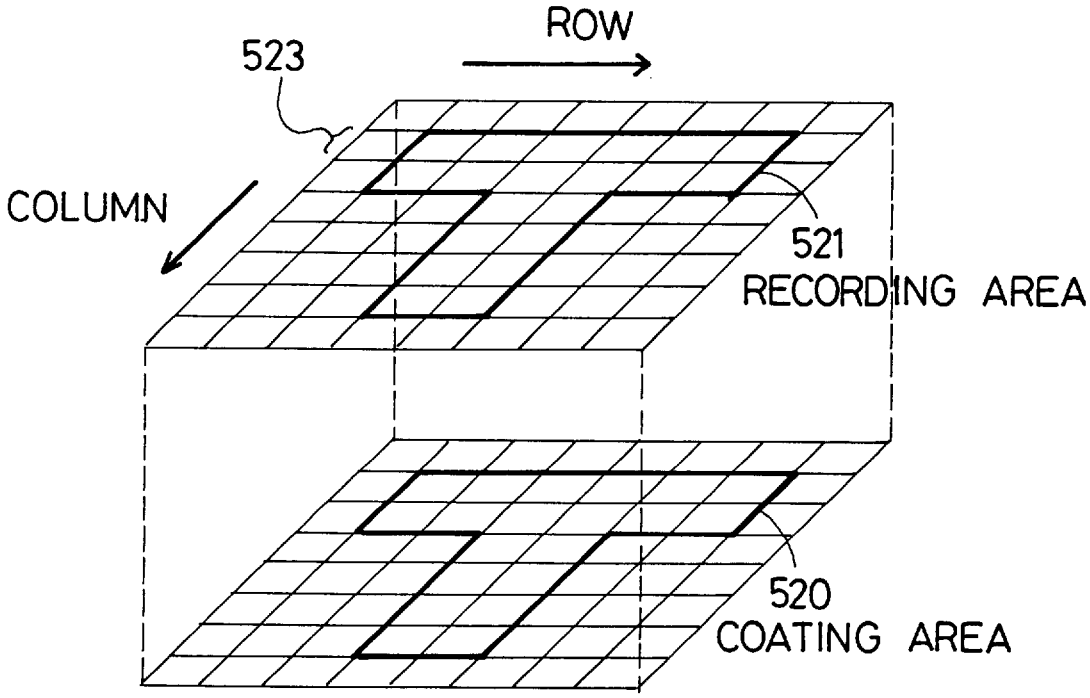
FIG. 26 shows an explanatory drawing of the relation between the coating area and the recording area of an inkjet recording apparatus according to this invention.
Figure 27:
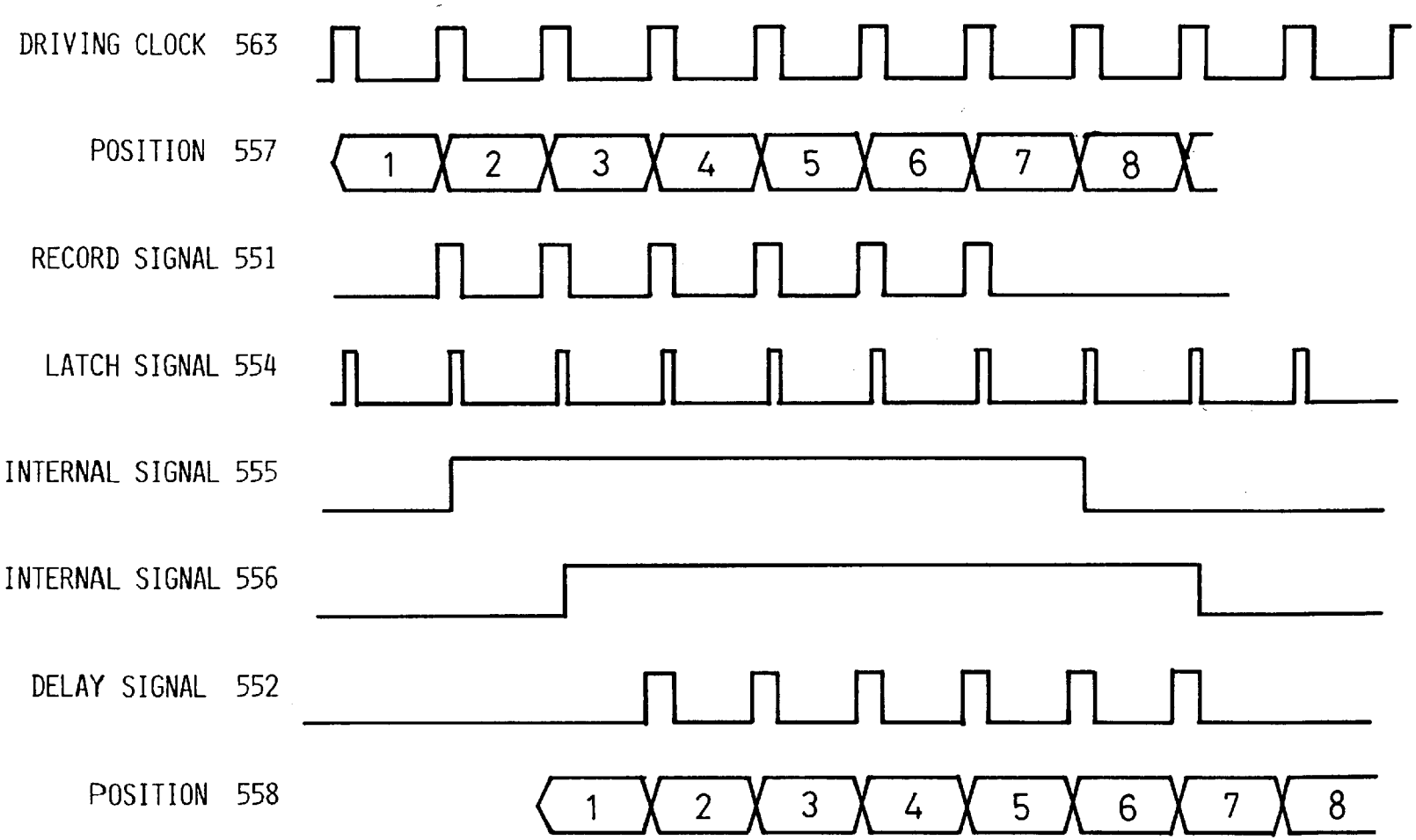
FIG. 27 shows a timing chart explaining the timing relation between the coating area and the recording area of an inkjet recording apparatus according to this invention.

FIG. 24 shows a block diagram of an inkjet recorder in this invention. FIG. 25 shows a type drawing of the inkjet recorder in this invention. FIG. 26 shows an explanatory drawing of relations between a coating area and a recording area in this invention. FIG. 27 shows a timing chart that explains the timing relations between coating operations and recording operations. FIG. 28 shows a circuit block diagram of a delaying means structure. In any of these Figures, the same parts and/or components are coded with the same reference numbers.

In FIG. 24, 510 is a coating means by which a recording medium is coated with a coating material which contains, for example, polyvinyl alcohol, according to a recording signal 551. The coating means 510 can be applied to an inkjet recording head to which the vibration of a piezoelectric element is applied, a bubble jet head to which film boiling is applied or to other kinds of miscellaneous inkjet recording heads. In this embodiment, a specific on-demand type inkjet recording head is used, of which structure and operations are explained in the embodiment 2-3 and 2-4. 511 is a delaying means which comprises a FIFO (First-in-first-out memory), a RAM (Random access memory), or a Latch, etc. The delaying means 511 functions such that datum or data which is inputted to it is/are stored temporarily (or for the time being) and is outputted when necessary. 512 is a recording means which is a well-known inkjet recording head.

In FIG. 25, 514 is a recording medium which can be a coated paper, a slightly coated paper for special use, a PPC paper, and OHP film, etc. 515 is a platen roller which turns by way of a motor which is not shown in the Figure. 516 is a carriage on which the coating means 510 and the recording means 512 are fixed. 517 is a lead screw which scans the carriage 516 by its own turning. 518 is a guide rail on which the carriage 514 slides. 519 is a frame which supports the platen roller 515, the lead screw 517, etc. The basic structure of this embodiment is the same as in FIG. 7.

In FIG. 27, position 557 is a position where the coating means 510 can coat and in which the numbers show the column to which a specific picture element corresponds. Likewise, position 558 is a position where the recording means 512 can record and in which the numbers show the column to which a specific element corresponds. In this embodiment, the coating means 510 has a preceding position by the length of two picture elements to the recording means 512 towards the arrow signal 604 in the main scanning direction, in which case the delaying means 511 can be realized with ease. The structure of the delaying means 511 is shown in FIG. 28. The structure of the delaying means 511 differs according to the number of nozzles of the inkjet recording means 512, bit length per one picture element, length of delay (which is "two picture elements" here), etc.

Next, the operation of the inkjet recorder according to this embodiment will be explained according to FIG. 24 through FIG. 28.

When the platen roller 515 turns towards the arrow signal 601, the recording medium 514 which is wrapped around the platen roller 515 is moved towards the arrow signal 602. The platen roller 515 then halts for a moment and adjusts the positions of the coating means 510 with the predetermined starting position of the recording means 512. The carriage 516 then initiates recording by shifting to the home position 605 by way of the lead screw 517 which is rotated.

The recording is done as follows: the recording signal 551 is input into the coating means 510 and the delaying means 511. Coating means 510 coats the recording medium on its surface with the coating materials according to the recording signal 551. The lead screw 517 then turns and the carriage 516 moves towards the arrow signal 604 in the main scanning direction on the lead screw 517 and the guide rail 518. Thereafter, while the coating means 510 shifts (or moves) towards the arrow signal 604 in the main scanning direction, the coating means 510 coats the coating material on the recording medium. At the same time the delaying means 511 inputs the delay signal 552 into the recording means 512 at a predetermined delay duration of time after receiving the recording signal 551. The delay duration of time is at least longer than the moving duration of time of the carriage 516 for adjusting the coating position of the coating means 510 to the recording position of the recording means 512. The recording means 512 discharges the inkjet recording ink according to the delay signal 552 and forms an image on the coating material disposed on the recording medium 514.

Taking as an example the character "T" to be recorded, the recording operation will be described in detail hereunder.

Assuming that a square in FIG. 26 corresponds to a picture element which is the smallest unit to be recordinged on. In this case, for example, the recording is done at the second row 523 on the recording medium.

Lead screw 517 turns synchronous with a driving clock signal 563, and then the carriage 516 is shifted by a picture element in accordance with the clock signal. When the driving clock signal 563 is input, the coating means 510 shifts to the position where it can coat the picture element in the first column, but the recording signal 551 does not form a pulse since the first column in the second row is a non-recording picture element, and the coating means 510 does not coat according to the recording signal 551. As shown in FIG. 27, by a pulse rising edge of a latch signal 554, the recording signal 551 is latched and an internal signal 555 turns to be LOW. Next, by a pulse falling edge of the latch signal 554, the internal signal 555 is latched and an output of a latch 526 also turns to be LOW.

Once the driving clock signal is input, the coating means 510 is shifted to a position where the picture element at the second column can be coated. At this point, since the coating means 510 is already on the picture element where it should recording, a pulse of the recording signal 551 is input into the coating means 510, and the coating material is coated on the area which corresponds to the picture element of the second column of the second row on the recording medium. By a pulse rising edge of the latch signal 554, the output of the latch 526 is latched and an output of latch 527 turns to be LOW. At the same time, the recording signal 551 is latched and the internal signal 555 turns to be HIGH. Next, by a pulse falling edge of the latch signal 554, the output of latch 527 is latched and the internal signal 556 turns to be LOW. The internal signal 555 is then latched and the output of latch 526 turns to be HIGH.

Next, a driving clock signal is input and than the coating means shifts at the position where the picture element of the third column can be coated. Thereafter, the recording means 512 shifts to the position where the picture element of the first column can be recordinged. At this point, since the coating means 510 is at the position of the picture element where recording should be done, a pulse of the recording signal 551 is input into the coating means 510 and the coating material is coated on the area which corresponds to the picture element of the third column of the second row. Due to the logical AND operation of the internal signal 556 and the driving clock signal 563, the delay signal 552 turns to be LOW, and the recording means 512 does not recording on the picture element of the first column. Moreover, by a pulse rising edge of the latch signal 554, the latch 527 latches the output of the latch 526 and the output of the latch 527 turns to be HIGH. At the same time, the recording signal 551 is latched, the internal signal 555 turns to be HIGH, the latch 526 latches the internal signal 555 and the output of the latch 526 also turns to be HIGH.

Moreover, when a driving clock signal 53 is input, the coating means 510 shifts to the position where the picture element of the fourth column can be coated, and the recording means 512 shifts to the position where the picture element of the second column can be recordinged. At this moment, since the coating means 510 is at the position of the picture element where the recording should be done, a pulse of the recording signal 551 is input into the coating means 510 and the coating material is coated on the area which corresponds to the picture element of the fourth column of the second row. Due to the logical AND operation of the internal signal 556 and the driving clock signal 563, the delay signal 552 turns to be HIGH and the recording means 512 discharges the recording ink and recordings on the coating material disposed on the recording medium. Moreover, by a pulse rising edge of the latch signal 554, the latch 527 latches the output of the latch 526 and the output of the latch 527 turns to be HIGH. At this point, the latch 525 latches the recording signal 551 and the output of the internal signal 555 turns to be HIGH. Next, by a pulse falling edge of the latch signal 554, the latch 528 latches the output of the latch 527 and the internal signal 556 turns to be HIGH. At the same time, the latch 526 latches the internal signal 555 and the output of the latch 526 turns to be HIGH.

By repetition of the above operations, recording in the main scanning direction can be achieved. Once recording in the main scanning direction is completed, the lead screw 517 is rotated in a reverse direction, the carriage 516 is shifted to the home position 605 and the next recording operation is ready to begin. The platen roller 515 is turned towards the arrow signal 601, the recording medium 514 which is wrapped on the platen roller 515 is shifted by one line towards the arrow signal 602 and recording in the next main scanning direction is completed.

By repetition of the above operations, recording is accomplished in one direction and the coating material is coated on the recording medium prior to inkjet recording and only on the area which should be recorded. According to the above inkjet printing operation, higher quality recording can be realized without regard to type of recording medium used.

(The Embodiment 2-7)

Based on FIG. 24, FIG. 26, FIG. 29 and FIG. 30, the embodiment 2-7 in this invention will be explained hereunder.

Figure 29:
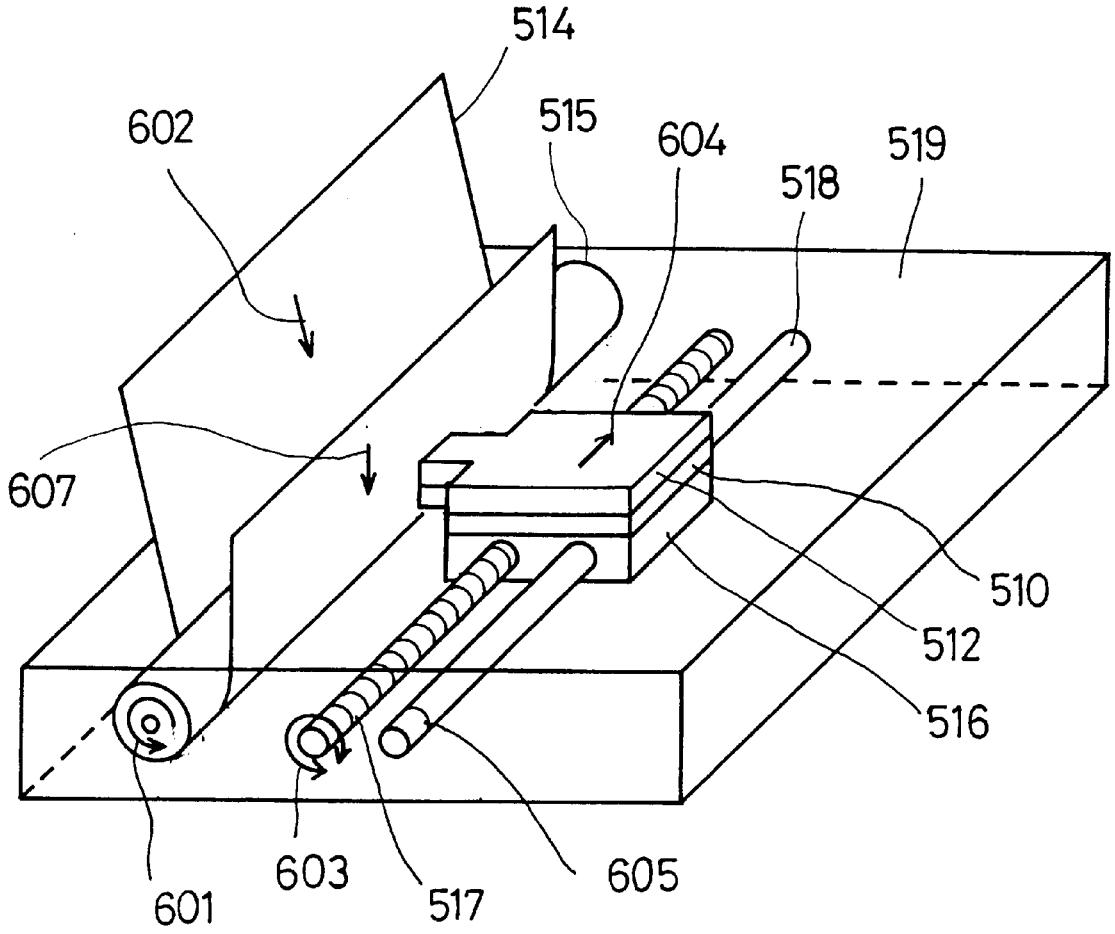
FIG. 29 shows another embodiment of an inkjet recording apparatus according to this invention.
Figure 30:
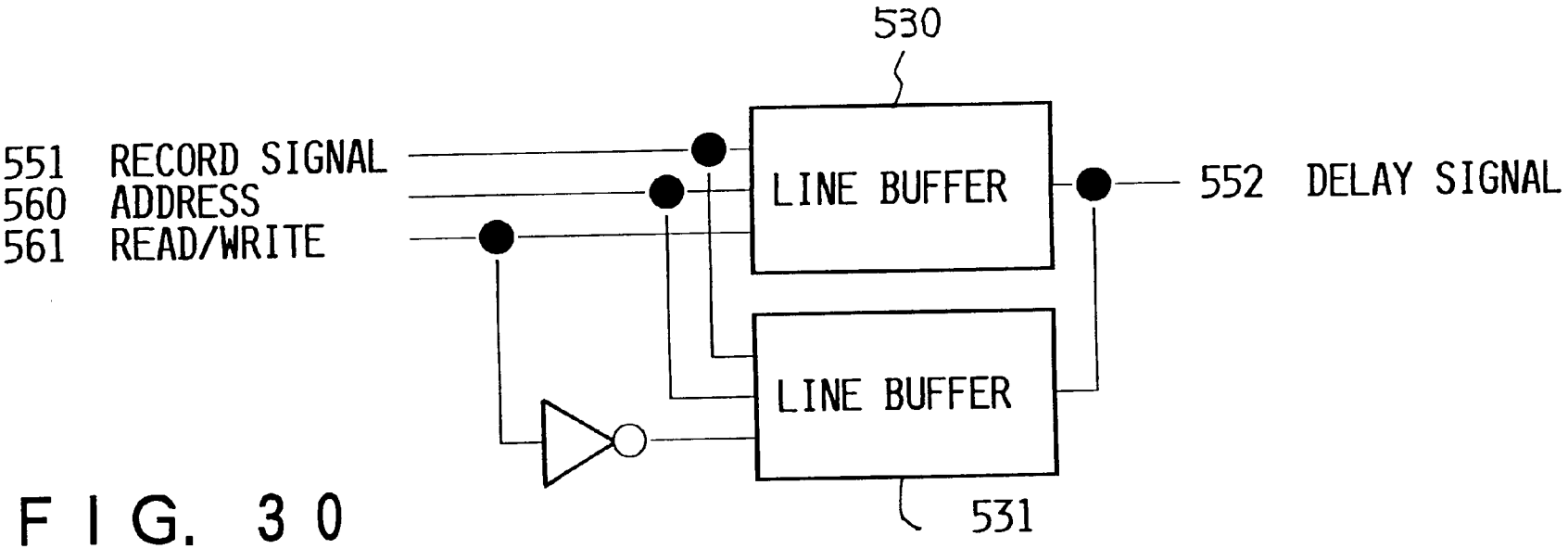
FIG. 30 shows a circuit block diagram of another embodiment of a delaying means of an inkjet recording apparatus according to this invention.

FIG. 29 shows a type drawing of an inkjet recording apparatus. FIG. 30 shows a circuit block diagram of a delaying means. In any of these Figures, the same parts and/or components are coded with the same reference numbers and explanation of the structural parts and drawings which have already been explained is specifically omitted.

In FIG. 29, the coating means 510 precedes by the length of one line the recording means 512 in the subscanning direction of the arrow signal 607. In this case, the delaying means 511 can be realized in the structure shown in FIG. 30 and the recording signal 551 is stored at the predetermined address of a line buffer which is chosen by the address 560 and READ/WRITE signal 561. The memory capacity of the line buffer is different from the number of nozzles on the recording means 512 and/or the bit and delay length per picture element. But in this case, it is enough if the memory capacity stores at least the minimum volume of data which the recording means 512 should recording in one main scanning direction. The basic structure in this embodiment is the same as in FIG. 16 and FIG. 17.

Next, operations of this embodiment is explained hereunder. The procedure and operations here are entirely the same as in the embodiment 2-6 up to the point where the carriage 516 is shifted to the home position 105 and where the recording operation is initialized.

The recording is done as follows: the recording signal 551 is input into the coating means 510 and the delaying means 511. The coating means 510 coats the coating material on the recording medium according to the recording signal 551. The lead screw 517 turns and the carriage 516 shifts on the lead screw 517 and the guide rail 518 towards the arrow signal 604 in the main scanning direction. By this operation, the coating means 510 coats the coating material on the recording medium while moving towards the arrow signal 604 in the main recording direction. The delaying means 511 delays the recording signal 551 by one line and such delayed signal is a delay signal 552. The delaying means 511 has the structure shown in FIG. 30, and one of two line buffers is used for storing the recording signal 551 and the other is used for outputting the delay signal 552. Switching of the line buffer memorization and reading modes is controlled by the READ/WRITE signal 561, and then the delay signal is input into the recording means 512. The recording means 512 discharges the recording ink according to the delay signal 552 and forms an image on the coating material disposed on the recording medium.

The above recording operations will be explained hereunder in more detail using the case of the character "T" to be recordinged shown in FIG. 26.

The coating means 510 is at the position where the first row can be coated, and the recording signal 551 is input into the coating means 510 and the delaying means 511. But since the recording signal 551 always results to be LOW because the first row is in the non-recording area, the coating means 510 does not coat. The recording signal 551 which is input into the delaying means 511 is thus written onto a line buffer 530 which is chosen by the READ/WRITE signal 561. The address 560 which is generated by WRITE is initialized every time the carriage 516 returns to the home position 605 and is counted up at every shift of the carriage 516 by a picture element towards the main scanning direction. According to this operation, the recording signal 551 of whole data for one line is stored into the line buffer 530 and the first scanning is completed. The lead screw 517 is turned in a reverse direction and the carriage 516 is shifted to the home position 605. The platen roller 515 turns towards the arrow signal 601, the recording medium 514 which is wrapped onto the platen roller 515 is shifted towards the arrow signal 602 by one line and is ready for recording.

The coating means achieves the position where the coating can be coated on the second row and the recording means 512 achieves the position where the recording ink can be recordinged on the first row. The recording signal 551 for recording the picture elements in the second through the seventh column is input into the coating means 510 and the delaying means 511. The coating means 510 coats the coating material at the position of the picture elements which corresponds to the second through the seventh column according to the recording signal 551. A line buffer 531 which is chosen for WRITE according to the READ/WRITE signal 561 stores the recording signal 551 according to the address 560. On the other hand, the line buffer 530 which is chosen for READ outputs the delay signal 552 according to the address 560. The delay signal 552 is input into the recording means 512. The recording means 512 discharges the recording ink according to the delay signal 552, but no pulse is output since LOW is stored in all addresses of the line buffer 530 during scanning on the former line. Therefore, the recording means 512 does not discharge the recording ink at all. As described above, at the end of the second scanning, the lead screw 517 turned in a reverse direction (against the recording direction) and the carriage 516 is moved to the home position 605. The platen roller 515 is turned towards the arrow signal 515 and the recording medium 514 which is wrapped onto the platen roller 515 is shifted towards the arrow signal 602 by one line and the next recording operation is initialized.

The coating means 510 then takes the position where the coating material can be coated on the third row, and the recording means 512 takes the position where the recording ink can be recordinged on the second row. The pulse of recording signal 551 for recording of the picture elements of the second through the seventh column is input into the coating means 510 and the delaying means 511. The coating means 510 coats the coating material on the position of the picture elements which corresponds to the second through the seventh column according to the recording signal 551. The line buffer 530 which is chosen for WRITE according to the READ/WRITE signal 561 stores the recording signal 551 according to the address 560. On the other hand, the line buffer 531 which is chosen for READ outputs the delay signal 552 according to the address 560. The delay signal 552 is input into the recording means 512. The recording means 512 discharges the recording ink according to the delay signal such that the recording means 512 discharges the recording ink at the position of the picture elements which corresponds to the second through the seventh column, since the data stored in the line buffer 531 in the scanning of the former line is for recording onto the position of the picture elements which corresponds to the second through the seventh column. By the above operation, the recording ink can be recordinged on the picture elements where the coating material is coated during the former scanning. At this point, the third scanning comes to an end. The lead screw 517 is turned in a reverse direction (opposite the recording direction) and the carriage 516 is moved to the home position 605. The platen roller 515 is turned towards the arrow signal 601 and then the recording medium 514 wrapped onto the platen roller 515 is shifted by one line towards the arrow signal 602 and the next recording operation is initiated.

By repeating the above operation, the coating material can be coated on the recording medium as shown in FIG. 26 and the recording ink can be recordinged on the coating material. According to the foregoing printing operation, a higher quality recording can be realized without regard to the type of recording medium used. It is understood that in this embodiment recording can be performed in the arrow signal 604 direction as well as in the reverse direction. By the above inkjet recording operation, high speed recording is made possible.

The delaying means 511 can be adopted to delay an arbitrary number of lines by means of applying different memory capacities and different generating address methods.

(The Embodiment 2-8)

The embodiment 2-8 in this invention will be explained hereunder using FIG. 26, FIG. 29, FIG. 30, FIG. 31 and FIG. 32.

Figure 31:
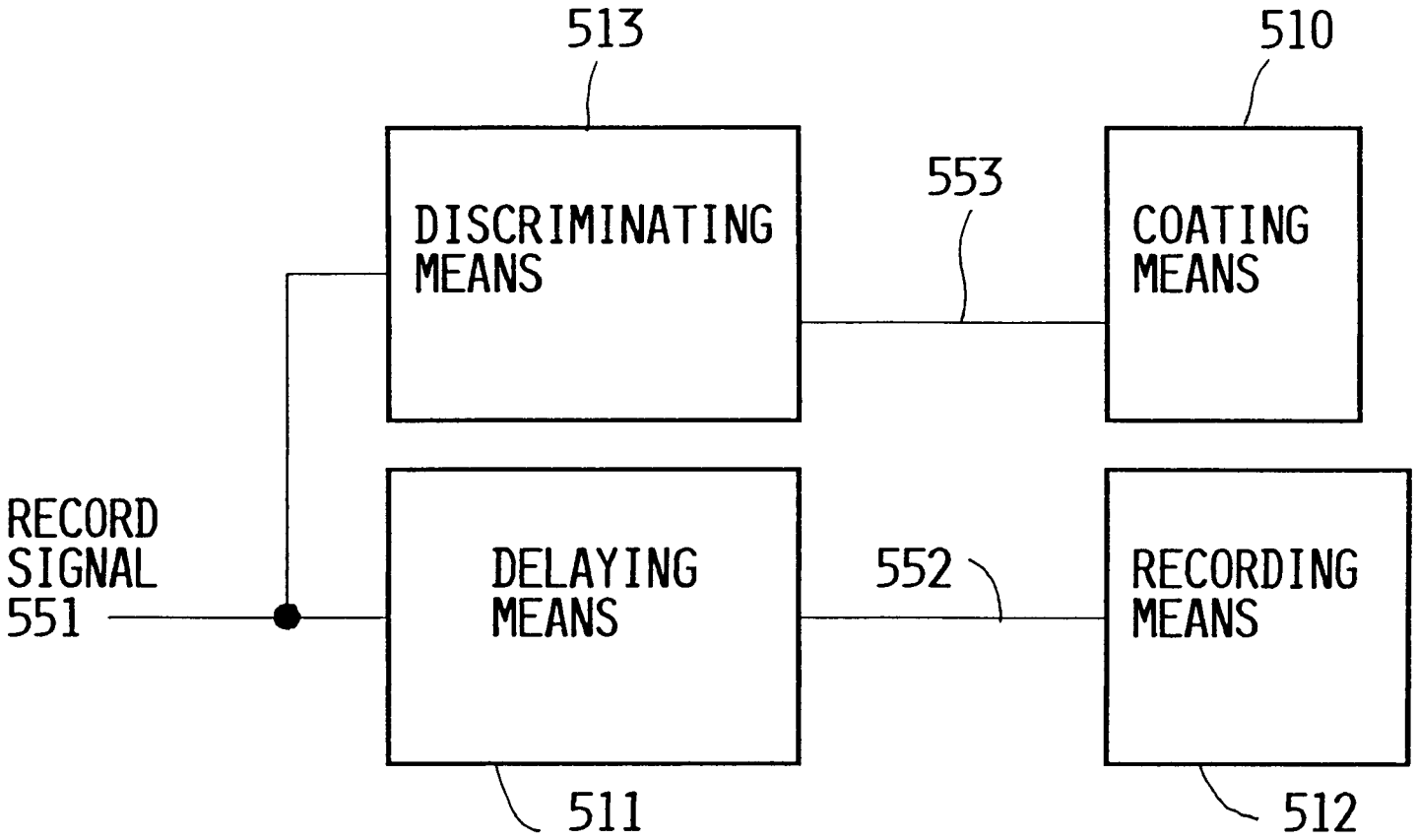
FIG. 31 shows a block diagram of another embodiment of an inkjet recording apparatus according to this invention.
Figure 32:
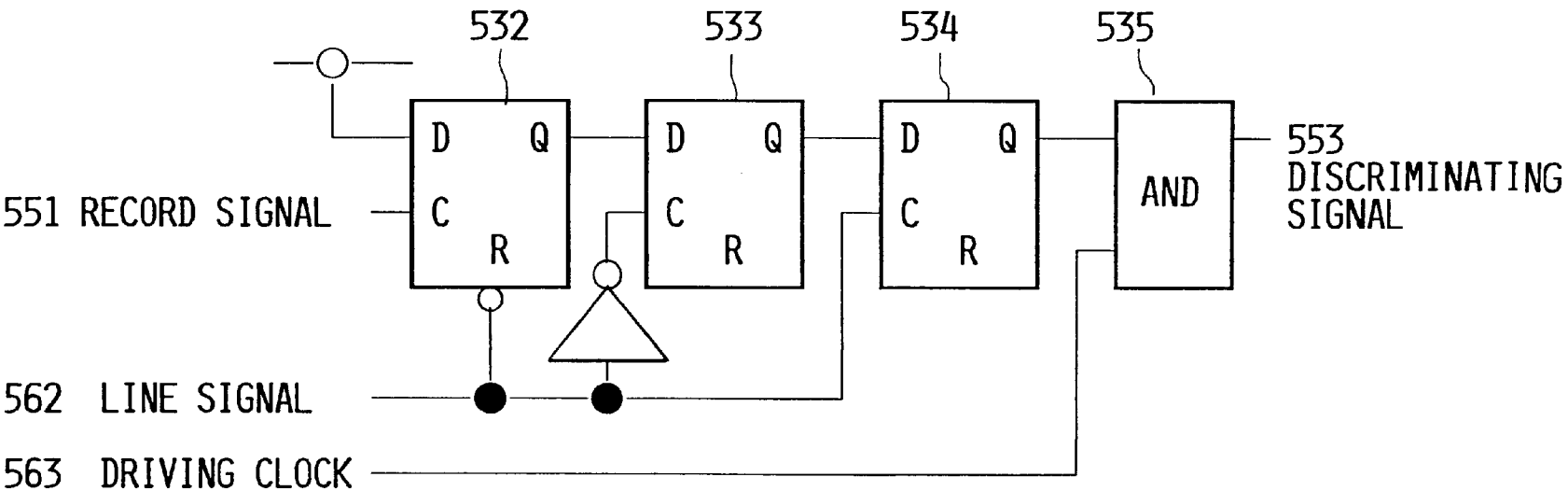
FIG. 32 shows a circuit block diagram of discriminating means of an inkjet recording apparatus according to this invention.

FIG. 31 shows a block diagram of an inkjet recording apparatus in this invention. FIG. 32 shows a circuit block diagram of a discriminating means and its structure. In any of these Figures, the same parts and/or components are coded with the same reference number. An explanation of the structural parts and drawings which have already been explained is specifically omitted.

In FIG. 31, 513 is the discriminating means which determines if the coating material should be coated and outputs the discriminating signal 553 which is the result of the determination above. The coating means 510 coats the coating material on the recording medium according to the discriminating signal 553. The coating means 510 can be applied to miscellaneous types of inkjet recording heads such as an inkjet recording head using piezo-electric vibration or a bubble jet head using film evaporation. In this embodiment, an on-demand type inkjet recording head is specifically used. 511 is the delaying means which comprises a FIFO, a RAM or a latch, etc. The delaying means 511 temporarily stores input datum and outputs such datum if required or necessary. 512 is the recording means which is a well-known inkjet recording head.

The coating means 510 precedes the recording means 512 by one line length towards the arrow signal 607 in the subscanning direction. In this case, the delaying means 511 is realized according to the structure shown in FIG. 30. In this embodiment, the structure shown in FIG. 30 is the same as in the embodiment 2-7, but the capacity of the line buffer, how the READ/WRITE signal 561 and the address 560 are given and a few other points are different from the case in the embodiment 2-7.

Operations of the inkjet printer according to this embodiment will be explained hereunder with reference to FIGS. 30 and 32. The procedure and operations are all the same as in the embodiment 2-7 to the stage where the carriage 16 is moved to the home position 605 and when the recording operation is initialized.

During the recording operation, the recording signal 551 is input into the discriminating means 513 and the delaying means 511. Specifically, the recording signal 551 is input into a terminal C of a flip-flop 532 (hereinunder abbreviated as FF). The FF532 is initialized beforehand according to a line signal 562 of which the output of a terminal Q is LOW. The line signal 562 is output by a pulse per one line, and the effective range of the recording signal 551 for one line is shown at a HIGH status. The recording signal 551 is supposed to be effective so long as the line signal 562 is HIGH. Once the line signal 562 turns to be LOW, the FF532 is initialized. Since a terminal D of the FF532 is fixed as HIGH, terminal Q turns to be HIGH according to the rising edge of the recording signal 551. The status of terminal Q is held until the line signal 562 turns to be LOW. Terminal Q of the FF532 is coupled with terminal D of the FF533 and the FF533 outputs the status of terminal D at the pulse fall of the line signal 562 to its terminal Q.

Terminal Q of the FF533 is coupled with terminal D of the FF534 and the FF534 outputs the status of terminal D at the pulse rise of the line signal 562 at terminal C to its terminal Q. Terminal Q of the FF534 as well as the driving clock 563 is input into an AND gate 535, and the AND gate 535 outputs the logical AND of both signals above as the discriminating signal 553. The driving clock 563 comprises pulses that correspond to the number of all picture elements for one line. As explained above, the discriminating means 513 generates the discriminating signal 553 according to the recording signal 551 and outputs it. If there exists in one line any one of picture elements to be recordinged, the discriminating means 513 controls the coating means 510 so that the entire area of the line is coated. Because of this, the discriminating signal 553 is delayed by one line to the recording signal 551.

The coating means 510 coats the coating material on the recording medium according to the discriminating signal 553. Due to this, the lead screw 517 turns, and the carriage 516 shifts on the lead screw 517 and the guide rail 518 towards the arrow signal 604 in the main scanning direction.

Next, the operation of the delaying means 511 will be explained hereunder with reference to FIG. 30.

The delaying means 511 delays the recording signal 551 by two lines and switches over buffers, each of which has at least the capacity enough to store two lines of data, one of which is used for storing the recording signal 551 and the other of which is used for outputting the delay signal. Switching over is done once by two lines and is controlled by the READ/WRITE signal 561. Each time the mode changes from WRITE to READ or from READ to WRITE, the address 560 used for READ/WRITE is initialized once by two lines in this embodiment and the address 560 is counted up during synchronization with the driving clock 563 in each mode. According to the above operations, the recording signal 551 is delayed by two lines and is input into the recording means 512 as the delay signal 552.

The recording means 512 discharges the recording ink according to the delay signal 552 and forms an image on the coating material which is coated on the recording medium 514.

The above recording operations will be explained in more detail using the case of character "T" to be recordinged in FIG. 26.

Suppose that a square in FIG. 26 corresponds to a picture element which is the smallest unit for recording.

The recording signal 551 is input into the discriminating means 513 and the delaying means 511. The discriminating means 513 determines if the picture element for recording exists. In this case, the recording signal 551 turns to be always LOW and no pulse is input, and the discriminating signal 553 turns to be LOW since the first row is in a non-recording area. The recording signal is then stored to the line buffer 530 which is chosen for WRITE according to the READ/WRITE signal 561. After operations corresponding to one line is completed, the platen roller 515 is turned towards the arrow signal 601 and the recording medium 514 wrapped onto the platen roller 515 is shifted towards the arrow signal 602 by one line.

The coating means 510 reaches the position where the first row is coated, but the coating means 510 does not coat according to the discriminating signal 553. With respect to the recording signal 551 which corresponds to the second row, a pulse by which the second through the seventh picture elements is recordinged is input into the discriminating means 513 and the delaying means 511. The discriminating means 513 recognizes the existence of a picture element to be recordinged, and the discriminating signal 553 turns to be HIGH. The delaying means 511 stores the recording signal 551 into the line buffer 530 which is chosen for WRITE according to the READ/WRITE signal 561. After the storing step, the address 560 is counted up continuously to the former lines counted. After the operations which correspond to one line is completed, the lead screw 517 turns in a reverse direction (against the recording direction), the carriage 516 moves to the home position 605, the platen roller 515 turns towards the arrow signal 601, and the recording medium 514 wrapped onto the platen roller 515 shifts towards the arrow signal 602 by one line.

The coating means 510 then shifts to the position where the coating to the second row can be done and the recording means shifts to the position where the recording to the first row can be done. The coating means 510 coats all of the picture elements in the second row according to the discriminating signal 553. The recording signal 551 which corresponds to the third row inputs a pulse into the discriminating means 513 and the delaying means 511 in order to recording picture elements of the second through the seventh column. The discriminating means 513 recognizes the existence of a picture element to be recordinged and has the discriminating signal 553 turned HIGH. The delaying means 511 stores the recording signal 551 into the line buffer 531 which is chosen for WRITE according to the READ/WRITE signal 561. The address 560 during the storing step is initialized in accordance with the switching of the READ/WRITE signal 561 and is counted up from an initial value.

Moreover, the line buffer 530 which is chosen for READ according to the READ/WRITE signal 561 outputs the delay signal 552 according to the address 560. The recording means 512 receives the delay signal 552, but recording is not performed since the delay signal 552 does not include a pulse. After the printing operation which corresponds to one line is completed, the lead screw 517 turns in a reverse direction (against the recording direction), the carriage 516 moves to the home position 605, the platen roller 515 turns towards the arrow signal 601, and the recording medium 514 wrapped onto the platen roller 515 shifts towards the arrow signal 602 by one line. The coating means 510 achieves the position where coating can be performed onto the third row and the recording means 512 achieves the position where recording can be performed onto the second row. The coating means 510 coats the area of all picture elements on the third row according to the discriminating signal 553. The recording signal 551 which corresponds to the fourth row inputs a pulse into the discriminating means 513 and the delaying means 511 for recording picture elements of the fourth through the fifth column. The discriminating means 513 recognizes the existence of a picture element to be recordinged and has the discriminating signal 553 turned to be HIGH. The delaying means 511 stores the recording signal 551 into the line buffer 531 which is chosen for WRITE according to the READ/WRITE signal 561.

Moreover, the line buffer 530 which is chosen for READ according to the READ/WRITE signal 561 outputs the delay signal 552 according to the address 560. The recording means 512 receives the delay signal 552 and discharges the recording ink onto the picture elements of the second through the seventh column and recordings it. By this operation, recording can be done on the picture element which is coated during scanning of the former line. After the operation corresponding to one line is completed, the lead screw 517 is rotated against the recording direction, the carriage 516 moves to the home position 605, the platen roller 515 turns towards the arrow signal 601, and the recording medium 514 wrapped onto the platen roller 515 shifts towards the arrow signal 602 by one line.

By repeating the above operations, the coating of the coating material can be done on the recording medium and the recording with the recording ink can be done on the coating material, and higher quality recording can be realized without regard to the type of recording medium used.

Figure 40:
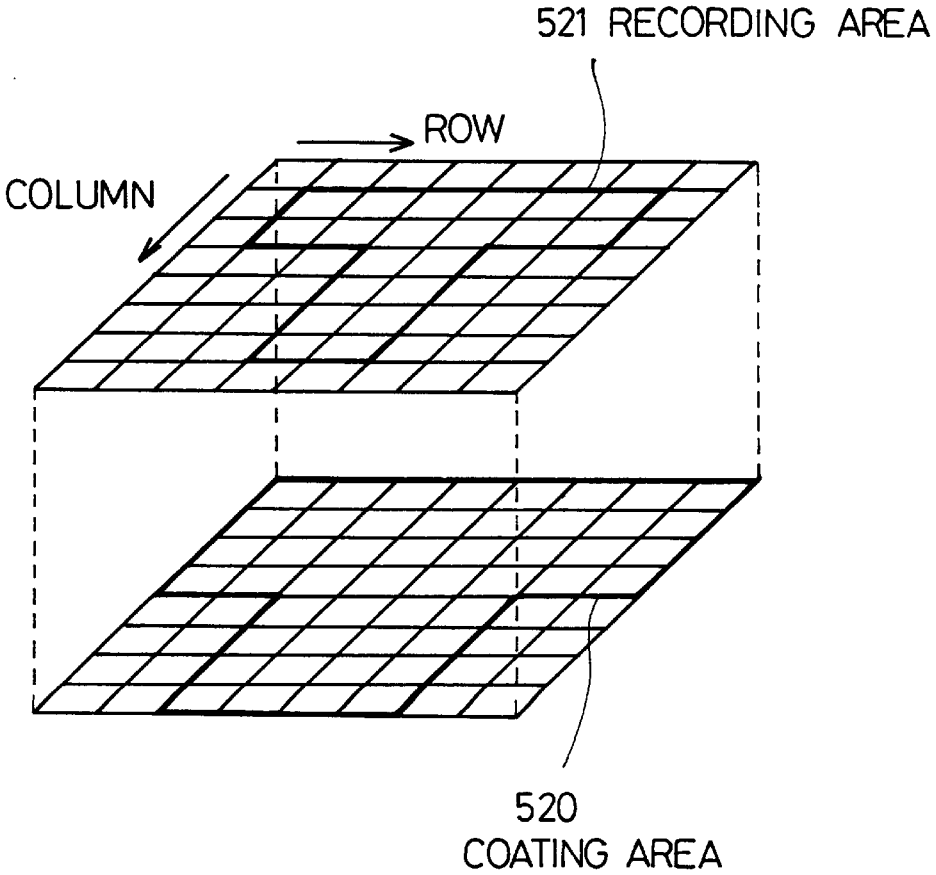
FIG. 40 shows an explanatory drawing of the relation between a coating area and a recording area of an inkjet recording apparatus according to this invention.

Although an on-demand type inkjet recording head is used as the coating means in the embodiments 2-6, 2-7 and 2-8, the coating means is not limited to such embodiment. For example, a spray type coating means using high pressure air, gas, etc., and a coating method that has the coating surface directly contacted with a sponge, a roller, etc., which absorbs the coating material, can also be applied. Such coating means have already been mentioned above. Moreover, it is also understood that by changing the discriminating method in the discriminating means 513 the neighboring picture elements of characters and/or pictures to be recordinged can also be the coating area as shown in FIG. 40.

(The Embodiment 2-9)

Hereunder, the Embodiment 2-9 in this invention will be explained with reference to FIG. 33 through FIG. 35.

Figure 33:
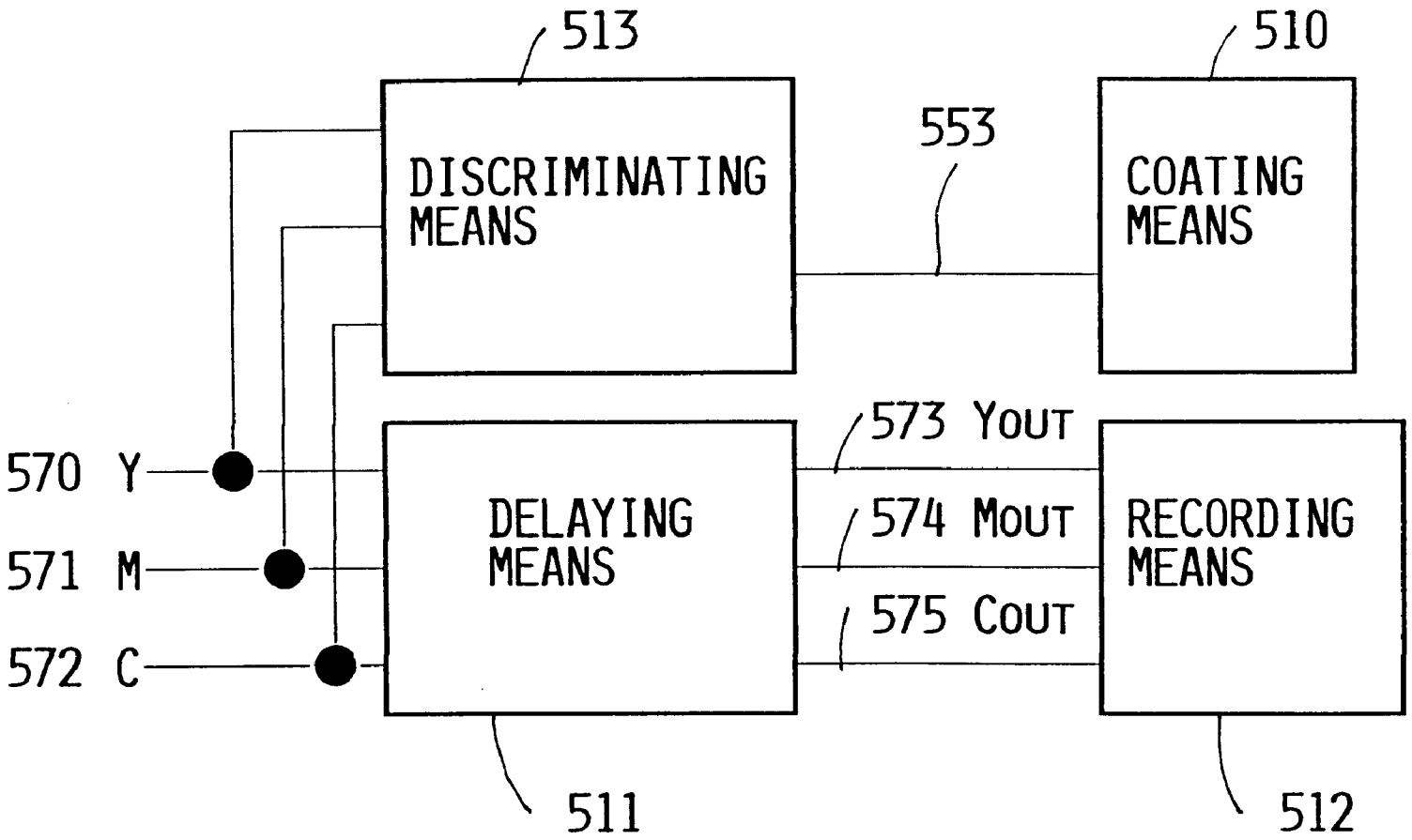
FIG. 33 shows a block diagram of another embodiment of an inkjet recording apparatus according to this invention.

FIG. 33 shows a block diagram of an inkjet recording apparatus according to another embodiment of this invention. FIG. 34 shows a type drawing of the inkjet recording apparatus in this embodiment. FIG. 35 shows a timing chart of operations of the discriminating means and the delaying means in this embodiment. In any of these Figures, the same parts and/or components are coded with the same reference numbers.

In FIG. 33, 513 is the discriminating means which determines by the recording signals of Y(yellow) signal 570, M(magenta) signal 571, and C(cyan) signal 572 if the coating material should be coated, and outputs the result as the discriminating signal 553. 510 is the coating means which coats the coating material on the recording medium according to the discriminating signal 553. The coating means 510 can comprise any miscellaneous inkjet recording head, such as an inkjet recording head of piezoelectric vibration, a bubble jet head of film evaporation, etc. In this embodiment, an on-demand type inkjet recording head is specifically used. 511 is the delaying means which comprises a FIFO, a RAM or a latch, etc. The delaying means 511 temporarily stores data which is input into it and outputs the data when necessary. 512 is the recording means which comprises a well-known recording head.

Figure 34:
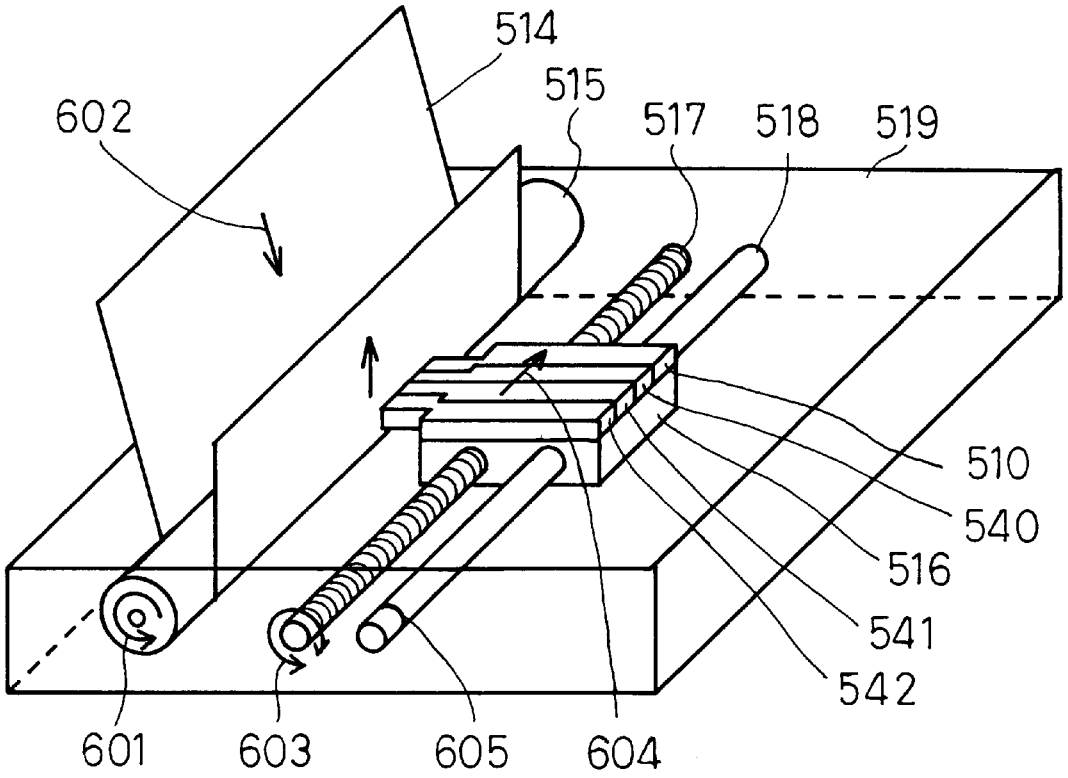
FIG. 34 shows another embodiment of an inkjet recording apparatus according to this invention.

In FIG. 34, 540 is a Y head which is a well-known inkjet recording head and discharges yellow ink. 541 is an M head which is a well-known inkjet recording head and discharges magenta ink. 542 is a C head which is a well-known inkjet recording head and discharges cyan ink. 540, 541 and 542 also correspond to the recording means 512.

The coating means 510 is at a preceding position to the Y head 540 by one dot length towards the arrow signal 604 in the main scanning direction. Likewise, the Y head 540 is at a preceding position to the M head 541 by one dot length and to the C head 542 by two dot lengths toward the arrow signal 604 in the main scanning direction.

Operations of the discriminating means 513 and the delaying means 511 will be explained hereunder.

Figure 35:
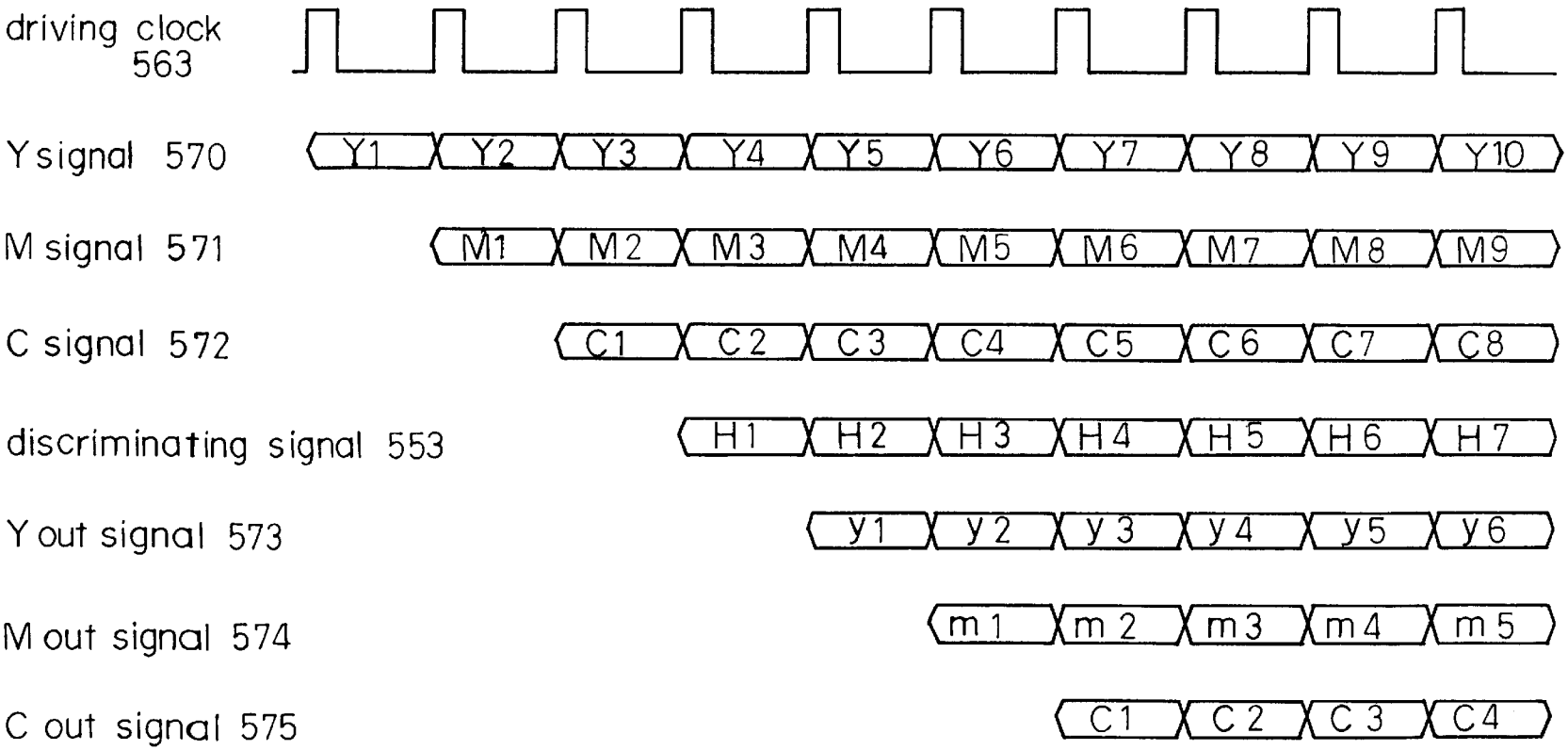
FIG. 35 shows a timing chart of operations of discriminating means and delaying means of an inkjet recording apparatus according to this invention.

Taking it under consideration that the Y head 540, the M head 541 and the C head 542 are fixed exactly at one dot length's distance, Y signal 570, M signal 571 and C signal 572 are transferred synchronously to the driving clock 563 as shown in FIG. 35. The driving clock 563 is also synchronous with the shift of the carriage, which shifts by one dot length per one clock pulse towards the arrow signal 604 in the main scanning direction. Into the discriminating means 513 and the delaying means 511, the following signals are input: the Y signal Y1 which corresponds to the first picture element and the M signal M1 which corresponds to the first picture element together with the first driving clock 563, the Y signal Y2 which corresponds to the second picture element together with the next driving clock pulse, the Y signal Y3 which corresponds to the third picture element, the M signal M2 which corresponds to the second picture element and the C signal C1 which corresponds to the first picture element together with the next driving clock pulse. Likewise, the signals which are signals that recording the same picture element are input in sequence into the discriminating means 513 and the delaying means 511 with the delay of one clock pulse.

The discriminating means 513 outputs the discriminating signal 553 even when at least one signal which is a recording pulse is included in the Y signal 570, the M signal 571 and the C signal 572 which correspond to the same one picture element. For example, when one or more recording pulse is/are included in the Y signal Y1, the M signal M1 and the C signal C1 which correspond(s) to the first picture element, the discriminating signal H1 is input into the coating means 510 which coats the coating material on the recording medium according to the discriminating signal H1. The delaying means 511 adjusts the operation timing between the coating means 510 and the recording means 512. Since the discriminating signal H1 is output with a delay of three clock pulses of the driving clock 563 to the Y signal Y1, the delaying means 511 makes the Yout signal y1, which delays by four clock pulses of the driving clock 563 to the Y signal Y1. Similarly, the delaying means 511 makes the Mout signal m1 and the Cout signal c1 which delay by four clock pulses of the driving clock 563 to the M signal M1 and the C signal C1, respectively. The Yout signal 573, the Mout signal 574, and the Cout signal 575 are respectively input into the Y head 540, the M head 541, and the C head 542.

Next, the operation of the inkjet printer according to this embodiment is explained.

The operation is the same as explained in the previous embodiment to the point where the carriage 516 moves to the home position 605 and recording is initiated.

As shown in FIG. 35, while synchronized to the driving clock 563, the Y signal 570, the M signal 571, and the C signal 572 are transferred and are input into the discriminating means 513 and the delaying means 511. Furthermore, while synchronized to the driving clock 563, the lead screw 517 turns and the carriage 516 shifts by one dot towards the arrow signal 604 in the main scanning direction.

The discriminating means 513 determines if it is a recording picture element out of the Y signal 570, the M signal 571 and the C signal 572 which correspond to the same one picture element and outputs the discriminating signal 553 into the coating means 510. The coating means 510 coats the coating material on the recording medium according to the discriminating signal 553. The delaying means 511 generates the Yout signal 573, the Mout signal 574 and the Cout signal 575, which are delayed by four pulses of the driving clock 563 to the Y signal 570, the M signal 571 and the C signal 572. The Yout signal 573, the Mout signal 574 and the Cout signal 575 are respectively input into the Y head 540, the M head 541 and the C head 542, and each head discharges the recording ink and recordings on the coating material which is coated by the coating means 510.

By repeating the above operation, the coating material is coated on the recording medium and the recording ink is recordinged on the coating material. As a result, a high quality color recording is realized without regard to the type of recording medium used.

(The Embodiment 2-10)

The embodiment 2-10 in this invention will be explained hereinunder with reference to FIG. 33, FIG. 36 and FIG. 37.

Figure 36:
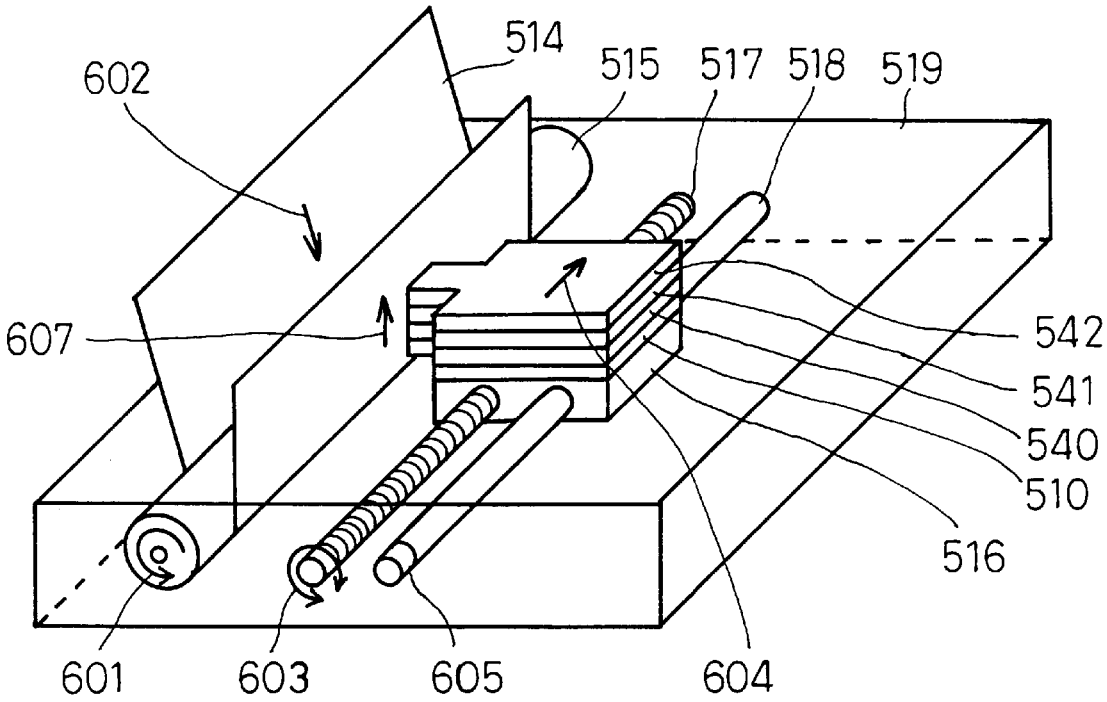
FIG. 36 shows another embodiment of an inkjet recording apparatus according to this invention.

FIG. 36 shows an inkjet recording apparatus according to this invention. FIG. 37 shows a timing chart of operations of the discriminating means and the delaying means. In FIGS. 33–37 the same parts and/or components are coded with the same reference numerals.

The inkjet recording apparatus shown in FIG. 33 functions in the same way as the inkjet recording apparatus described with respect to embodiment 2-9, except that the time for transferring the Y signal 570, the M signal 571 and the C signal 572 to the delaying means 511 and the discriminating means 513 is different. Therefore, the output of the Yout signal 573, the Mout signal 574 and the Cout signal 575 are also different from the embodiment 2-9.

In FIG. 36, 540 is a well-known inkjet recording Y head and discharges yellow recording ink. 541 is a well-known inkjet recording M head and discharges magenta recording ink. 542 is a well-known inkjet recording C head and discharges cyan recording ink. 540, 541 and 542 correspond to the recording means 512 described above.

The coating means 510 precedes the Y head 540 by one line towards the arrow signal 607 in the subscanning direction. Likewise, the Y head 540 precedes the M head 541 by one line and the C head 542 by two lines, respectively, towards the arrow signal 607 in the subscanning direction. In the main scanning direction, the Y head 540, the M head 541 and the C head 542 are fixed at the same position. For example, after recording with the Y head 540, the recording medium 514 shifts by one line towards the arrow signal 602 in the subscanning direction and then the M head 541 recordings. By this arrangement, the magenta ink can be recordinged over the yellow ink. Operations of the discriminating means 513 and the delaying means 511 are explained below.

Figure 37A:
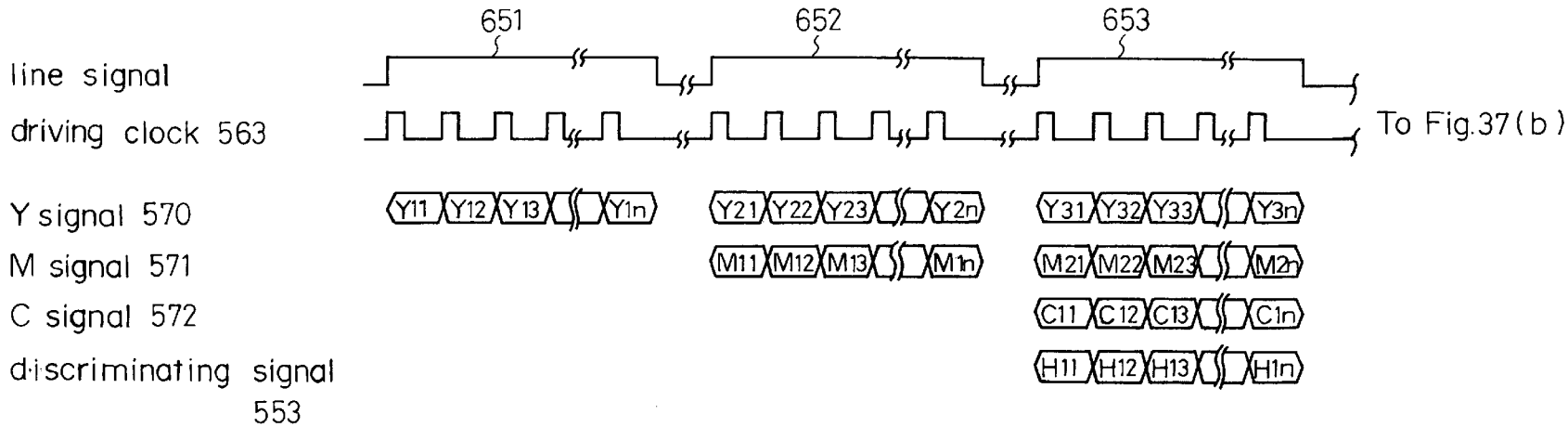
FIG. 37 shows a timing chart of operations of discriminating means and delaying means of an inkjet recording apparatus according to this invention.
Figure 37B:
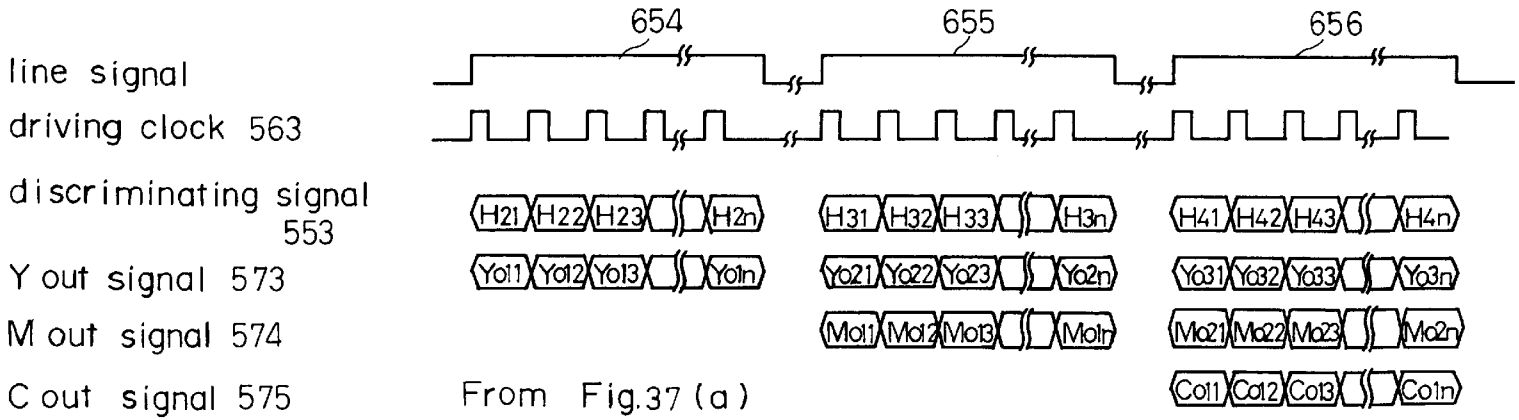

Taking into consideration that the positions of the Y head 540, the M head 541 and the C head 542 are fixed by one line interval, the Y signal 570, the M signal 571 and the C signal 572 are input into the discriminating means 513 and the delaying means 511 synchronously to the driving clock 563 as shown in FIG. 37. The driving clock 563 is synchronized to the movement of the carriage, which shifts by one dot length per one clock pulse towards the arrow signal 604 in the main scanning direction. The line signal shows a valid range in a line of the Y signal 570, the M signal 571 and the C signal 572.

The discriminating means 513 outputs the discriminating signal 553 when there exists a recording pulse from at least one of the Y signal 570, the M signal 571 and the C signal 572. For example, when at least one or more of the recording pulses is included in the Y signal Y11, the M signal M11, and the C signal C11, which correspond to the first picture element, the discriminating signal H11 is output into the coating means 510, and the coating means 510 coats the coating material on the recording medium according to the discriminating signal H11. In order to execute the above operation, the discriminating means 513 has a buffer large enough for two lines data of the Y signal 570 and for line data of the M signal 571, and gets logical OR of the Y signal with a delay by two lines, the M signal with a delay by one line and the C signal with no delay and outputs the discriminating signal 553. The buffers can easily be structured with well-known means.

The delay means 511 adjusts the operational timing of the coating means 510 and the recording means 512. Since the discriminating means H11 is output with a delay of two pulses of the line signal from the Y signal Y11, the delaying means 511 generates the Yout signal Yo11 which is delayed by three pulses of the line signal from the Y signal Y11. Similarly, the delaying means 511 generates the Mout signal Mo11 and the Cout signal Co11, both of which are delayed by three pulses of the line signal from the M signal M11 and the C signal C11, respectively. The Yout signal 573, the Mout signal 574 and the Cout signal 575 are input into the Y head 540, the M head 541 and the C head 542, respectively. In order to execute the above operations, the delaying means 511 has buffers large enough of 3 line data each for the Y signal 570, the M signal 571 and the C signal 572 and are easily structured with well-known means.

The operation of the inkjet recording apparatus according to this embodiment will be explained below. The operation is essentially the same as in the embodiment 2-9 to the point where the carriage 516 shifts to the home position 605 and inkjet recording is initiated.

As shown in FIG. 37, while synchronized to the driving clock 563, the Y signal 570, the M signal 571 and the C signal 572 are input into the discriminating means 513 and the delaying means 511. While synchronized to the driving clock 563, the lead crew 517 turns and the carriage 516 shifts by one dot at a time towards the arrow signal 604 in the main scanning direction. The discriminating means 513 decides if it is a recording picture element out of the Y signal 570, the M signal 571 and the C signal 572, which correspond to the same picture element, and outputs the discriminating signal 553 into the coating means 510. The coating means 510 coats the coating material on the recording medium according to the discriminating signal 553. Taking the positioning difference between the coating means 510 and the recording means 512 into consideration, the delaying means 511 generates the Yout signal 573, the Mout signal 574 and the Cout signal 575, all of which have a delay of three pulses from the Y signal 570, the M signal 571 and the C signal 572, respectively. The Yout signal 573, the Mout signal 574 and the Cout signal 575 are input into the Y head 540, the M head 541 and the C head 542, respectively, and each head discharges the recording ink on the coating material coated on the recording medium.

By repeating the operation described above, the coating material can be coated on the recording medium and the recording ink can be recordinged on the coating material. As a result, high quality color recording can be realized without regard to the type of recording medium used.

(The Embodiment 2-11)

The embodiment 2-11 will be explained below with reference to FIG. 33, FIG. 36, FIG. 38 and FIG. 39.

Figure 38A:
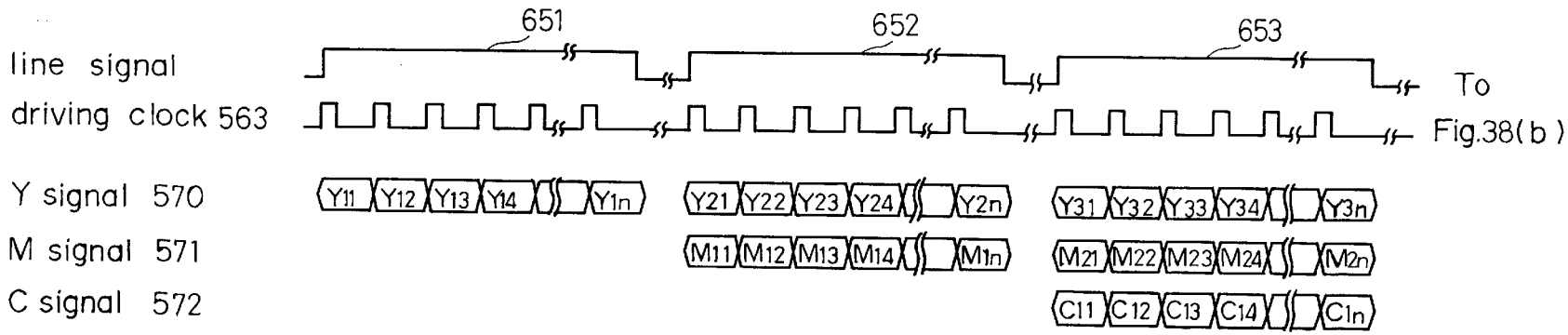
FIG. 38 shows a timing chart of operations of discriminating means and delaying means of an inkjet recording apparatus according to this invention.
Figure 38B:
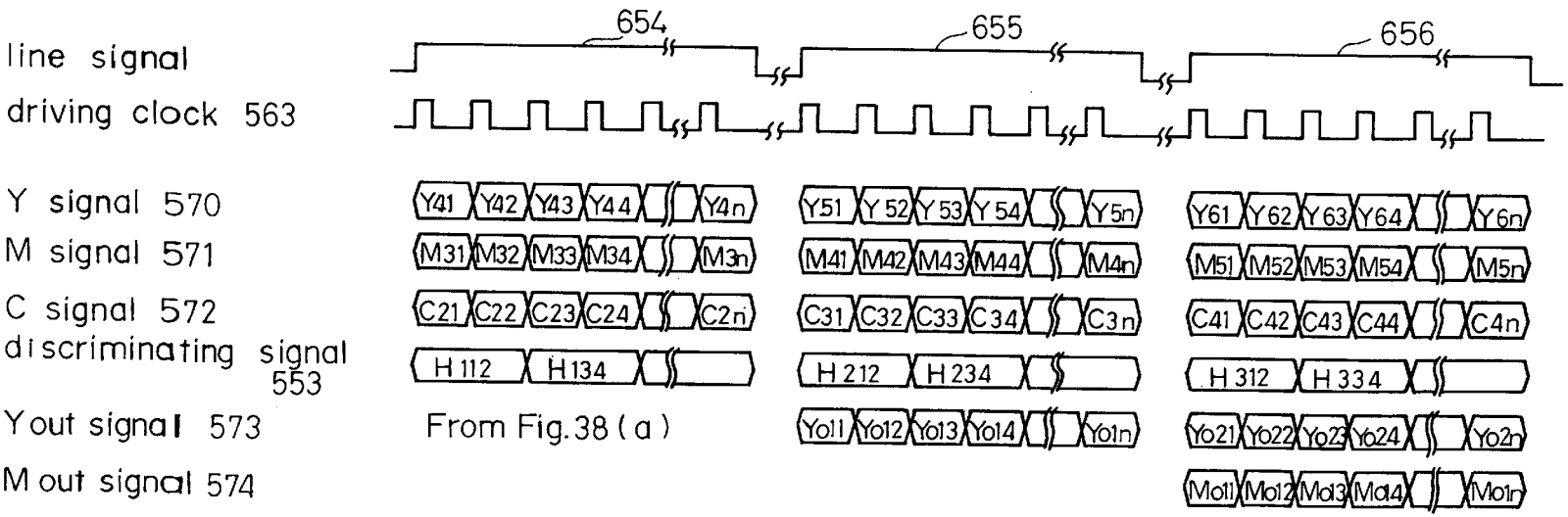
Figure 39:
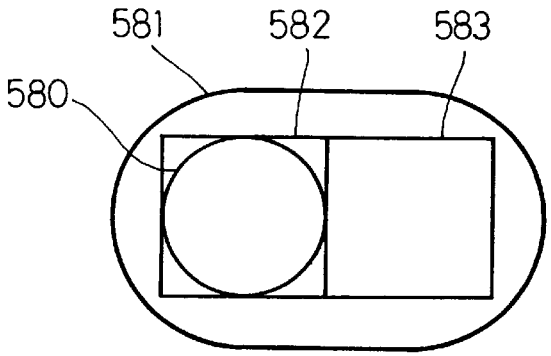
FIG. 39 shows an explanatory drawing of the relation between ink and coating material on a recording medium an inkjet recording apparatus according to this invention.

FIG. 38 shows a timing chart of operations of the discriminating means and the delaying means. FIG. 39 shows an explanatory drawing of relations between the recording ink and the coating materials. In FIGS. 33, 36, 38 and 39, the same parts and/or components are designated with the same reference numbers. Therefore, a description of components already described in the previous embodiments is omitted.

FIG. 33 is as described above with respect to FIG. 31 of the embodiment 2-10 except that the output timings of the discriminating signal 553, the Yout signal 573, the Mout signal 574 and the Cout signal 575 in the present embodiment are different.

FIG. 36 is as described above with respect to FIG. 34 of the embodiment 2-10 except that the resolution of the coating means 510 in this embodiment is one-half that of the Y head 540, the M head 541 and the C head 542. For example, the resolution of the coating means 510 is 150 dots/inch (DPI) which is half of 300 DPI, the resolution of the Y head 540, the M head 541 and the C head 542.

The operation of the discriminating means 513 and the delaying means 511 is explained below.

Taking into consideration that the fixed positions of the Y head 540, the M head 541 and the C head 542 have an interval by one line sequence, the Y signal 570, the M signal 571 and the C signal 572 are input into the discriminating means 513 and the delaying means 511 synchronized to the driving clock 563 as shown in FIG. 38. Since the driving clock 563 is synchronized to movement of the carriage, the carriage shifts by one dot length per one clock pulse towards the arrow signal 604 in the main scanning direction, and the line signal shows a valid range in a line of the Y signal 570, the M signal 571 and the C signal 572.

When at least one or more of recording pulse(s) is/are included in the neighboring two picture element pulses of each of the Y signal 570, the M signal 571 and the C signal 572, that is, six pulses in total, the discriminating signal 553 is output from the discriminating means 513. For example, when at least one or more recording pulses is/are included in the six signals of the Y signal Y11, the M signal M11 and the C signal C11, which correspond to the first picture element, and the Y signal Y12, the M signal M12 and the C signal C12, which correspond to the second picture element, the discriminating means 513 outputs the discriminating signal H112 into the coating means 510, and the coating means 510 coats the coating material on the recording medium according to the discriminating signal H112. Likewise, when at least one or more recording pulse(s) is/are included in six signals of the Y signal Y13, the M signal M13 and the C signal C13, which correspond to the third picture element, and the Y signal Y14 , the M signal M14 and the C signal C14, which correspond to the fourth picture element, the discriminating signal H134 is output into the coating means 510, and the coating means 510 coats the coating material on the recording medium according to the discriminating signal H134.

In order to execute the above operations, the discriminating means 513 has a buffer large enough for three line data of the Y signal 570, a buffer large enough for two line data of the M signal 571 and a buffer large enough for a line data of the C signal 572, and gets logical OR of the Y signal which is delayed by three lines, the M signal which is delayed by two lines and the C signal which is delayed by one line, and finally outputs the discriminating signal 553. The buffers can be easily structured by well-known means.

The delaying means 511 adjusts the operation timing of the coating means 510 and the recording means 512. Since the discriminating signal H112 is output with the delay of three pulses of the line signal from the Y signal Y11, the delaying means 511 generates the Yout signal Yo11 which has four pulses delay of the line signal from the Y signal Y11. Likewise, the Mout signal Mo11 and the Cout signal Co11 which have four pulses delay of the line signal from the M signal M11 and the C signal C11, respectively, and the Cout signal Co11, not shown, are generated. The Yout signal 573, the Mout signal 574 and the Cout signal 575 are input into the Y head 540, the M head 541 and the C head 542, respectively. In order to execute the above operations, the delaying means has buffers large enough for four lines data of the Y signal 570, the M signal 571 and the C signal 572, respectively, and the buffers can be easily structured with well-known means.

Next, the operation of the inkjet apparatus according to the present embodiment will be explained below.

The operation of the inkjet apparatus is the same as described above with respect to the embodiment 2-10 until the carriage 516 is moved to the home position 605 and a recording operation is initiated. Thereafter, as shown in FIG. 38, the Y signal 570, the M signal 571 and the C signal 572 are input into the discriminating means 513 and the delaying means 511 synchronized to the driving clock 563. The lead screw 517 then turns and the carriage 516 shifts one dot at a time towards the arrow signal 604 in the main scanning direction while synchronized to the driving clock 563. The discriminating means 513 then outputs the discriminating signal 553 to the coating means 510. When the discriminating means 513 decides if a recording picture element pulse in out of the neighboring two picture element pulses of the Y signal 570, the M signal 571 and the C signal 572, the coating means 510 coats the coating material on the recording medium according to the discriminating signal 553. The delaying means 511 generates the Yout signal 573, the Mout signal 574 and the Cout signal 575 which has four pulses delay of the line signal from the Y signal 570, the M signal 571 and the C signal 572, respectively, taking into account the different fixed positions between the recording means 512 and the coating means 510. The Yout signal 573, the Mout signal 574 and the Cout signal 575 are input into the Y head 540, the M head 541 and the C head 542, respectively, and each head discharges the recording ink and recordings on the coating material coated by the coating means 510.

Since the resolution of the coating means 510 in the present embodiment is half of that of the inkjet recording head in the recording means 512, two neighboring picture elements can be coated during each coating. As a result, by repeating the foregoing operation, the coating area 581 is assumed to include two picture elements, and the recording ink dying area 580 is set on the coating area described above when at least one of the picture elements 582 and 583 is a recording picture element as shown in FIG. 39. However, the present invention is not limited to the example shown in FIG. 39. For example, the present invention can be practiced even when at least one of two neighboring picture elements in the subscanning direction is recordinged.

Moreover, in the present invention the resolution of the coating means is one fourth of that of the recording head and the area of four picture elements is coated when at least one or more of the neighboring four picture elements, in the main scanning direction and in the subscanning direction, respectively, is recordinged.

The structure of the inkjet recording head used for the coating means in the embodiments 2-6 through 2-11 is the same as the structure of the inkjet recording head described for the embodiments 2-3 through 2-4, however, it is not limited to such structure.

Although the coating and the recording operations described with respect to the embodiments 2-6 through 2-11 have been defined as one dot per line, the present invention can also be practiced with a line comprising a plurality of dots defined in the subscanning direction. In the latter case, expansion of the memory capacity for the delay means is necessary. Although the present invention has been exemplified in a printer, it is understood that the present invention can also be applied to a facsimile, a copier, etc.

It is also understood that the relation between the coating head and the inkjet recording head as described above with respect to the embodiments 2-3 through 2-5 is also applicable to the inkjet recording apparatus described above with respect to the embodiments 2-6 through 2-11, and is also applicable to a facsimile or a copier.

From the foregoing description, it will be appreciated that an inkjet recording apparatus is disclosed which discharges the recording ink and forms a high quality image on a recording medium according to a recording signal without regard to the type of recording medium used. Furthermore, the foregoing object is accomplished by providing coating means which coats the coating material on the recording medium before the inkjet recording ink is recordinged to form an image on the recording medium according to the recording signal, delaying means which delays the recording signal, and recording means which recordings according to an output signal from the delaying means. Since the coating area is determined according to the recording signal, the coating material is not wasted and waving of paper due to the coating of a high volume of the coating material is avoided in the case where the recording medium is a paper, thereby improving the quality of the recording. It is also understood that the coating material described in the embodiments 1-1 through 1-3 can also be applied to the inkjet recording apparatus described in the embodiments 2-1 through 2-11.

Although in the embodiments 2-1 through 2-5 a specific type of coating material has been selected, the selection of any coating material according to this invention can realize good results. Moreover, although the type of coating material has not been specified in the embodiments 2-6 through 2-11, selected results can be obtained when the coating material selected is as described above for the embodiments of FIGS. 1-1 through 2-5.

(The Embodiment 3-1)

The embodiment 3-1 is explained hereunder in conjunction with FIGS. 41–45.

Figure 41:
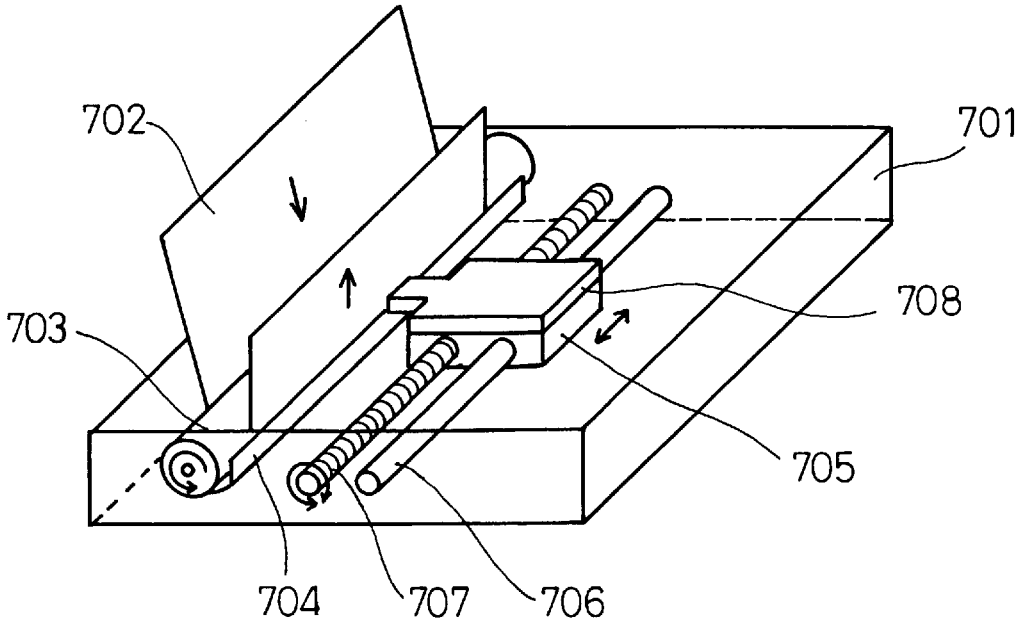
FIG. 41 shows a drawing of an outline structure of an inkjet printer embodying the inkjet recording apparatus according to this invention.

FIG. 41 shows a strabismus drawing of an outline structure of a drop on-demand type inkjet printer. A frame 701 houses the components of the printer. A platen roller 703 is rotated by a driving motor (not shown) for feeding a recording medium 702, such as plain paper, towards the arrow signal. A paper guide 704 is disposed parallel and adjacent to the platen roller 703 for frictionally guiding the feeding of the recording medium 702 in the direction of the arrow signal. A lead screw 707 converts forward and reverse rotary motion of the driving motor to linear reciprocating motion parallel to the recording field. A carriage 705 slides reciprocally on a guide rail 706, and an inkjet recording head 708 is fixed on the carriage 705 and executes inkjet recording on the recording medium 702. The inkjet recording head 708 comprises a plurality of nozzles for discharging ink in a timed manner according to an inkjet recording signal. A tank (not shown) for storing the ink is included in the printer.

The inkjet recording head 708 in this embodiment can be structured in several ways according to the principle of ink grain or particle discharge methods. The typical methods are the following two. One is a method in which a pulse signal is charged on a piezo-electric element which is fixed in the ink passage and which is mechanically distorted, and then a pressure wave is generated by which a grain of ink is discharged from the nozzle. In another method, a pulse signal is charged on a heater element which is fixed in the ink passage and which is momentarily heated to form bubbles of ink. Pressure generated by the bubbles causes a grain of ink to be discharged from the nozzle.

A drop on-demand type inkjet printer with the structure described above recordings inkjet recording ink on the recording medium 702 by shifting the recording medium 702 and the inkjet recording head 708, which discharges the ink on the recording medium, relatively towards the arrow signal.

Figure 42:
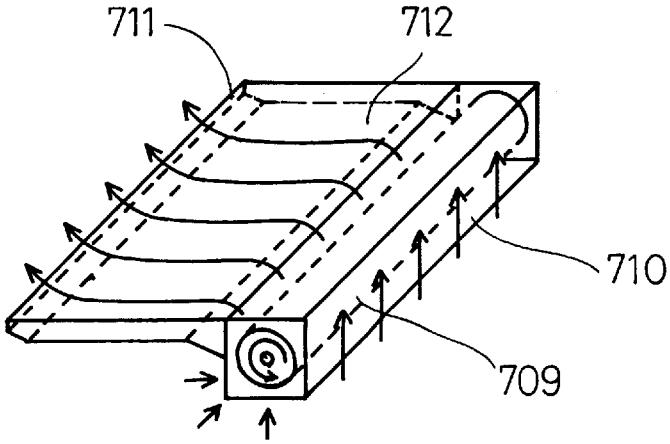
FIG. 42 shows a first embodiment of wind pressure generation means and wind pressure supply means of an inkjet recording apparatus according to this invention.

FIG. 42 shows a strabismus drawing of a wind pressure generation means and a wind pressure supply means in the first embodiment of the inkjet recording apparatus. A duct 712 with a slit-shaped opening 711 is fixed along an outlet at the left upper side of a cross flow fan 710 which has a wide-range runner 709. Wind blown in the direction of the arrow signal from a suction opening fixed under a lower left hand side of the runner 709, which is structured in the cross flow fan 710 and turns counterclockwise (left turn), is blown out from the discharge opening at the upper left end along the circumference of the cover and is guided by the duct 712 towards the opening 711. Wind having a flat, uniform flow is discharged out from the opening 711.

Figure 43:
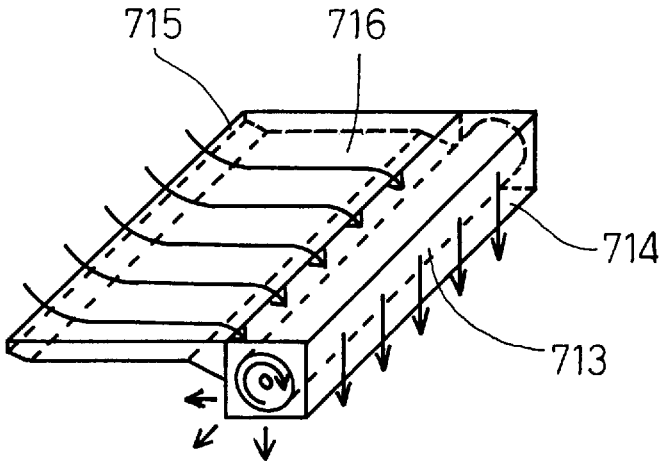
FIG. 43 shows a second embodiment of wind pressure generation means and wind pressure supply means of an inkjet recording apparatus according to this invention.

FIG. 43 shows a strabismus drawing of the wind pressure generation means and the wind pressure supply means in the second embodiment of the inkjet recording apparatus. On the discharge opening at the left upper side of the cross flow fan 714 with the wide-range runner 713, a duct 716 having a slit-shaped suction opening 715 is fixed. The wind absorbed from the suction opening 715 through the force of the runner 713 which turns right (clockwise turn) flows into the duct 716 where it is converted to a flat, uniform flow. The wind flows through the suction opening at the upper left side of the cross flow fan 714 and along the circumference of the runner 713 where it is subjected to a clockwise turn, and is discharged from the discharge opening of the cross flow fan 714 at the under side and the lower left side towards the arrow signal. Suction and blasting is as described above.

Figure 44:
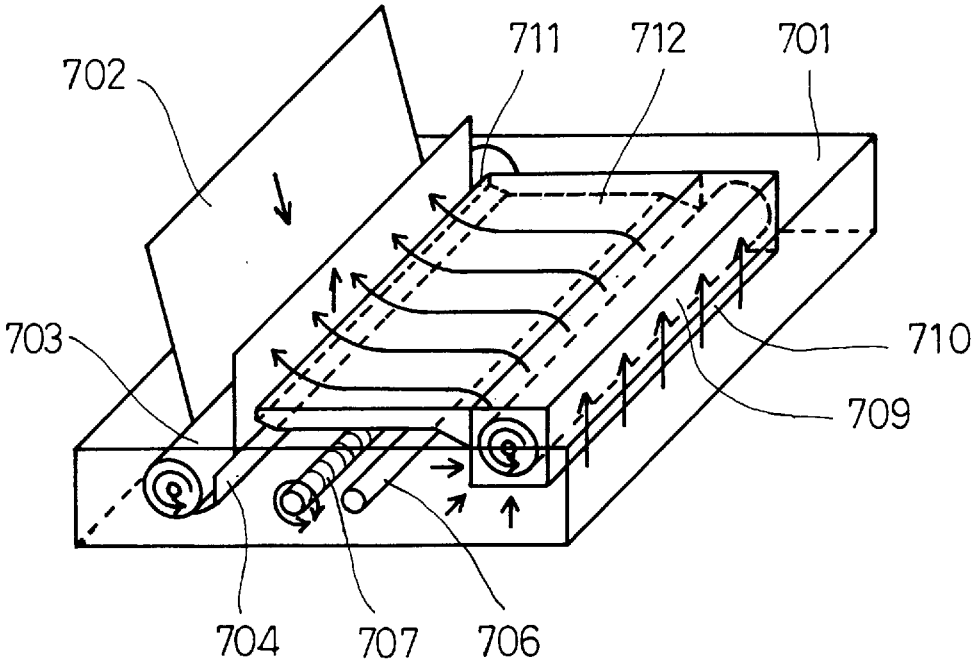
FIG. 44 shows the assembly of the wind pressure generator means and the wind pressure supply means shown in FIG. 41.

FIG. 44 shows a strabismus drawing of the assembly of the first embodiment of the wind pressure generation means and the wind pressure supply means shown in FIG. 42 incorporated in the drop on-demand type inkjet printer shown in FIG. 41. The opening 711 of the duct 712 is fixed on the frame 701 such that the opening 711 is spaced a predetermined distance to the recording medium 702 and parallel to the inkjet recording apparatus. The ink discharged on the recording medium during inkjet recording is rapidly and instantaneously dried up with the pressure of a flat, belt-shaped wind which is discharged from the opening 711 and flows along the surface of the recording medium 702. The wide size of the opening 711 shown here corresponds to the width of the recording medium 702. The wind pressure flows across the entire width of the recording medium 702. When the size of the recording medium 702 is wide, the wind volume of the cross flow fan 710 is approximately 0.5 cubic meters per minute, which will be sufficient enough in capacity for drying.

Figure 45:
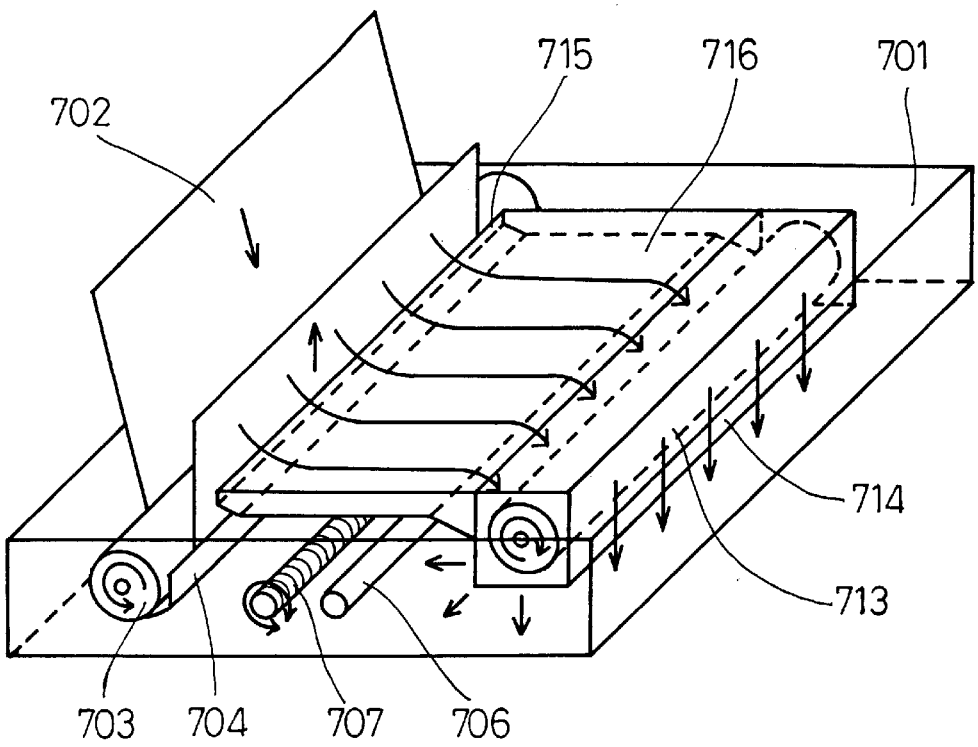
FIG. 45 shows the assembly of the wind pressure generation means and the wind pressure supply means shown in FIG. 41.

FIG. 45 shows a strabismus drawing of the assembly of the second embodiment of the wind pressure generation means and the wind pressure supply means in FIG. 43 incorporated in the drop on-demand type inkjet printer shown in FIG. 41. The opening 715 of the duct 716 is fixed on the frame 701 in a manner that the opening 715 is spaced a predetermined distance parallel to the recording medium 702 of the inkjet recording apparatus. The ink discharged on the recording medium 702 during inkjet recording is rapidly and instantaneously dried up with the pressure of the flat belt-shaped wind which is discharged from the opening 715 and flows along the surface of the recording medium 702. The wide size of the opening 715 shown here corresponds to the width of the recording medium 702 as shown in the embodiment of FIG. 44. The wind pressure flows over the entire width of the recording medium 702. When the size of the recording medium 702 is wide, the wind volume of the cross flow fan 714 should be a little higher in capacity, which will be sufficient enough for drying than that shown in the embodiment of FIG. 44. Although it is not shown in FIG. 45, the surface of the recording medium 702 is suppressed with a star wheel, etc., in the manner of point contact, in order not to block the opening 715 which may be suctioned and then blocked through lifting.

(The Embodiment 3-2)

Figure 46:
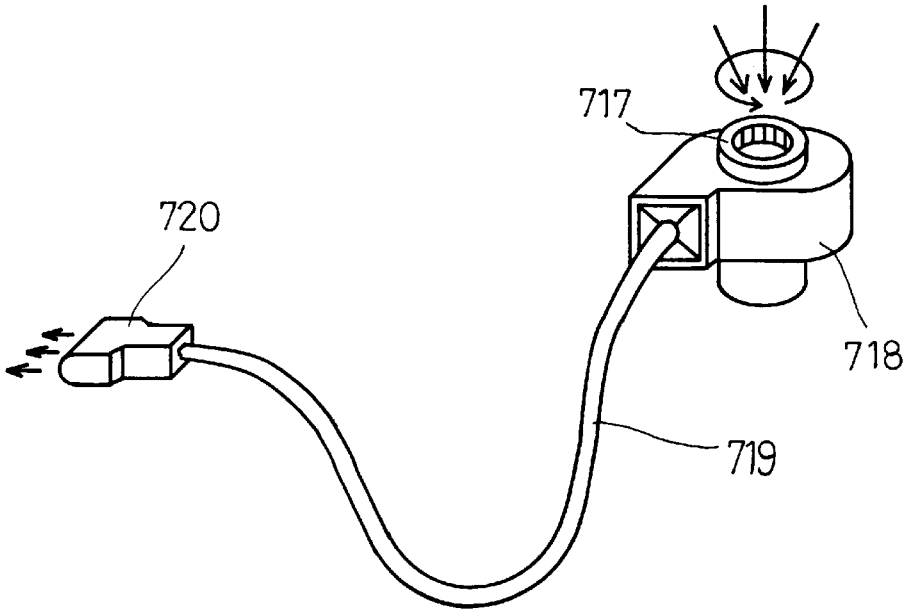
FIG. 46 shows a third embodiment of wind pressure generation means and wind pressure supply means of an inkjet recording apparatus according to this invention.

FIG. 46 shows a strabismus drawing of the assembly of a third embodiment of the wind pressure generation means and the wind pressure supply means in this invention. At the wind discharge opening of a sirocco type fan or blower which supplies the wind with centrifugal force by turning of a runner 717 which is provided with cylindrical-shaped wings, an end of a flexible duct 719 which is tubular in shape is fixed. At another end of the duct 719 is fixed a blast nozzle 720 which discharges the convergent wind. The wind which is suctioned towards the arrow signal direction from the suction opening at the upper end of the runner 717 flows in a counterclockwise direction in the runner 717 along the circumference of the cover and finally flows out of the discharge opening at the side of sirocco fan 718. The converged wind is then guided towards the blast nozzle 720 through the duct 719 and is discharged from the top end of the blast nozzle 720.

Figure 47:
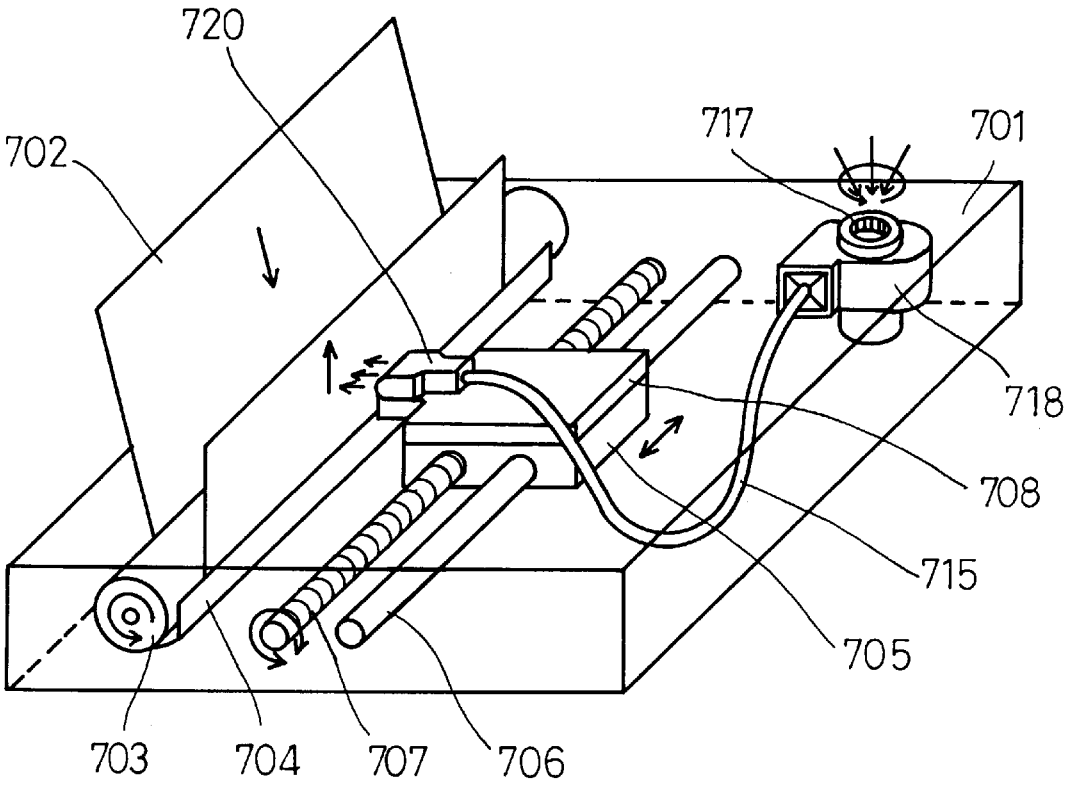
FIG. 47 shows the assembly of the wind pressure generation means and the wind pressure supply means of FIG. 46 onto the inkjet printer of FIG. 41.

FIG. 47 shows a strabismus drawing of the assembly of the third embodiment of the wind pressure generation means and the wind pressure supply means shown in FIG. 46 incorporated in the drop on-demand type inkjet printer shown in FIG. 41. The sirocco fan 718 is fixed on the frame 701, and the blast nozzle 720 is fixed at the neighborhood of the nozzle of the inkjet recording head 708 which is fixed on the carriage 705 and which slides reciprocally along the guide rail 706. The ink discharged on the recording medium 702 during inkjet recording is rapidly and instantaneously dried up with the pressurized wind which flows on the surface of the recording medium 702 and is discharged from the top end of the blast nozzle 720 which slides reciprocally integrally with the inkjet recording head 708. Since the sirocco fan 718 is used as the wind pressure generation means in this embodiment, it is possible to supply high pressured and convergent wind. Moreover, by fixing one end of the duct 719 to the side of the wind suction opening of the sirocco fan 718, the suction blower type wind pressure supply means can also be realized as shown in the embodiment of FIG. 45. Preferably, the hydrostatic pressure level of the sirocco fan 718 should be 1.5 mm Hg or higher for effecting rapid and instantaneous drying of the ink on the recording medium 702.

(The Embodiment 3-3)

Figure 48:
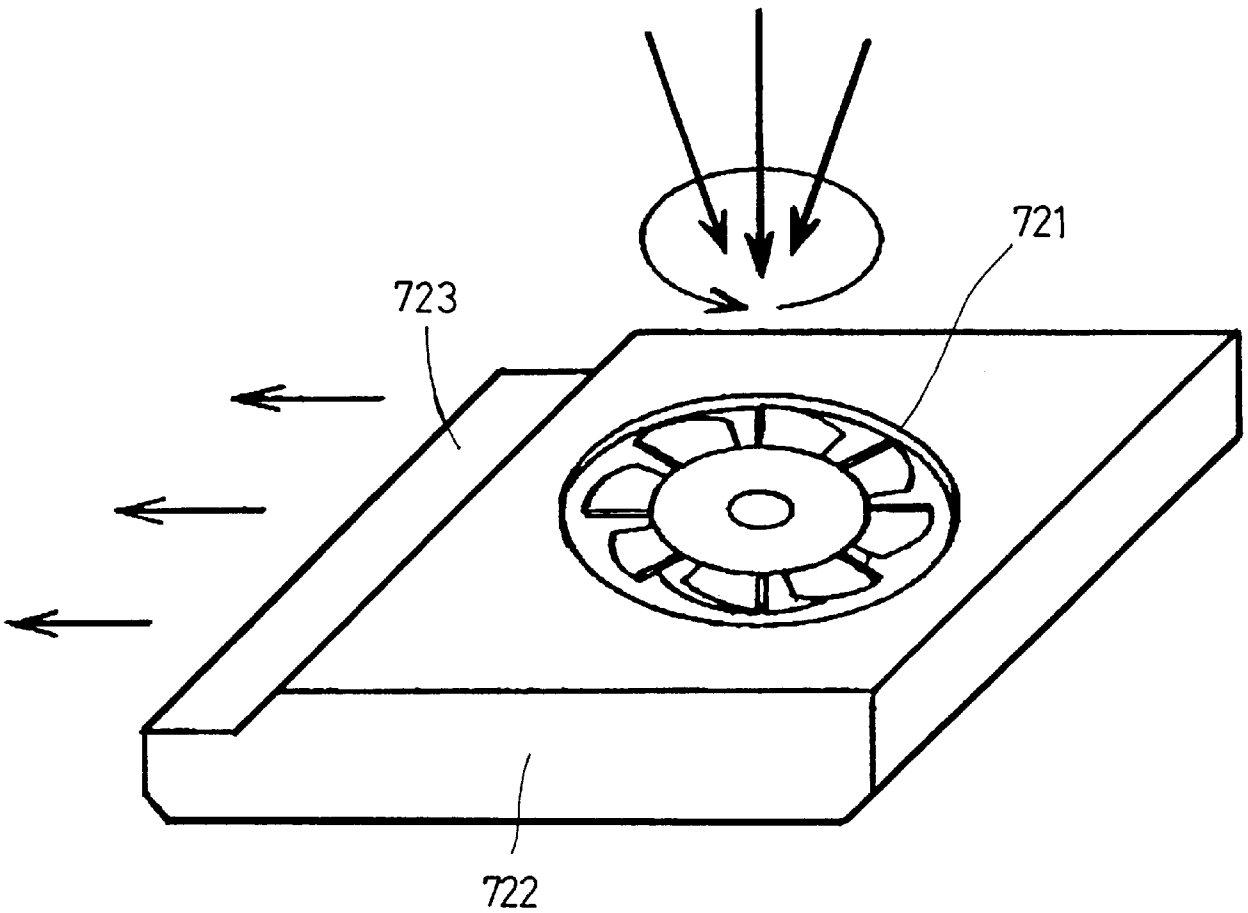
FIG. 48 shows a fourth embodiment of wind pressure generation means and wind pressure supply means of an inkjet recording apparatus according to this invention.

FIG. 48 shows a strabismus drawing of a fourth embodiment of the wind pressure generation means and the wind pressure supply means of the inkjet recording apparatus in this invention. A structure including a duct with an opening 723 is organized uniformly in an axial fan 722 having wings constituting a propeller fan 721. The wind which is sucked towards the arrow signal from the suction opening fixed on the upper side of the wings 721 turn counterclockwise, flows through the duct of the axial fan 722, is converged at the discharge opening 723 and is finally discharged.

Figure 49:
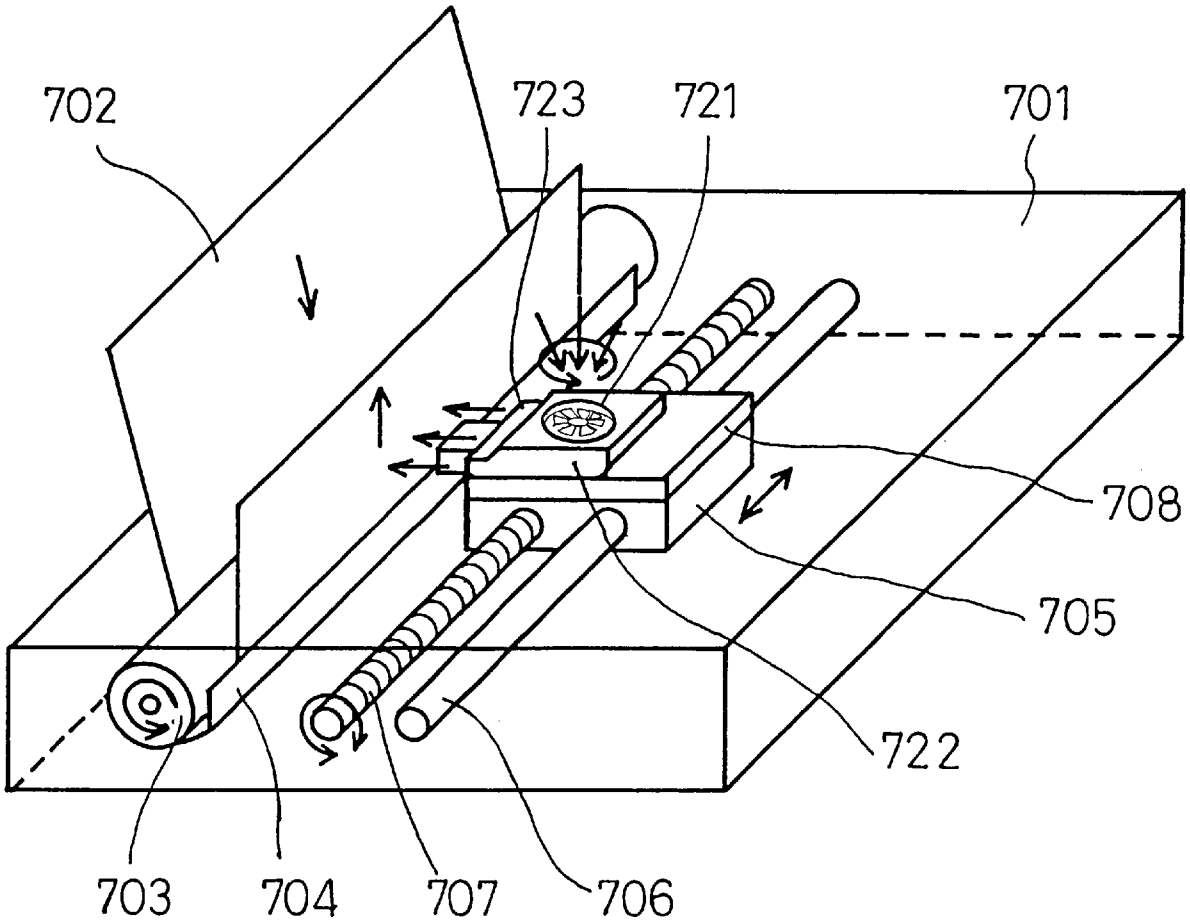
FIG. 49 shows the assembly of the wind pressure generation means and the wind pressure supply means of FIG. 48 onto the inkjet printer of FIG. 41.

FIG. 49 shows a strabismus drawing of assembly of a fourth embodiment of the wind pressure generation means and the wind pressure supply means shown in FIG. 48 incorporated in the drop on-demand type inkjet printer shown in FIG. 41. The axial fan 722 is fixed at the neighborhood of the nozzle of the inkjet recording head 708 which is fixed on the carriage 705 and which slides reciprocally along the guide rail 706. The ink discharged on the recording medium 702 during inkjet recording is rapidly and instantaneously dried up with the wind pressure which is discharged from the opening 723 of the axial fan 722 which is integral and slides reciprocally with the inkjet recording head 708 and flows along the surface of the recording medium 702. Since the axial fan 723 is used as the wind pressure generation means in this embodiment, it is possible to obtain a higher volume of wind and, by reversing the rotational direction of the wings 721, the suction wind type means shown in the embodiment of FIG. 45 can also be realized. The wind volume of the axial fan may be sufficient enough for drying if the flow velocity is 0.2 cubic meter per minute.

(The embodiment 3-4)

Figure 50:
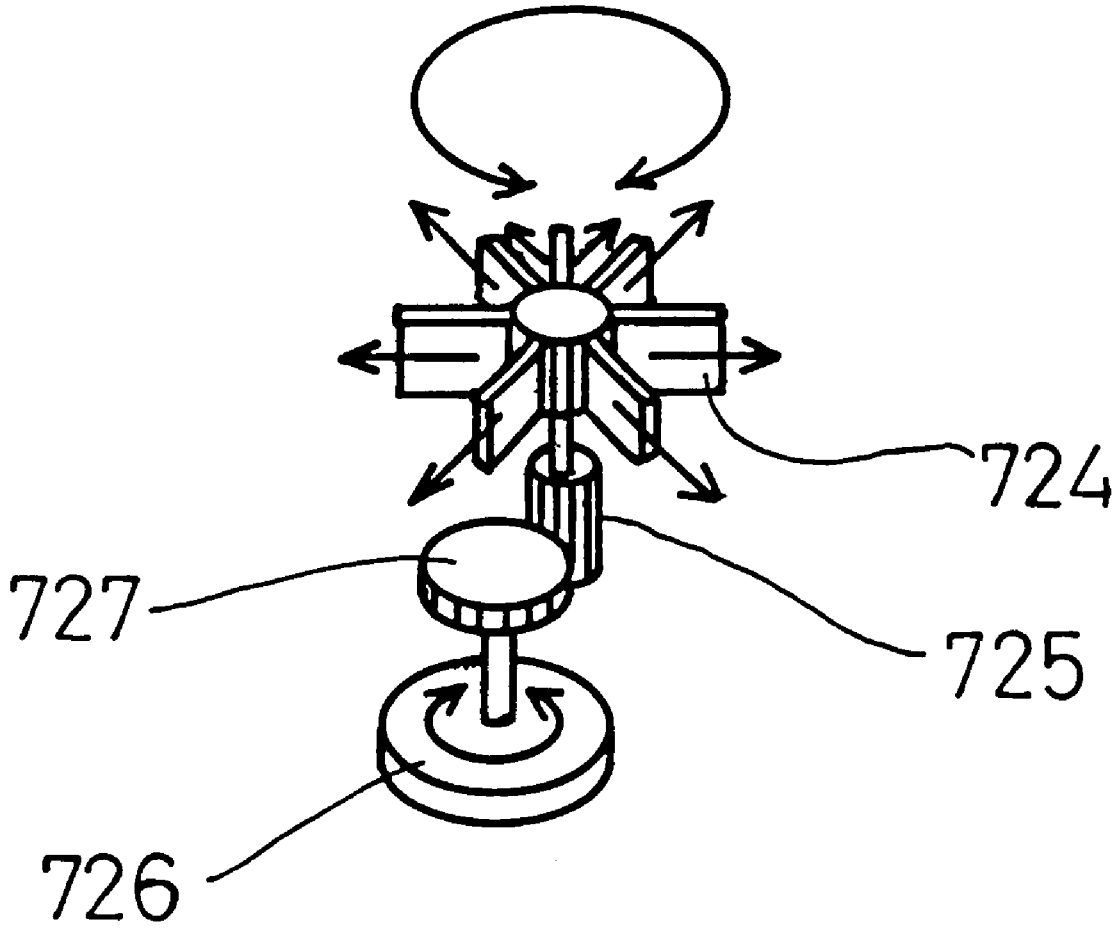
FIG. 50 shows a fifth embodiment of wind pressure generation means and wind pressure supply means of an inkjet recording apparatus according to this invention.

FIG. 50 shows a strabismus drawing of a fifth embodiment of the wind pressure generation means and the wind pressure supply means of the inkjet recording apparatus according to the present invention. A small cogwheel 725 is fixed at the lower end of a shaft of a runner 724 having wings along a circumferential direction. A cogwheel 727 is connected to a friction roller 726 and is in meshing engagement with the cogwheel 725. The cogwheel 725, the runner 724, the cogwheel 727 and the friction roller 726 constitute a wind supply unit. When the friction roller 726 is rotated clockwise or counterclockwise, a torque acceleration, which depends on the ratio of number of teeth between the cogwheel 727 and the small cogwheel 725, is transferred to the runner 724. The torque rotates the runner 724 and wind is generated in a radial direction from the runner 724. In order to increase the wind supply performance, it is also possible to form a duct with an opening as a wind pressure supply means, if necessary.

Figure 51:
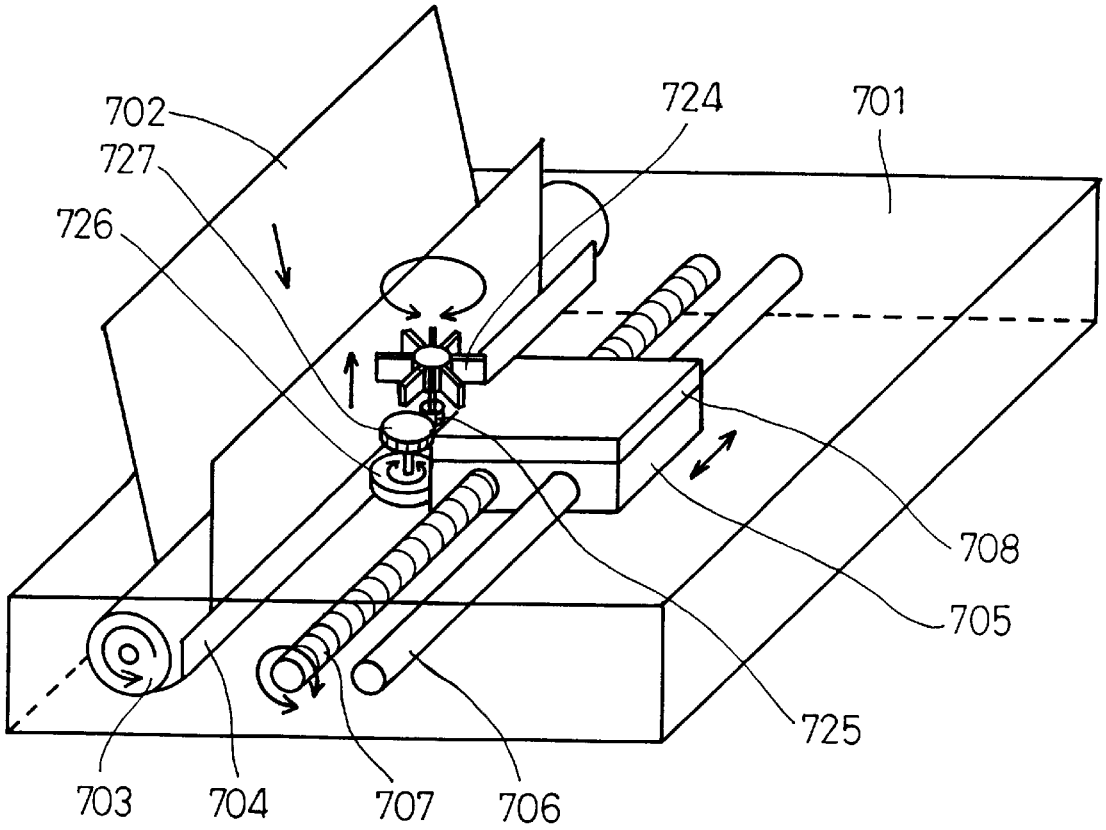
FIG. 51 shows the assembly of the wind pressure generation means and the wind pressure supply means of FIG. 50 onto the inkjet printer of FIG. 41.

FIG. 51 shows a strabismus drawing of the assembly of the fifth embodiment of the wind pressure generation means and the wind pressure supply means shown in FIG. 50 incorporated in the drop on-demand type inkjet printer shown in FIG. 41. The wind supply unit, which comprises the runner 724, the small cogwheel 725, the friction roller 726 and the cogwheel 727, is fixed at the neighborhood of the nozzle of the inkjet recording head 708 which is disposed on the carriage 705 and which reciprocally slides along the guide rail 706. Moreover, a peripheral portion of the friction roller 726 is pressed at the side of the paper guide 704 with spring force or elastic stress while being rotatable. The friction roller 726 shown here rotates with contact to the side of the paper guide 704 and the torque generated as a result of its rotation is accelerated according to the ratio of number of teeth of the cogwheel 727 to the number of teeth of the small cogwheel 725, and is transmitted to the runner 724 to generate wind around the runner 724. The ink discharged on the recording medium 702 during inkjet recording is rapidly and instantaneously dried up by pressurized wind supplied from the runner 724 which reciprocally slides integrally with the inkjet recording head 708 and flows along the surface of the recording medium 702. Since no power force is necessary in the wind supply unit in this embodiment, miniaturization and/or simplification of the wind pressure generation means and the wind pressure supply means is possible. Furthermore, wind volume and hydrostatic pressure generated at the runner 724 is optimized through planning and control of the tooth number ratio coefficient with respect to the cogwheel 727 and the small cogwheel 725, the number of wings of the runner 724 and/or the area of its wings, the reciprocal sliding speed of the carriage 705, etc. The contact portion between the paper guide 704 and the friction roller 726 can also be realized with a small size rack and gear instead.

Figure 52:
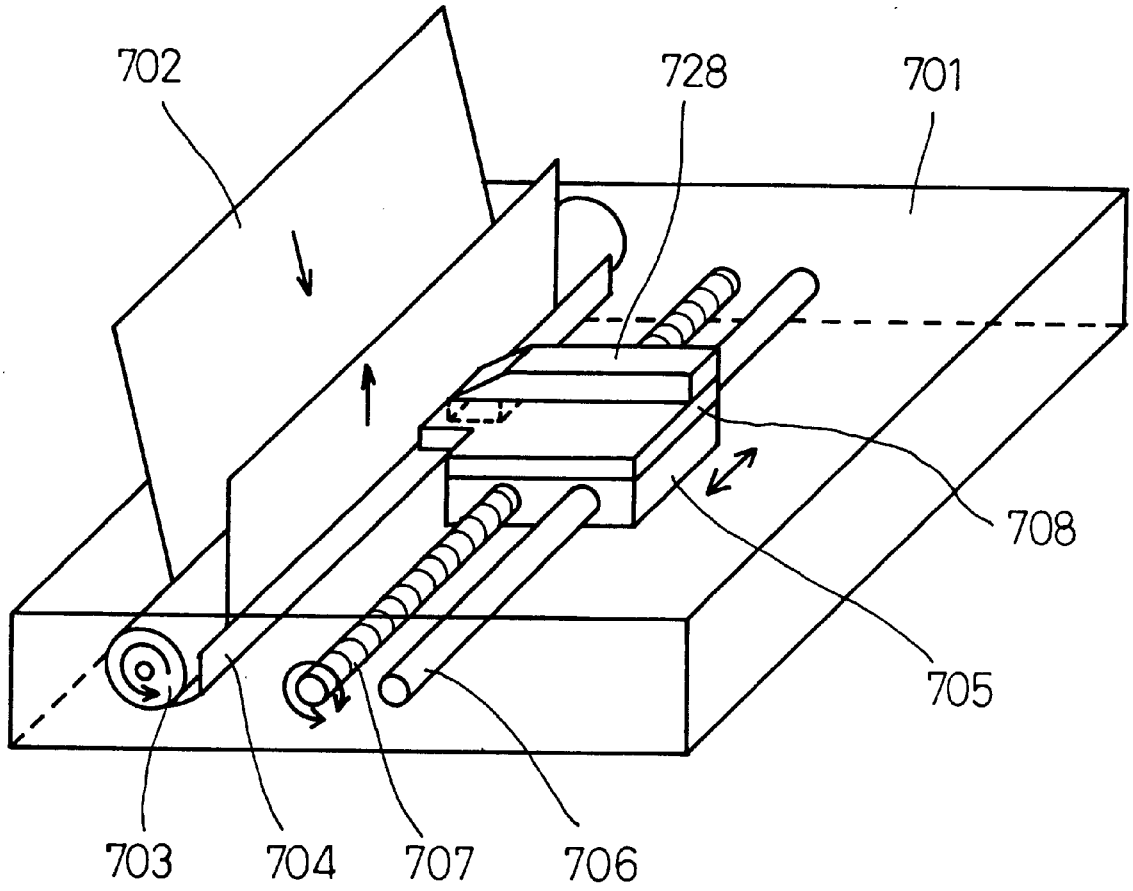
FIG. 52 shows the assembly of an embodiment of coating means onto the inkjet printer of FIG. 41.

FIG. 52 shows a strabismus drawing of the assembly of an embodiment of a coating means incorporated in the drop on-demand type inkjet printer shown in FIG. 41. The coating head 728 which discharges the liquid coating material on the recording medium 702 is fixed at the neighborhood of the inkjet recording head 708 which is fixed on the carriage 705 and which slides reciprocally along the guide rail 706. The coating head 728 has a head which particularizes the coating material and discharges it from a plurality of nozzles according to the coating signal, and a coating material liquid tank in which the coating material is stored. In this embodiment, the head and the liquid tank are integrally formed as a uniform body with the coating head 728.

The coating head 728 can also be structured with a Kayser method, a thermal method, etc., as with the inkjet recording head 708. The coating liquid may be discharged from the nozzle in spray form using the force of high pressure gas or compressed air. As for the coating material, a water soluble material such as polyvinyl alcohol which is saponified completely, polyvinyl alcohol which is saponified partially, and which is less expensive than conventional coating materials may be used. For example, the coating liquid having the following composition may be used.

| | |
|---|---|
| Polyvinyl alcohol which is saponified partially, of 1000 average degree of polymerization and 84.5% degree of saponification | 1.5 weight % |
| Ion-exchanged water | 78.5 weight % |
| Ethanol | 15.0 weight % |
| Diethylene glycol | 5.0 weight % |

The coating material shown in the embodiments 1-1 through 1-3 are also applicable in this embodiment. Although not shown in the Figures, it is understood that the wind pressure generation means and the wind pressure supply means shown in the first through the fifth embodiments can be assembled on the drop on-demand type inkjet printer in which the coating means according to the present embodiment has been incorporated.

Moreover, it is understood by those skilled in the art that the wind pressure generation means and the wind pressure supply means shown in the foregoing first through fifth embodiments above can be incorporated into the inkjet recording apparatus described above with respect to the embodiments 2-1 through 2-11.

The coating liquid, which is discharged on the recording medium 702 from a plurality of nozzles of the coating head 728 which reciprocally slides integrally with the inkjet recording head 708 just before inkjet recording in a manner that the coating covers adequately the whole area by a dot or by a line, is dried rapidly and instantaneously by the blast wind or the suction wind from the wind pressure generation means and the wind pressure supply means, thereby completing the coating operation.

After the coating process, inkjet recording is initiated. The ink which is discharged from the inkjet recording head 708 on the recording medium 702 coated with the coating material is dried rapidly and instantaneously by the wind pressure generation means and the wind pressure supply means similarly as during the coating operation, thereby anchoring the ink on the recording medium 702 to complete the inkjet recording operation. During the anchoring process, the recording medium 702 processed with a coating material comprised of polyvinyl alcohol which is saponified partially, etc., has almost the same ink anchoring capacity as with the specific coated paper specialized for the inkjet recording. This ink anchoring function temporarily suppresses the bleeding of the ink by catching the ink at the coated layer just before the ink which is going to infiltrate into the inside of the recording medium 702 reaches the fiber of the recording medium 702. By the wind supply or the absorption type wind supply function of the wind pressure generation means and the wind pressure supply means being provided to the inkjet recording apparatus according to the present invention, bleeding of the ink due to water in the ink is suppressed, thereby accelerating the inkjet recording operation.

According to the foregoing embodiments shown in FIG. 41 through FIG. 52, a greater positive effect can specifically be realized in which inkjet recording is done at a higher speed and with a higher quality image state when plain paper is used as the recording medium. Even in the case that OHP sheet made of transparent plastic film is used as the recording medium, a stable inkjet recording operation can be realized with higher speed and a higher quality image state.

From the foregoing description, it can be seen that inkjet recording can be performed with stability and at a higher speed and a higher quality of image state, thereby solving the problems concerning inkjet recording in the prior art by forcefully and speedily discharging and/or diffusing excessive water and discharged ink which is contained in or brought into contact with the recording medium into the air through the wind pressure generation means and the wind pressure supply means. Accordingly, suppression of ink bleeding and shortening of the drying time of the ink can be realized during the ink anchoring process.

Moreover, by providing coating means having a coating material which is less expensive than prior art coating materials, and by coating the coating material on the recording medium just before the recording ink is discharged on the recording medium, inkjet recording with higher quality image can be realized at a lower cost without regard to the type of recording medium used. Furthermore, a more stable and a lower cost inkjet recording apparatus can be realized since the drying process of the ink and the coating liquid is achieved not through a heating means but through wind pressure generation means and wind pressure supply means. Accordingly the inkjet recording apparatus according to the present invention constitutes a significant improvement over the prior art.

What is claimed is:

1. An inkjet recording apparatus comprising:

inkjet recording means for discharging recording ink according to a recording signal and for recording on a recording medium, the inkjet recording means comprising at least one first orifice for discharging the recording ink on the recording medium, a first passage in communication with the first orifice for receiving a supply of the recording ink, and first heating means for heating the recording ink supplied to the first passage; and coating means for coating a coating material on the recording medium prior to recording by the inkjet recording means, the coating means comprising at least one second orifice for discharging the coating material on the recording medium, a second passage in communication with the second orifice for receiving a supply of the coating material, and second heating means for heating the coating material supplied to the second passage.

2. An inkjet recording apparatus according to claim 1, further comprising control means for controlling the first and second heating means so that the second heating means generates a greater amount of heat energy than that generated by the first heating means.

3. An inkjet recording apparatus according to claim 1; wherein the inkjet recording means further comprises a plurality of first orifices, and the coating means further comprises a plurality of second orifices.

4. An inkjet recording apparatus according to claim 3; wherein the number of the first orifices of the inkjet recording means is an integer multiple of the number of the second orifices of the coating means.

5. An inkjet recording apparatus according to claim 1; further comprising means for supplying a head current to the first heating means and the second heating means for a predetermined duration time.

6. An inkjet recording apparatus according to claim 5; wherein at least one of the head current and the head current duration time supplied to the second heating means is greater than a corresponding one of the head current and the head current duration time supplied to the first heating means.

7. An inkjet recording apparatus comprising:

coating means for coating a coating material on a recording medium according to a recording signal, the coating means comprising at least one orifice for discharging the coating material on the recording medium and a passage in communication with the orifice for receiving a supply of the coating material;

delay means for delaying the recording signal for a predetermined amount of the time and outputting a delay signal;

inkjet recording means for discharging recording ink according to the delayed recording signal and for recording on the recording medium, the inkjet recording means comprising at least one orifice for discharging the recording ink on the recording medium and a passage in communication with the orifice for receiving a supply of the recording ink;

wherein the inkjet recording means further comprises first heating means for heating the recording ink supplied to the passage of the inkjet recording means, and the coating means comprises second heating means for heating the coating material supplied to the passage of the coating means.

8. An inkjet recording apparatus according to claim 7; further comprising control means for controlling the first and second heating means so that the second heating means generates a greater amount of heat energy than that generated by the first heating means.

9. An inkjet recording apparatus comprising:

inkjet recording means for discharging recording ink according to a recording signal and for recording on recording medium, the inkjet recording means having first heating means for heating the recording ink;

coating means for coating a coating material on the recording medium prior to recording by the inkjet recording means, the coating means having second heating means for heating the coating material; and control means for controlling the first and second heating means so that heat energy generated by the second heating means is greater than the heat energy generated by the first heating means.

10. An inkjet recording apparatus according to claim 9, wherein the coating material comprises one of polyvinyl alcohol which is saponified completely and polyvinyl alcohol which is saponified partially.

11. An inkjet recording apparatus according to claim 10, wherein the polyvinyl alcohol has a saponification degree of at least 97.5%.

12. An inkjet recording apparatus according to claim 10; wherein the polyvinyl alcohol has a saponification degree of 60% to 97.5%.

13. An inkjet recording apparatus according to claim 10, wherein the polyvinyl alcohol has a polymerization degree of 150–750 is present in the coating material in an amount of 0.2 wt. % to 30 wt. %.

14. An inkjet recording apparatus according to claim 10; wherein the polyvinyl alcohol has a polymerization degree of 750–2000 and is present in the coating material in an amount of 0.1 wt. % to 20 wt. %.

15. An inkjet recording apparatus according to claim 10; wherein the polyvinyl alcohol has a polymerization degree of 2000–5000 and is present in the coating material in an amount of 0.05 wt. % to 15 wt. %.

16. An inkjet recording apparatus comprising:

inkjet recording means for discharging recording ink according to a recording signal and for recording on a recording medium, the inkjet recording means having at least one first orifice having a first discharge diameter for discharging the recording ink, a first passage in communication with the first orifice for receiving a supply of the recording ink, and first heating means for heating the recording ink supplied to the first passage;

coating means for coating a coating material on the recording medium prior to recording by the inkjet recording means, the coating means comprising at least one second orifice having a second discharge diameter greater than the first discharge diameter for discharging the recording ink, a second passage in communication with the second orifice for receiving a supply of the coating material, and second heating means for heating the coating material supplied to the passage; and control means for controlling the first and second heating means so that heat energy generated by the second heating means is greater than the heat energy generated by the first heating means.

17. An inkjet recording apparatus according to claim 16; wherein the recording material comprises one of polyvinyl alcohol which is saponified completely and polyvinyl alcohol which is saponified partially.

18. An inkjet recording apparatus comprising:

inkjet recording means for discharging recording ink according to a recording signal and for recording on a recording medium; and a coating unit for coating a coating material having a predetermined thickness on the recording medium prior to recording by the inkjet recording means, the coating unit comprising storage means for storing the coating material, a first roller disposed between the storage means and the recording medium for coating the coating material on the recording material, and a plurality of secondary rollers for supplying the coating material to the first roller.

19. An inkjet recording apparatus according to claim 18, wherein the coating material comprises one of polyvinyl alcohol which is saponified completely and polyvinyl alcohol which is saponified partially.

20. An inkjet recording apparatus according to claim 19, wherein the polyvinyl alcohol has a saponification degree of at least 97.5%.

21. An inkjet recording apparatus according to claim 19; wherein the polyvinyl alcohol has a saponification degree of 60% to 97.5%.

22. An inkjet recording apparatus according to claim 19; wherein the polyvinyl alcohol has a polymerization degree of 150–750 and is present in the coating material in an amount of 0.2 wt. % to 30 wt. %.

23. An inkjet recording apparatus according to claim 19; wherein the polyvinyl alcohol has a polymerization degree of 750–2000 and is present in the coating material in an amount of 0.1 wt. % to 20 wt. %.

24. An inkjet recording apparatus according to claim 19; wherein the polyvinyl alcohol has a polymerization degree of 2000–5000 and is present in the coating material in an amount of 0.05 wt. % to 15 wt. %.

25. An inkjet recording apparatus comprising:

inkjet recording means for discharging recording ink according to a recording signal and for recording on a recording medium, the inkjet recording means comprising at least one first orifice for discharging the recording ink on the recording medium and a first passage in communication with the first orifice for receiving a supply of the recording ink; and coating means for coating a coating material on the recording medium prior to recording by the inkjet recording means, the coating means comprising at least one second orifice for discharging the coating material on the recording medium, a second passage in communication with the second orifice for receiving a supply of the coating material, coating material supply means for supplying the coating material on the recording medium, and gas supply means for supplying a gas to the coating material supply means to supply the coating material as a fine mist.

26. An inkjet recording apparatus comprising: inkjet recording means for discharging recording ink according to a recording signal and for recording on a recording medium, the inkjet recording means having at least one first orifice having a first discharge diameter for discharging the recording ink, a first passage in communication with the first orifice for receiving a supply of the recording ink, and first heating means for heating the recording ink supplied to the first passage; coating means for coating a coating material on the recording medium prior to recording by the inkjet recording means, the coating means comprising at least one second orifice having a second discharge diameter greater than the first discharge diameter for discharging the coating material, a second passage in communication with the second orifice for receiving a supply of the coating material, and second heating means for heating the coating material supplied to the passage; and means for supplying a head current to the first heating means and the second heating means for a predetermined duration of time.

27. An inkjet recording apparatus according to claim 26; wherein at least one of the head current and the head current duration time supplied to the second heating means is greater than a corresponding one of the head current and the head current duration time supplied to the first heating means.

* * * * *